US005998105A

United States Patent [19]

Murakoshi

[11] Patent Number: 5,998,105

[45] **Date of Patent: *Dec. 7, 1999**

[54] METHOD OF IMAGE FORMATION USING SILVER HALIDE COLOR PHOTOGRAPHIC MATERIAL

[75] Inventor: Yasuhiro Murakoshi, Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/753,891

[22] Filed: Dec. 2, 1996

[30] Foreign Application Priority Data

Nov. 30, 1995 [JP] Japan ..... 7-334190

[51] Int. Cl.[6] ..... G03C 7/46

[52] U.S. Cl. ..... 430/375; 430/363; 430/374; 430/383; 430/394; 430/264; 430/598; 430/945

[58] Field of Search ..... 438/363, 374, 438/375, 383, 394, 264, 598, 945

[56] References Cited

FOREIGN PATENT DOCUMENTS 5-19423 1/1993 Japan .

*Primary Examiner*—Geraldine Letscher

*Attorney, Agent, or Firm*—Sughrue, Mion, Zinn, Macpeak & Seas, PLLC

[57] ABSTRACT

Disclosed is a method of image formation comprising the steps of: (i) subjecting a silver halide color photographic material to scanning exposure with a beam modulated in accordance with image information to prepare a scanning-exposed photographic material, wherein the silver halide color photographic material comprises a support having provided thereon a photographic constituent layer containing at least one reducing agent for color formation represented by formula (I) and at least one dye-forming coupler, and wherein a scanning pitch of the beam is smaller than an effective beam diameter of the beam, and an inter-raster overlap width of the beam is from 5% to 95% of the effective beam diameter; and (ii) developing the scanning-exposed photographic material:

$$R^{11}—NHNH—X—R^{12} \quad (I)$$

wherein $R^{11}$ represents an aryl group or a heterocyclic group; $R^{12}$ represents an alkyl group, an alkenyl group, an alkinyl group, an aryl group or a heterocyclic group; X represents —$SO_2$—, —CO—, —COCO—, —CO—O—, —CON($R^{13}$)—, —COCO—O—, —COCO—N($R^{13}$)— or —$SO_2$—N($R^{13}$)—; and $R^{13}$ is a hydrogen atom, an alkyl group, an alkenyl group, an alkinyl group, an aryl group or a heterocyclic group.

7 Claims, No Drawings

METHOD OF IMAGE FORMATION USING SILVER HALIDE COLOR PHOTOGRAPHIC MATERIAL

FIELD OF THE INVENTION

The present invention relates to a method of image formation using a silver halide color photographic material, in which light-sensitive silver halide emulsions, dye-forming couplers and a reducing agent for color formation are incorporated, and subjecting such a photographic material to scanning exposure with beams of light.

BACKGROUND OF THE INVENTION

Owing to recent advancement in computer technology, it has become comparatively easy to process the image read with a scanner on a computer (image processing). For the purpose of meeting the demands for formation of high-quality hard copies from such an image, the utilization of silver halide photographic materials has been examined; as a result, the image formation using a scanning exposure system has come to be carried out.

As examples of a method of image formation using a scanning exposure system, mention may be made of the method disclosed in JP-B-62-21305 (The term "JP-B" as used herein means an "examined Japanese patent publication") which comprises subjecting a photographic material to the scanning exposure using light emitting diodes as light source, the method disclosed in JP-A-62-35352 (The term "JP-A" as used herein means an "unexamined published Japanese patent application") which comprises subjecting a high chloride-content photographic material to the scanning exposure with laser beams, and the method disclosed in JP-A-63-18346 which uses as light source the second harmonic wave obtained by the use of a semiconductor laser device and an SHG element. In WO87/04534, on the other hand, reduction in the total time for image formation is attained-by using a silver halide having a high chloride content as the silver halide of a photosensitive material. However, the image formation according to those methods has a drawback such that it tends to provide blurred images since a variation in density between rasters is emphasized by a variation in quality between lots of a photosensitive material, a temperature condition upon exposure and a fluctuation in processing after exposure.

It is known that mitigation of such a drawback is possible by overlapping rasters in the scanning exposure operation. For instance, JP-A-04-249244 discloses the method of dissolving the blurred-image problem by adjusting the overlap between rasters to 15–95% of the beam diameter. In JP-A-05-19423, on the other hand, it is stated clearly that improvement in dependence on exposure temperature is possible by adjusting the overlap between rasters to 5–95% of the beam diameter. However, problems caused by the characteristic of scanning exposure, that is, short exposure with light of high illumination intensity, including the deterioration of photographic properties due to exposure of silver halide to light of high illumination intensity, e.g., lowering of the maximum density of a developed color (Dmax), cannot be prevented by the adoption of the aforementioned exposure methods alone. Thus, improvements in those exposure methods have been desired.

On the other hand, persons skilled in the art have been required to reduce wastes of photographic processing solutions, particularly to reduce the replenisher volume of a color developer and the effluent volume of a used color developer, and to simplify the composition of a color developer. A conventional color developer for silver halide color photographic materials is a basic solution in which a p-phenylenediamine derivative is dissolved, so that it is unstable and subject to deterioration due to ageing. Accordingly, such a conventional color developer requires frequent replenishment and many kinds of preservatives for maintaining the developing performance constant. Such being the case, the conventional color developer also has a problem that it gives rise to a large quantity of water solution which cannot be discharged unless it undergoes complex treatments for disposal.

As an effective means to solve the above problem, it is possible to adopt a method of incorporating an aromatic primary amine or its precursor as a reducing agent for color formation into a hydrophilic colloid layer. Specific examples of an aromatic primary amine developing agent or a precursor thereof which can be incorporated in hydrophilic colloid layers include the compounds described in U.S. Pat. Nos. 2,507,114 and 3,764,328, JP-A-56-6235 and JP-A-58-192031. However, these aromatic primary amines and the precursors thereof are unstable, so that the photosensitive materials in which they are incorporated have a disadvantage in generating stains upon long-range storage before photographic processing or upon color development. As another effective means, it is possible to use a method of incorporating the sulfonylhydrazide compounds described, e.g., in EP-A1-0545491 and EP-A1-0565165 into a hydrophilic colloid layer. According to this method, the processing with an alkali solution free from a developing agent becomes possible, provided that an auxiliary developing agent or its precursor is incorporated as well. Therefore, it becomes feasible to reduce the replenisher volume of a developer (an alkali solution) and the effluent volume of a used developer, and to simplify the composition of a developer.

As mentioned above, a fairly satisfactory density of developed color can be obtained by the processing method in which a basic aqueous solution containing a conventional p-phenylenediamine derivative is used as color developer, but the maximum density of a developed color is lowered in the case of high illumination intensity exposure. In addition, such a color developer requires complex handling. It is therefore desired to overcome these disadvantages by technological development.

SUMMARY OF THE INVENTION

An object of the present invention is to provide a method of image formation which can prevent the maximum density of a developed color from lowering due to scanning exposure, uses a processing system wherein the developer used has a simplified composition and the replenisher and effluent volumes thereof are reduced, and ensures an excellent long-range keeping quality in the image formed.

As a result of our intensive study of the aforementioned problems, it has been found that the above object can be attained by the following means.

More specifically, the object of the present invention can be attained by adopting the following constitutions (1) to (6):

(1) A method of image formation which comprises a scanning exposure step using a beam modulated in accordance with image information and a development-processing step: with the scanning exposure having a scanning pitch smaller than the effective beam diameter of each beam and an inter-raster overlap width (a width of overlap between rasters), adjusted to from 5% to 95% of the effective beam diameter, and being given to a silver halide color photographic material having on a support one or more of a photographic constituent layer containing at least one reducing agent for color formation represented by the following formula (I) and at least one dye-forming coupler;

$$R^{11}—NHNH—X—R^{12} \quad (I)$$

wherein $R^{11}$ represents an aryl group or a heterocyclic group; $R^{12}$ represents an alkyl group, an alkinyl group, an alkenyl group, an aryl group or a heterocyclic group; X represents $—SO_2—$, —CO—, —COCO—, —CO—O—, $—CON(R^{13})—$, —COCO—O—, $—COCO—N(R^{13})—$ or $—SO_2—N(R^{13})—$; and $R^{13}$ is a hydrogen atom or a group having the same meaning as $R^{12}$.

(2) A method of image formation according to the above constitution (1), wherein the compound represented by the foregoing formula (I) is a compound represented by the following formula (II) or (III):

(II)

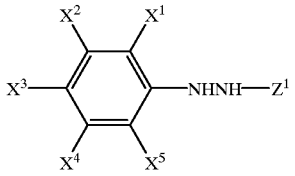

(III)

$$R^3—NHNH—Z^2$$

wherein $Z^1$ represents an acyl group, a carbamoyl group, an alkoxycarbonyl group or an aryloxycarbonyl group; $Z^2$ represents a carbamoyl group, an alkoxycarbonyl group or an aryloxycarbonyl group; $X^1$, $X^2$, $X^3$, $X^4$ and $X^5$ each represents a hydrogen atom or a substituent group, provided that the sum of the Hammett's $\sigma_p$ values of $X^1$, $X^3$ and $X^5$ and the Hammett's $\sigma_m$ values of $X^2$ and $X^4$ is not smaller than 0.80 and not greater than 3.80; and $R^3$ represents a heterocyclic group.

(3) A method of image formation according to the above constitution (2), wherein the compounds represented by the foregoing formulae (II) and (III) are compounds represented by the following formulae (IV) and (V), respectively:

(IV)

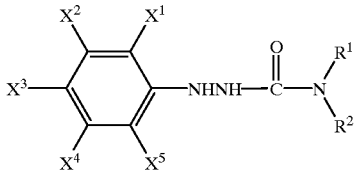

(V)

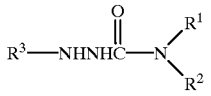

wherein $R^1$ and $R^2$ each represents a hydrogen atom or a substituent group; $X^1$, $X^2$, $X^3$, $X^4$ and $X^5$ each represents a hydrogen atom or a substituent group, provided that the sum of the Hammett's $\sigma_p$ values of $X^1$, $X^3$ and $X^5$ and the Hammett's $\sigma_m$ values of $X^2$ and $X^4$ is not smaller than 0.80 and not greater than 3.80; and $R^3$ represents a heterocyclic group.

(4) A method of image formation according to the above constitution (3), wherein the compounds represented by the foregoing formulae (IV) and (V) are compounds represented by the following formulae (VI) and (VII), respectively:

(VI)

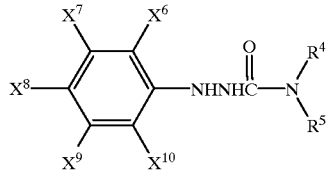

(VII)

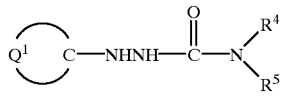

wherein $R^4$ and $R^5$ each represents a hydrogen atom or a substituent group; $X^6$, $X^7$, $X^8$, $X^9$ and $X^{10}$ each represents a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group or a heterocyclic group, provided that the sum of the Hammett's $\sigma_p$ values of $X^6$, $X^8$ and $X^{10}$ and the Hammett's $\sigma_m$ values of $X^7$ and $X^9$ is not smaller than 1.20 and not greater than 3.80; and $Q^1$ represents a nonmetallic atomic group for forming a nitrogen-containing 5- to 8-membered heterocyclic ring together with C.

(5) A method of image formation according to the foregoing constitution (1), (2), (3) or (4), wherein the inter-raster overlap width of the scanning exposure is adjusted to from 20% to 80% of the effective beam diameter.

(6) A method of image formation according to the foregoing constitution (1), (2), (3), (4) or (5), wherein the silver halide color photographic material has a total silver halide coverage ranging from 0.003 to 0.3 g/m$^2$, based on silver.

In other words, the present invention has been achieved by the following discovery:

Although the formation of images was attempted by subjecting conventional photographic materials to scanning exposure with light of high illumination intensity and then processing them using as a color developer a basic aqueous solution in which a p-phenylenediamine derivative was dissolved, the maximum densities of colors developed thereby were considerably low, compared with those obtained through conventional surface exposure with light of low illumination intensity.

On the other hand, when a photosensitive material in which the present reducing agent for color formation and dye-forming couplers were incorporated was subjected to the aforementioned scanning exposure and processed with an alkali bath free from a developing agent, the lowering of the maximum density of colors was unexpectedly inhibited. In addition, the alkali bath required only a small amount of replenisher, and the effluent thereof could be reduced, compared with those of conventional processing solutions.

Moreover, the present reducing agents of formulae (II) and (III) could provide images of good keeping quality and reduce the generation of stains, and these effects were especially great when the reducing agents were those of formulae (IV) and (V).

DETAILED DESCRIPTION OF THE INVENTION

In the formula (I), $R^{11}$ represents an unsubstituted or substituted aryl or heterocyclic group. As for the aryl group as $R^{11}$, aryl groups containing 6 to 14 carbon atoms, such as phenyl and naphthyl groups, are suitable examples thereof. As for the heterocyclic group as $R^{11}$, saturated or unsaturated 5-, 6- and 7-membered heterocyclic rings containing at least one nitrogen, oxygen, sulfur or selenium atom are suitable examples thereof. These rings each may be a condensed ring formed by being fused together with a benzene or hetero ring. Specific examples of a heterocyclic group as $R^{11}$ include furanyl, thienyl, oxazolyl, thiazolyl, imidazolyl, triazolyl, pyrrolidinyl, benzoxazolyl, benzothiazolyl, pyridyl, pyridazyl, pyrimidinyl, pyrazinyl, triazinyl, quinolinyl, isoquinolinyl, phthalazinyl, quinoxalinyl, quinazolinyl, purinyl, pteridinyl, azepinyl and benzoxepinyl groups.

As specific examples of a substituent which the group represented by $R^{11}$ may have, mention may be made of an alkyl group, an alkenyl group, an alkinyl group, an aryl group, a heterocyclic group, an alkoxy group, an aryloxy group, a heterocyclyloxy group, and alkylthio group, an arylthio group, a heterocyclylthio group, an acyloxy group, an acylthio group, an alkoxycarbonyloxy group, an aryloxycarbonyloxy group, a carbamoyloxy group, an alkylsulfonyloxy group, an arylsulfonyloxy group, an amino group, an alkylamino group, an arylamino group, an amido group, an alkoxycarbonylamino group, an aryloxycarbonylamino group, an ureido group, a sulfonamido group, a sulfamoylamino group, an acyl group, an alkoxycarbonyl group, an aryloxycarbonyl group, a carbamoyl group, an acylcarbamoyl group, a carbamoylcarbamoyl group, a sulfonylcarbamoyl group, a sulfamoylcarbamoyl group, an alkylsulfonyl group, an arylsulfonyl group, an alkylsulfinyl group, an arylsulfinyl group, an alkoxysulfonyl group, an aryloxysulfonyl group, a sulfamoyl group, an acylsulfamoyl group, a carbamoylsulfamoyl group, a halogen atom, a nitro group, a cyano group, a carboxyl group, a sulfo group, a phosphono group, a hydroxyl group, a mercapto group, an imido group and an azo group.

$R^{12}$ represents an unsubstituted or substituted alkyl, alkenyl, alkinyl, aryl or heterocyclic group.

As for the alkyl group as $R^{12}$, straight-chain, branched or cyclic alkyl groups containing 1 to 16 carbon atoms, such as methyl, ethyl, hexyl, dodecyl, 2-octyl, t-butyl, cyclopentyl and cyclooctyl groups, are suitable examples thereof. As for the alkenyl group as $R^{12}$, straight-chain or cyclic alkenyl groups containing 2 to 16 carbon atoms, such as vinyl, 1-octenyl and cyclohexenyl groups, are suitable examples thereof.

As for the alkinyl group as $R^{12}$, those containing 2 to 16 carbon atoms, such as 1-butinyl and phenylethinyl groups, are suitable examples thereof. As for the aryl group and the heterocyclic group as $R^{12}$, the groups recited above as suitable examples of $R^{11}$ are their respective suitable examples. As for the substituent which the group represented by $R^{12}$ may have, the substituents recited above as specific examples of a substituent which the group represented by $R^{11}$ may have are also suitable examples thereof.

X represents —$SO_2$—, —CO—, —COCO—, —CO—O—, —CON($R^{13}$)—, —COCO—O—, —COCO—N($R^{13}$)— or —$SO_2$—N($R^{13}$)—, wherein $R^{13}$ represents a hydrogen atom or has the same meaning as $R^{12}$.

Of these groups, —CO—, —CON($R^{13}$)— and —CO—O— are preferred over the others. In particular, —CON($R^{13}$)— is favorable for excellent color formation.

Of the compounds represented by formula (I), the compounds represented by formulae (II) and (III) are preferred over the others, those represented by formulae (IV) and (V) are much preferred, and those represented by formulae (VI) and (VII) are especially preferred.

The compounds represented by formulae (II) to (VII) are described below in detail.

In the formulae (II) and (III), $Z^1$ represents an acyl group, a carbamoyl group, an alkoxycarbonyl group or an aryloxycarbonyl group, and $Z^2$ represents a carbamoyl group, an alkoxycarbonyl group or an aryloxycarbonyl group. As for the acyl group therein, acyl groups containing 1 to 50 carbon atoms are desirable, and those containing 2 to 40 carbon atoms are more desirable. Specific examples of such an acyl group include acetyl, 2-methylpropanoyl, cyclohexylcarbonyl, n-octanoyl, 2-hexyldecanoyl, dodecanoyl, chloroacetyl, trifluoroacetyl, benzoyl, 4-dodecyloxybenzoyl, 2-hydroxymethylbenzoyl and 3-(N-hydroxy-N-methylaminocarbonyl)propanoyl groups.

Since the cases in which $Z^1$ and $Z^2$ are each a carbamoyl group correspond to the compounds of formulae (VI) and (VII) respectively, such a carbamoyl group is referred to a detailed description of $R^4$ and $R^5$ given hereinafter.

As for the alkoxycarbonyl group and the aryloxycarbonyl group, those containing 2 to 50 carbon atoms, preferably 2 to 40 carbon atoms, are suitable examples thereof. More specifically, such groups include methoxycarbonyl, ethoxycarbonyl, isobutyloxycarbonyl, cyclohexyloxycarbonyl, dodecyloxycarbonyl, benzyloxycarbonyl, phenoxycarbonyl, 4-octyloxyphenoxycarbonyl, 2-hydroxymethylphenoxycarbonyl and 2-dodecyloxyphenoxycarbonyl groups.

Each of $X^1$, $X^2$, $X^3$, $X^4$ and $X^5$ represents a hydrogen atom or a substituent group. Specific examples of such a substituent group include straight- or branched-chain, or cyclic alkyl groups containing 1 to 50 carbon atoms (e.g., trifluoromethyl, methyl, ethyl, propyl, heptafluoropropyl, isopropyl, butyl, t-butyl, t-pentyl, cyclopentyl, cyclohexyl, octyl, 2-ethylhexyl, dodecyl); straight- or branched-chain, or cyclic alkenyl groups containing 2 to 50 carbon atoms (e.g., vinyl, 1-methylvinyl, cyclohexene-1-yl); alkinyl groups having a total carbon number of 2 to 50 (e.g., ethinyl, 1-propinyl), aryl group containing 6 to 50 carbon atoms (e.g., phenyl, naphthyl, anthryl); acyloxy group containing 1 to 50 carbon atoms (e.g., acetoxy, tetradecanoyloxy, benzoyloxy); carbamoyloxy groups containing 1 to 50 carbon atoms (e.g., N,N-dimethylcarbamoyl); carbonamido groups containing 1 to 50 carbon atoms (e.g., formamido, N-methylacetamido, acetamido, N-methylformamido, benzamido); sulfonamido groups containing 1 to 50 carbon atoms (e.g., methanesulfonamido, dodecanesulfonamido, benzenesulfonamido, p-toluenesulfonamido); carbamoyl groups containing 1 to 50 carbon atoms (e.g., N-methylcarbamoyl, N,N-diethylcarbamoyl, N-mesylcarbamoyl); sulfamoyl groups containing 0 to 50 carbon atoms (e.g., N-butylsulfamoyl, N,N-diethylsulfamoyl, N-methyl-N-(4-methoxyphenyl) sulfamoyl); alkoxy groups containing 1 to 50 carbon atoms (e.g., methoxy, propoxy, isopropoxy, octyloxy, t-octyloxy, dodecyloxy, 2-(2,4-di-t-pentylphenoxy)ethoxy); aryloxy groups containing 6 to 50 carbon atoms (e.g., phenoxy, 4-methoxyphenoxy, naphthoxy); aryloxycarbonyl groups containing 7 to 50 carbon atoms (e.g., phenoxycarbonyl, naphthoxycarbonyl); alkoxycarbonyl groups containing 2 to 50 carbon atoms (e.g., methoxycarbonyl, t-butoxycarbonyl); N-acylsulfamoyl groups containing 1 to 50 carbon atoms (e.g., N-tetradecanoylsulfamoyl, N-benzoylsulfamoyl); alkylsulfonyl groups containing 1 to 50 carbon atoms (e.g., methanesulfonyl, octylsulfonyl, 2-methoxyethylsulfonyl, 2-hexyldecylsulfonyl); arylsulfonyl groups containing 6 to 50 carbon atoms (e.g., benzenesulfonyl, p-toluenesulfonyl, 4-phenylsulfonylphenylsulfonyl); alkoxycarbonylamino groups containing 2 to 50 carbon atoms (e.g., ethoxycarbonylamino); aryloxycarbonylamino groups containing 7 to 50 carbon atoms (e.g., phenoxycarbonylamino, naphthoxycarbonylamino); amino groups containing 0 to 50 carbon atoms (e.g., amino, methylamino, diethylamino, diisopropylamino, anilino, morpholino); a cyano group; a nitro group; a carboxyl group; a hydroxy group; a sulfo group; a mercapto group; alkylsulfinyl group containing 1 to 50 carbon atoms (e.g., methanesulfinyl, octanesulfinyl); arylsulfinyl groups containing 6 to 50 carbon atoms (e.g., benzenesulfinyl, 4-chlorophenylsulfinyl, p-toluenesulfinyl); alkylthio groups containing 1 to 50 carbon atoms (e.g., methylthio, octylthio, cyclohexylthio); arylthio groups containing 6 to 50 carbon atoms (e.g., phenylthio, naphthylthio); ureido groups containing 1 to 50 carbon atoms (e.g., 3-methylureido, 3,3-dimethylureido, 1,3-diphenylureido); heterocyclic groups containing 2 to 50 carbon atoms (such as 3- to 12-membered monocyclic or condensed ring containing in their respective nuclei at least one hetero atom, such as nitrogen, oxygen or sulfur atom, with examples including 2-furyl, 2-pyranyl, 2-pyridyl, 2-thienyl, 2-imidazolyl, morpholino, 2-quinolyl, 2-benzimidazolyl, 2-benzothiazolyl and 2-benzoxazolyl groups); acyl groups containing 1 to 50 carbon atoms (e.g., acetyl, benzoyl, trifluoroacetyl); sulfamoylamino groups containing 0 to 50 carbon atoms (e.g., N-butylsulfamoylamino, N-phenylsulfamoylamino); silyl groups containing 3 to 50 carbon atoms (e.g., trimethylsilyl, dimethyl-t-butylsilyl, triphenylsilyl); and halogen atoms (e.g., fluorine, chlorine, bromine). These substituent groups may further have substituent(s). Examples of such a substituent include the groups recited above. In addition, any adjacent two among the substituent groups $X^1$, $X^2$, $X^3$, $X^4$ and $X^5$ may be combined with each other to complete a condensed ring. As for the ring to be fused with the benzene ring, 5- to 7-membered rings are desirable, and 5- and 6-membered rings are more desirable.

The appropriate number of carbon atoms present in such a substituent group as recited above is not greater than 50, preferably no greater than 42, particularly preferably no greater than 34, and not smaller than 1.

As for the substituent groups $X^1$, $X^2$, $X^3$, $X^4$ and $X^5$ in formula (II), the sum of the Hammett's $\sigma_p$ values of $X^1$, $X^3$ and $X^5$ and the Hammett's $\sigma_m$ values of $X^2$ and $X^4$ is not smaller than 0.80 and not greater than 3.80. As for the substituent groups $X^6$, $X^7$, $X^8$, $X^9$ and $X^{10}$ in formula (VI), each thereof represents a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group or a heterocyclic group. These groups each may further have substituent(s), and any adjacent two of $X^6$, $X^7$, $X^8$, $X^9$ and $X^{10}$ may combine with each other to complete a condensed ring. Specific examples thereof are similar to those recited in the above description of $X^1$, $X^2$, $X^3$, $X^4$ and $X^5$. In formula (VI), however, the sum of the Hammett's $\sigma_p$ values of $X^6X^8$ and $X^{10}$ and the Hammett's $\sigma_m$ values of $X^7$ and $X^9$ is not smaller than 1.20 and not greater than 3.80, preferably not smaller than 1.50 and not greater than 3.80, and particularly preferably not smaller than 1.70 and not greater than 3.80.

When the sum total of the $\sigma_p$ values and the $\sigma_m$ values is less than 0.8, the resultant compound cannot have sufficient color forming properties; while the compounds which are greater than 3.80 in sum total defined above are difficult to synthesize and obtain.

Additionally, Hammett's $\sigma_p$ and $\sigma_m$ values are described in detail in various books, e.g., in Naoki Inamoto, *Hammett Soku—Kozo to Hannosei* (which means "Hammett's Rule—Structure and Reactivity"), published by Maruzen; *Shin Jikken Kagaku Koza* 14*: Yuki Kagobutsu no Gosei to Hanno V* (which means "New lectures of experimental chemistry 14: Syntheses and reactions of organic compounds V"), page 2605, compiled by The Chemical Society of Japan, published by Maruzen; Tadao Nakaya, *Riron Yuki Kagaku Kaisetsu* (which means "Exposition of theoretical organic chemistry"), page 217, published by Tokyo Kagaku Dojin; and *Chemical Review*, volume 91, pages 165–195 (1991).

Each of $R^1$ and $R^2$ in formulae (IV) and (V) and $R^4$ and $R^5$ in formulae (VI) and (VII) represents a hydrogen atom or a substituent group. Specific examples of such a substituent group include those recited in the description of $X^1$, $X^2$, $X^3$, $X^4$ and $X^5$. Preferably, each of the substituent groups $R^1$, $R^2$, $R^4$ and $R^5$ represents a hydrogen atom, a substituted or unsubstituted alkyl group containing 1 to 50 carbon atoms, a substituted or unsubstituted aryl group containing 6 to 50 carbon atoms, or a substituted or unsubstituted heterocyclic group containing 1 to 50 carbon atoms. In particular, it is favorable that at least either $R^1$ or $R^2$ and at least either $R^4$ or $R^5$ be a hydrogen atom.

$R^3$ in formulae (III) and (V) represents a heterocyclic group, preferably a saturated or unsaturated 3- to 12-membered (especially 3- to 8-membered) heterocyclic group containing 1 to 50 carbon atoms and at least one hetero atom, such as a nitrogen, oxygen or sulfur atom, which may be a monocyclic or condensed ring. Specific examples of such a hetero ring include furan, pyran, pyridine, thiophene, imidazole, quinoline, benzimidazole, benzothiazole, benzoxazole, pyrimidine, pyrazine, 1,2,4-thiadiazole, pyrrole, oxazole, thiazole, quinazoline, isothiazole, pyridazine, indole, pyrazole, triazole and quinoxaline. These rings may have substituent(s), and it is desirable that those rings be substituted with at least one electron-attracting (withdrawing) group. The term "electron-attracting group" as used herein is intended to include the groups having positive Hammett's $\sigma_p$ values.

In incorporating the present reducing agent for color formation into a photosensitive material, it is effective to contain a ballast group in at least one among $Z^1$, $Z^2$, $R^1$ to $R^5$ and $X^1$ to $X^{10}$.

Suitable examples of a hetero ring completed by $Q^1$ are illustrated with Compounds I-16 to I-57 and I-59 to I-74 exemplified hereinafter.

Now, specific examples of a new reducing agent for color formation according to the present invention are illustrated below. However, the scope of the invention should not be construed as being limited to these specific examples.

I-1
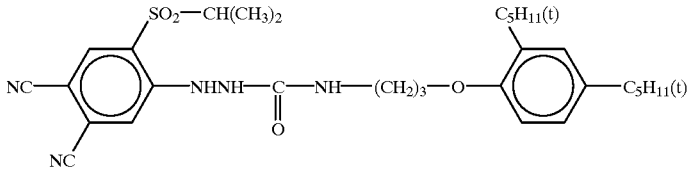
I-2
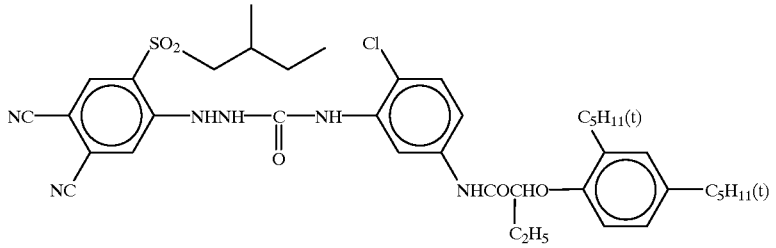
I-3
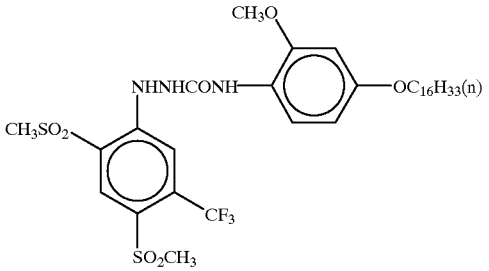
I-4
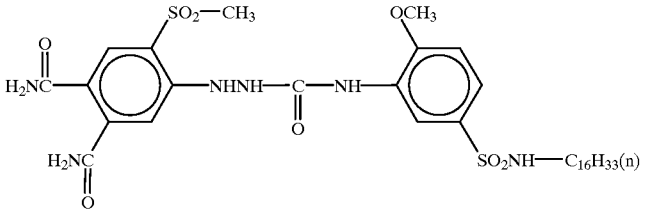
I-5
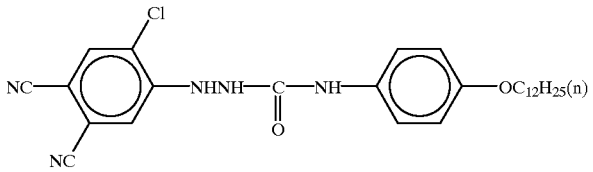
I-6
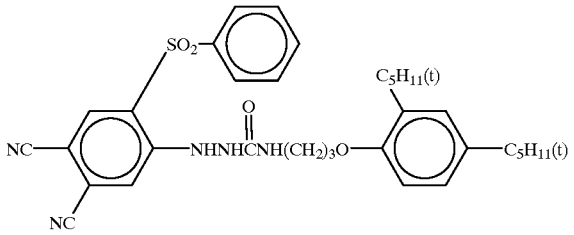

-continued
I-7
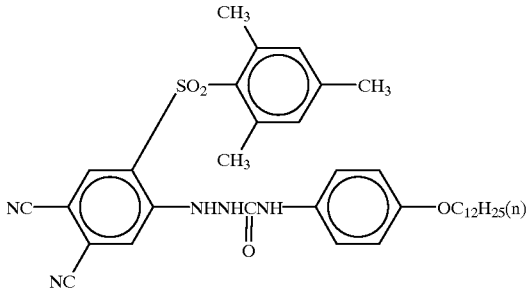
I-8
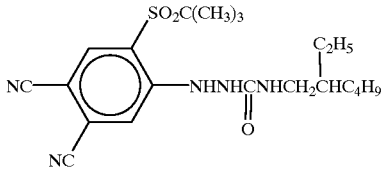
I-9
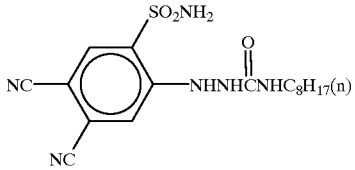
I-10
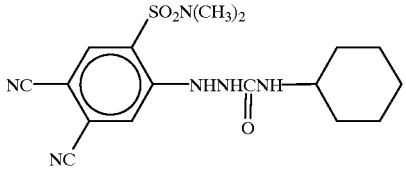
I-11
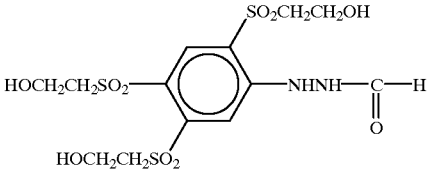
I-12
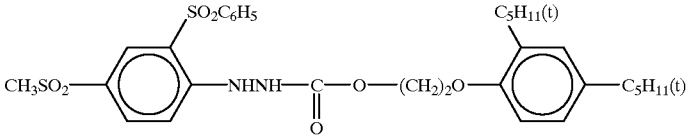
I-13
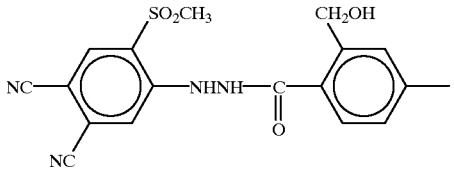
I-14
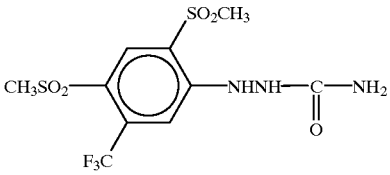
I-15
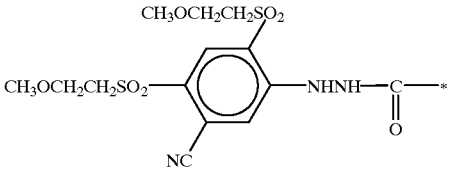
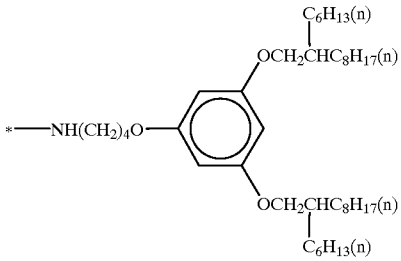

-continued
I-16
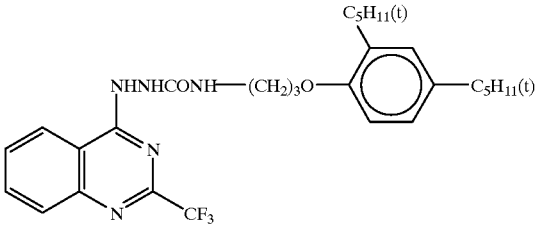
I-17
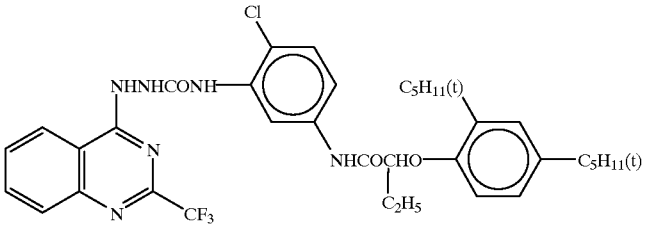
I-18
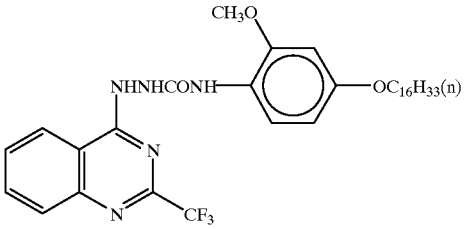
I-19
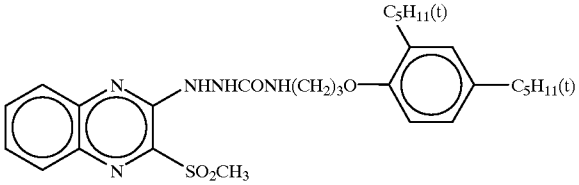
I-20
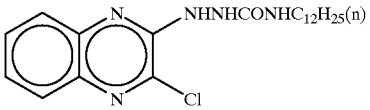
I-21
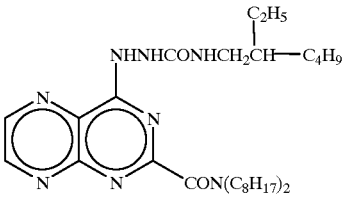
I-22
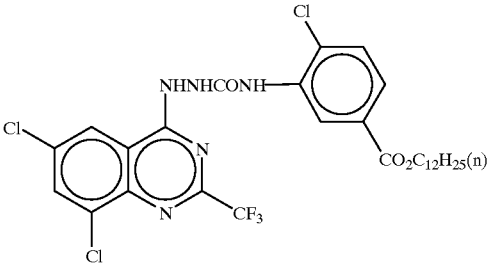
I-23
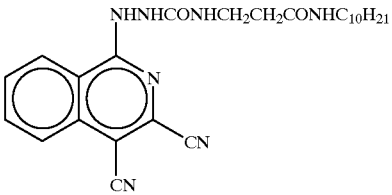

-continued
I-24
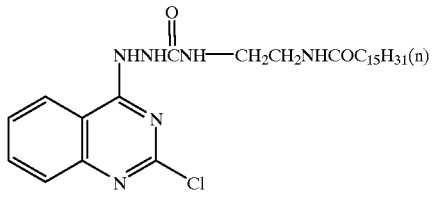
I-25
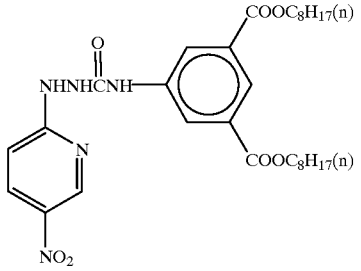
I-26
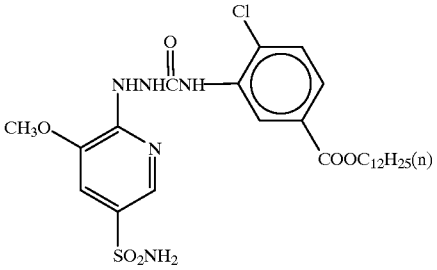
I-27
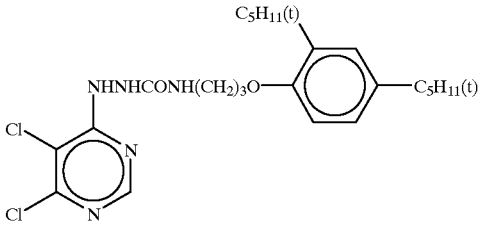
I-28
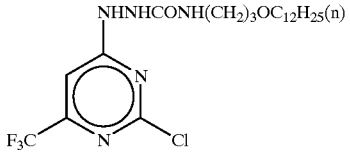
I-29
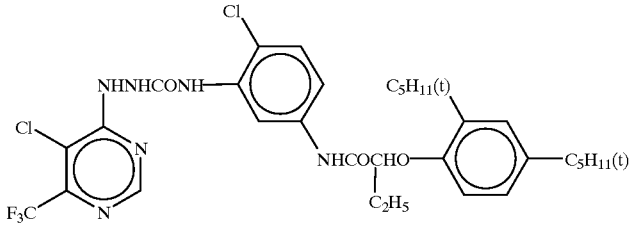
I-30
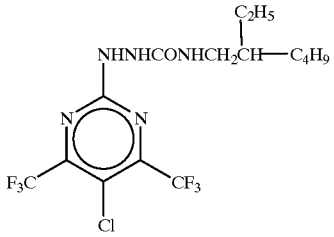
I-31
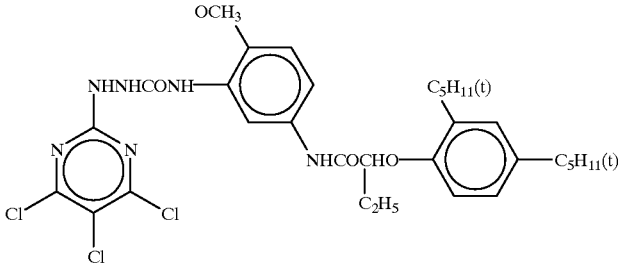

-continued
I-32
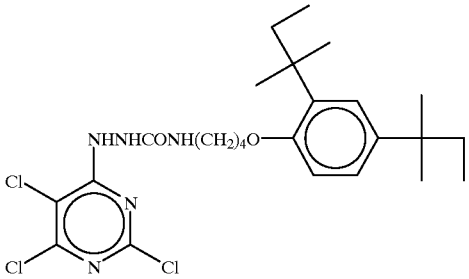
I-33
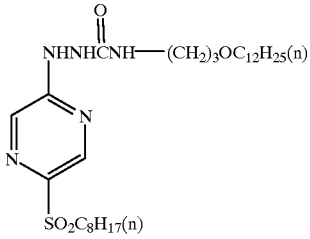
I-34
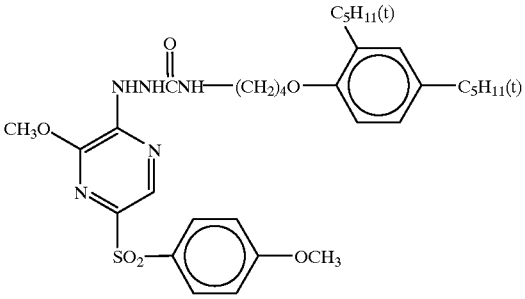
I-35
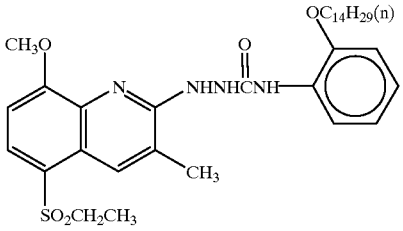
I-36
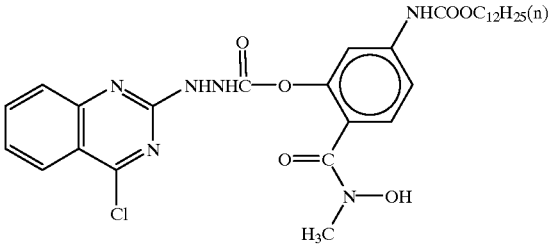
I-37
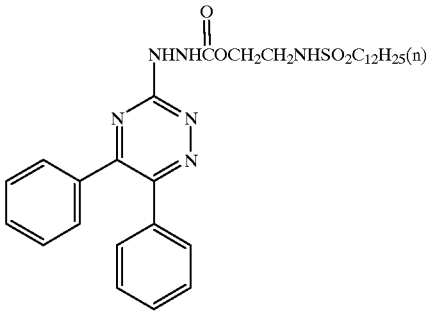
I-38
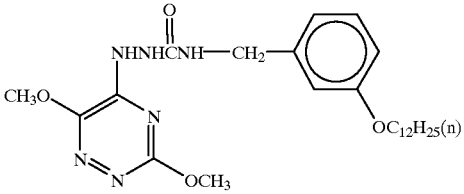
I-39
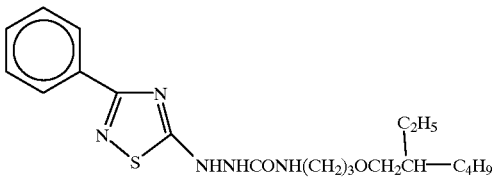
I-40
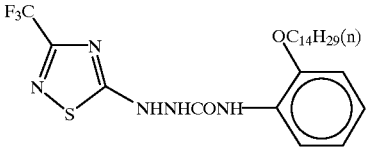
I-41
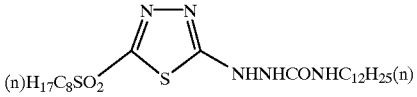
I-42
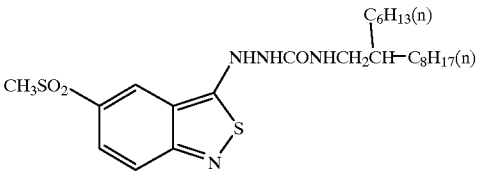

-continued
I-43
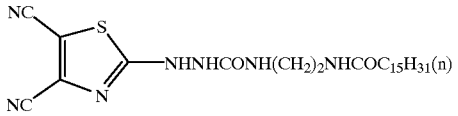
I-44
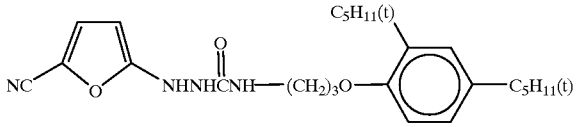
I-45
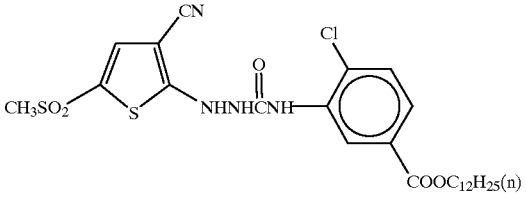
I-46
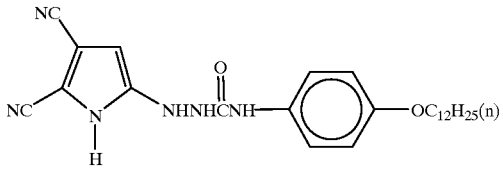
I-47
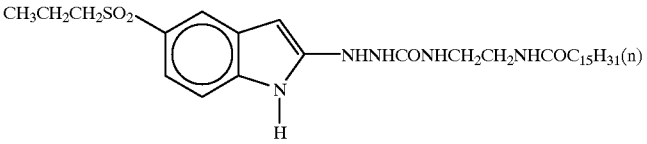
I-48
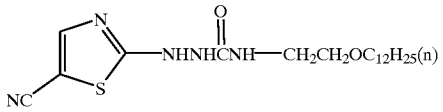
I-49
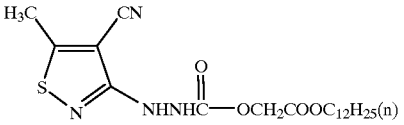
I-50
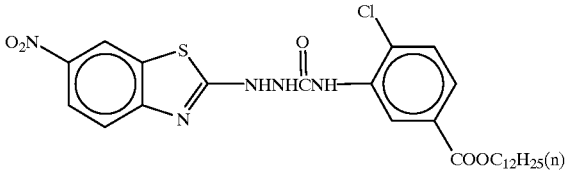
I-51
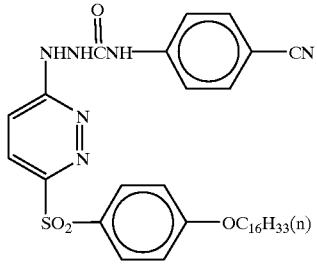

-continued
I-52
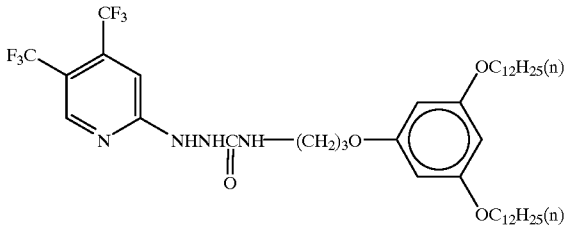
I-53
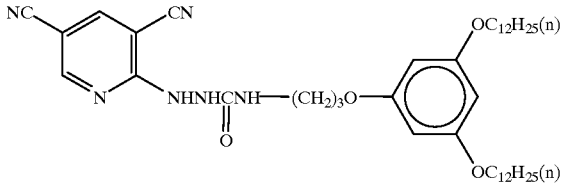
I-54
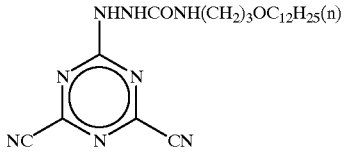
I-55
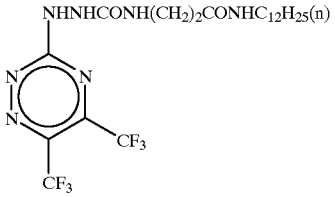
I-56
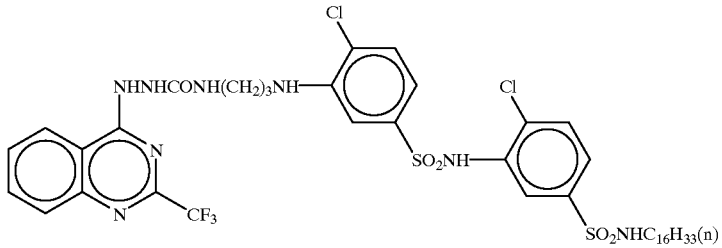
I-57
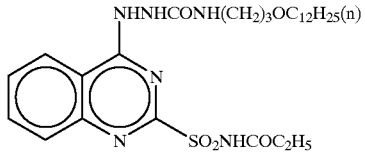
I-58
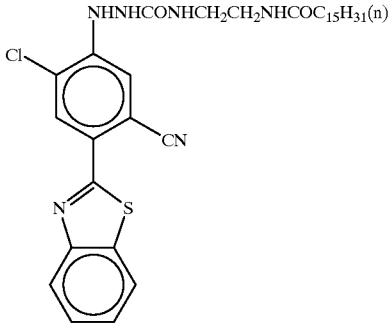
I-59
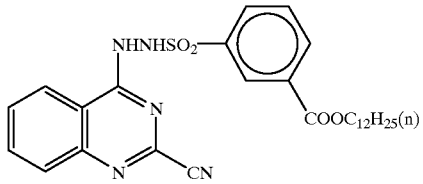
I-60
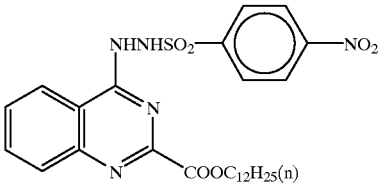

-continued
I-61
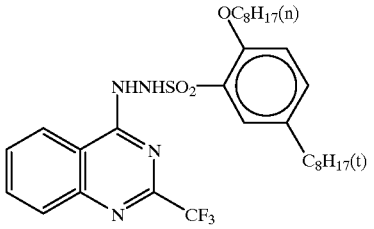
I-62
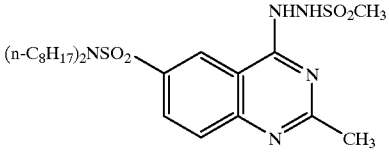
I-63
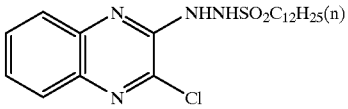
I-64
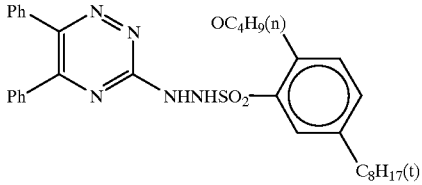
I-65
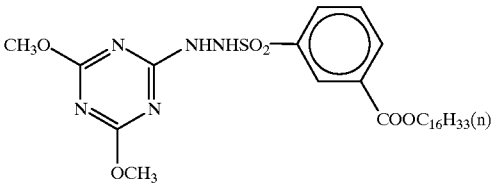
I-66
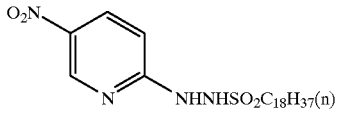
I-67
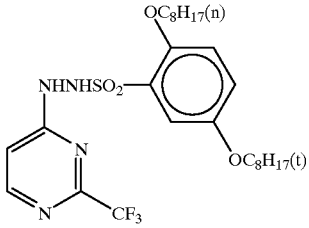
I-68
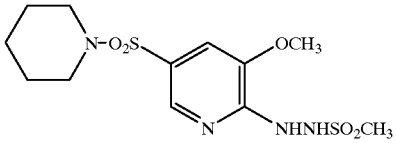
I-69
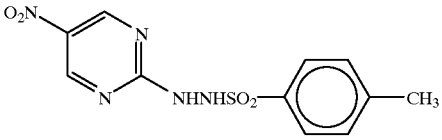
I-70
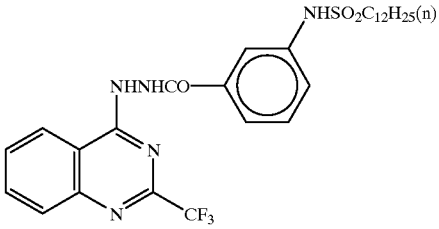
I-71
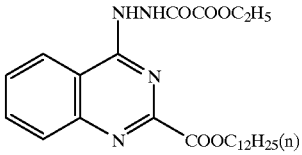
I-72
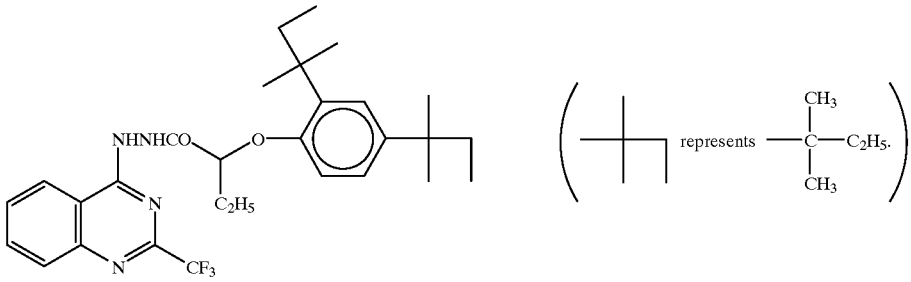

-continued
I-73
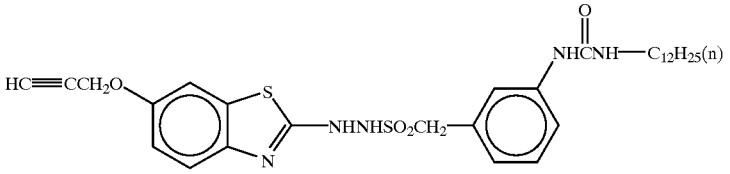
I-74
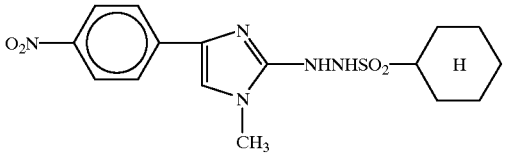
I-75
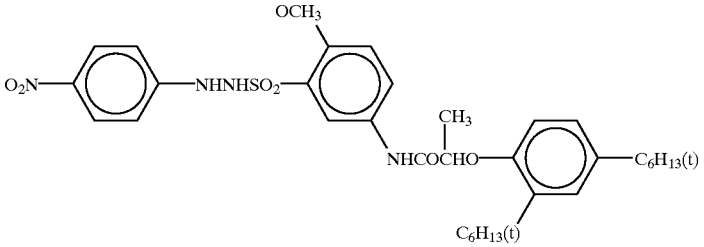
I-76
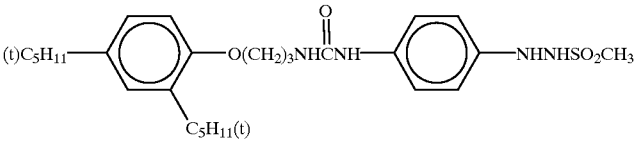
I-77
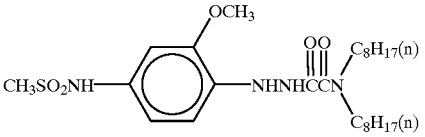
I-78
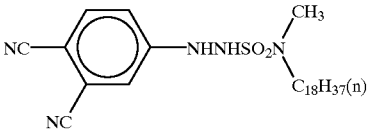
I-79
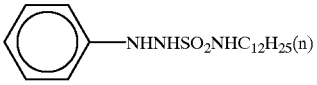
I-80
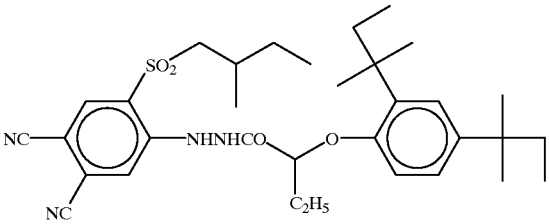
I-81
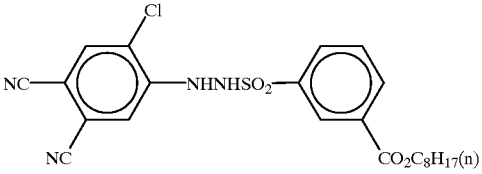
I-82
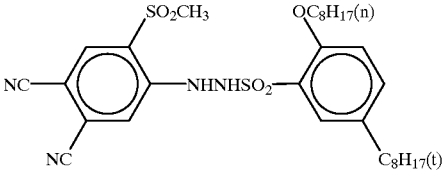

-continued

I-83

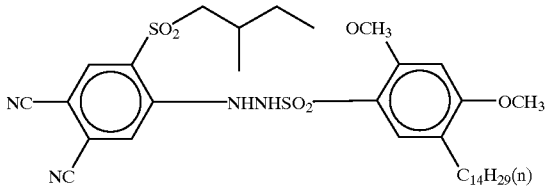

I-84

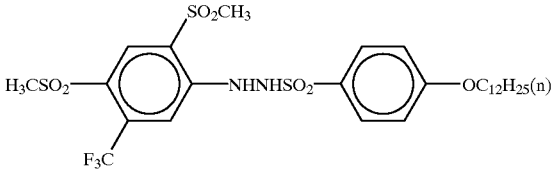

As for the couplers preferably used in the present invention, the compounds having the structures shown below as formulae (1) to (12) are examples thereof. The compounds of formulae (1) to (4), those of formula (5), those of formula (6), those of formula (7), those of formula (8) and those of formulae (9) to (12) are named collectively active methylene compounds, pyrazolone compounds, pyrazoloazole compounds, phenol compounds, naphthol compounds and pyrrolotriazole compounds, respectively, and they are well known in the art.

(1)

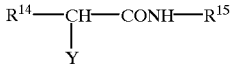

(2)

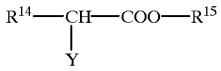

(3)

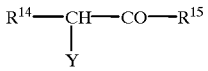

(4)

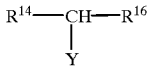

(5)

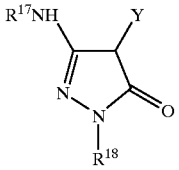

(6)

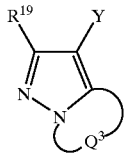

-continued (7)

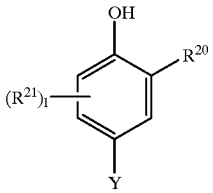

(8)

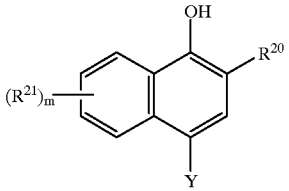

(9)

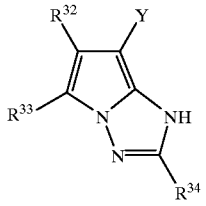

(10)

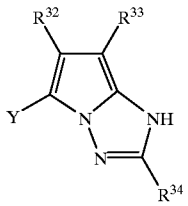

(11)

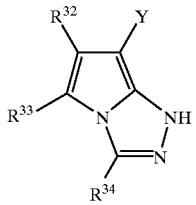

-continued (12)

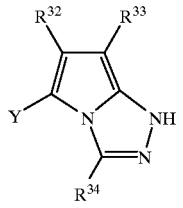

More specifically, the formulae (1) to (4) represent the couplers called active methylene couplers, and $R^{14}$ therein is an acyl, cyano, nitro, aryl, heterocyclic, alkoxycarbonyl, aryloxycarbonyl, carbamoyl, sulfamoyl, alkylsulfonyl or arylsulfonyl group, which may be substituted.

$R^{15}$ in formulae (1) to (3) is an unsubstituted or substituted alkyl, aryl or heterocyclic group. $R^{16}$ in formula (4) is an unsubstituted or substituted aryl or heterocyclic group. As examples of a substituent which the groups represented by $R^{14}$, $R^{15}$ and $R^{16}$ may have, mention may be made of the groups recited hereinbefore as examples of $X^1$ to $X^5$.

Y in formulae (1) to (4) represents a hydrogen atom, or a group capable of splitting off by coupling reaction with the oxidation product of the reducing agent for color formation. Specific examples of a splitting-off group as Y include a heterocyclic group (that is, a 5- to 7-membered saturated or unsaturated monocyclic or condensed ring containing at least one nitrogen, oxygen or sulfur atom as a hetero atom, such as succinimide, maleinimide, phthalimide, diglycol imide, pyrrole, pyrazole, imidazole, 1,2,4-triazole, tetrazole, indole, benzopyrazole, benzimidazole, benzotriazole, imidazoline-2,4-dione, oxazolidine-2,4-dione, thiazolidine-2,4-dione, imidazolidine-2-one, oxazoline-2-one, thiazoline-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine or 2-imino-2,3,4-thiazolidine-4-one), a halogen atom (e.g., chlorine, bromine), an aryloxy group (e.g., phenoxy, 1-naphthoxy), a heterocyclic oxy group (e.g., pyridyloxy, pyrazolyloxy), an acyloxy group (e.g., acetoxy, benzoyloxy), an alkoxy group (e.g., methoxy, dodecyloxy), a carbamoyloxy group (e.g., N,N-diethylcarbamoyloxy, morpholinocarbonyloxy), an aryloxycarbonyloxy group (e.g., phenoxycarbonyloxy), an alkoxycarbonyloxy group (e.g., methoxycarbonyloxy, ethoxycarbonyloxy), an arylthio group (e.g., phenylthio, naphthylthio), a heterocyclic lthio group (e.g., tetrazolylthio, 1,3,4-thiadiazolylthio, 1,3,4-oxadiazolylthio, benzimidazolylthio), an alkylthio group (e.g., methylthio, octylthio, hexadecylthio), an alkylsulfonyloxy group (e.g., benzenesulfonyloxy, toluenesulfonyloxy), a carbonamido group (e.g., acetamido, trifluoroacetamido), a sulfonamido group (e.g., methanesulfonamido, benzenesulfonamido), an alkylsulfonyl group (e.g., methanesulfonyl), an arylsulfonyl group (e.g., benzenesulfonyl), an alkylsulfinyl group (e.g., methanesulfinyl), an arylsulfinyl group (e.g., benzenesulfinyl), an arylazo group (e.g., phenylazo, naphthylazo) and a carbamoylamino group (e.g., N-methylcarbamoylamino).

Each of those splitting-off groups recited above may have substituent(s). As examples of a substituent which the splitting-off groups as Y may have, mention may be made of the groups recited hereinbefore as examples of $X^1$ to $X^5$.

Y is preferably a halogen atom, an aryloxy group, a heterocyclyloxy group, an acyloxy group, an aryloxycarbonyloxy group, an alkoxycarbonyloxy group or a carbamoyloxy group.

In formulae (1) to (4), $R^{14}$ may combine with $R^{15}$ or $R^{16}$ to form a ring.

The formula (5) represents the couplers called 5-pyrazolone couplers, and therein $R^{17}$ is an alkyl group, an aryl group, an acyl group or a carbamoyl group. $R^{18}$ represents a phenyl group having no substituent or at least one halogen, alkyl, cyano, alkoxy, alkoxycarbonyl or acylamino substituent.

Of the 5-pyrazolone couplers represented by formula (5), the couplers of formula (5) wherein $R^{17}$ is an aryl or acyl group and $R^{18}$ is a phenyl group substituted with at least one halogen atom are preferred over the others.

As for the aryl group preferred as $R^{17}$, phenyl, 2-chlorophenyl, 2-methoxyphenyl, 2-chloro-5-tetradecanamidophenyl, 2-chloro-5-(3-octadecenyl-1-succinimido)phenyl, 2-chloro-5-octadecylsulfonamidophenyl and 2-chloro-5-[2-(4-hydroxy-3-t-butylphenoxy)tetradecanamido]phenyl groups are examples thereof. As for the acyl group preferred as $R^{17}$, acetyl, 2-(2,4-di-t-pentylphenoxy)butanoyl, benzoyl and 3-(2,4-di-t-amylphenoxyacetamido)benzoyl groups are examples thereof. These aryl and acyl groups may further have substituent(s). Examples of such substituent(s) include halogen atoms and organic substituents attached thereto via a carbon, oxygen, nitrogen or sulfur atom. Y in formula (5) has the same meaning as in the foregoing formulae (1) to (4).

Specific examples of a substituted phenyl group preferred as $R^{18}$ include 2,4,6-trichlorophenyl, 2,5-dichlorophenyl and 2-chlorophenyl groups.

The formula (6) represents the couplers called pyrazoloazole couplers. Therein, $R^{19}$ is a hydrogen atom or a substituent group, and $Q^3$ represents a nonmetallic atomic group for completing a 5-membered azole ring containing 2 to 4 nitrogen atoms. Such an azole ring may have substituent(s) (or form a condensed ring by being fused together with another ring).

Of the pyrazoloazole couplers represented by formula (6), the imidazo[1,2-b]pyrazoles described in U.S. Pat. No. 4,500,630, the pyrazolo[1,5-b]-1,2,4-triazoles described in U.S. Pat. No. 4,500,654 and the pyrazolo[5,1-c]-1,2,4-triazoles described in U.S. Pat. No. 3,725,067 are preferred over the others with respect to spectral absorption characteristics of the dyes formed therefrom.

Details of a substituent group $R^{19}$ and substituent(s) of the azole ring completed by $Q^3$ are described, e.g., in U.S. Pat. No. 4,540,654, from column 2, line 41, to column 8, line 27. More specifically, those preferred as a pyrazoloazole coupler of formula (6) are the pyrazolotriazole couplers described in JP-A-61-65245, which each have a branched-chain alkyl group at the 2-, 3- or 6-position of the pyrazolotriazolyl group; the pyrazoloazole couplers described in JP-A-61-65245, which each contain a sulfonamido group in a molecule; the pyrazoloazole couplers described in JP-A-61-147254, which each contain an alkoxyphenylsulfonamido group as a ballast group; the pyrazolotriazole couplers described in JP-A-62-209457 and JP-A-63-307453, which each have an alkoxy or aryl group at the 6-position; and the pyrazolotriazole couplers described in JP-A-02-201443, which each have a carbonamido group in a molecule. As for Y in formula (6), it has the same meaning as described above.

The couplers of formulae (7) and (8) are called a phenol coupler and a naphthol coupler, respectively. In those formulae, $R^{20}$ represents a hydrogen atom, or a group selected from among —$CONR^{22}R^{23}$, —$SO_2NR^{22}R^{23}$, —$NHCOR^{22}$, —$NHCONR^{22}R^{23}$ and —$NHSO_2NR^{22}R^{23}$. Therein, $R^{22}$ and $R^{23}$ each represents a hydrogen atom or a substituent group. $R^{21}$ in formulae (7) and (8) represents a substituent group, 1 in formula (7) is an integer of from 0 to 2, and m in formula (8) is an integer of from 0 to 4. When 1 and m are each 2 or more, $R^{21}$ groups may be the same or different. Specific examples of substituent groups $R^{21}$ to $R^{23}$ include the groups recited as examples of $X^1$ to $X^5$ in formulae (II) to (IV). Y in formulae (7) and (8) has the same meaning as described hereinbefore.

Suitable examples of a phenol coupler represented by formula (7) include the 2-acylamino-5-alkylphenol couplers described, e.g., in U.S. Pat. Nos. 2,369,929, 2,801,171, 2,772,162, 2,895,826 and 3,772,002, the 2,5-diacylaminophenol couplers described, e.g., in U.S. Pat. Nos. 2,772,162, 3,758,308, 4,126,396, 4,334,011 and 4,327,173, West German Patent Application (OLS) 3,329,729 and JP-A-59-166956, and the 2-phenylureido-5-acylaminophenol couplers described, e.g., in U.S. Pat. Nos. 3,446,622, 4,333,999, 4,451,559 and 4,427,767. Suitable examples of Y herein are the same as those of Y mentioned hereinbefore.

Suitable examples of a naphthol coupler represented by formula (8) include the 2-carbamoyl-1-naphthol couplers described, e.g., i U.S. Pat. Nos. 2,474,293, 4,952,212, 4,146,396, 4,282,233 and 4,296,200, and the 2-carbamoyl-5-amido-1-naphthol couplers described, e.g., in U.S. Pat. No. 4,690,889. Suitable examples of Y herein are the same as those of Y mentioned hereinbefore.

Formulae (9) to (12) represent the couplers called pyrrolotriazole couplers. Therein, $R^{32}$, $R^{33}$ and $R^{34}$ are each a hydrogen atom or a substituent group, and Y has the same meaning as mentioned hereinbefore. Specific examples of substituent groups $R^{32}$, $R^{33}$ and $R^{34}$ include the groups recited hereinbefore as examples of $X^1$ to $X^5$. Suitable examples of pyrrolotriazole couplers represented by formulae (9) to (12) include the couplers described in EP-A1-0488248, EP-A1-0491197 and European Patent 545,300, wherein at least either $R^{32}$ or $R^{33}$ is an electron-attracting group. Suitable examples of Y herein are the same as those of Y mentioned hereinbefore.

In addition to the aforementioned couplers, couplers having different structures, such as a ring-fused phenol, imidazole, pyrrole, 3-hydroxypyridine, an active methylene other than those described above, an active methine, a 5,5-ring-fused hetero ring and a 5,6-ring-fused hetero ring, can also be used.

As for the ring-fused phenol couplers which can be used, the couplers described, e.g., in U.S. Pat. Nos. 4,327,173, 4,564,586 and 4,904,575 are examples thereof.

As for the imidazole couplers which can be used, the couplers described, e.g., in U.S. Pat. Nos. 4,818,672 and 5,051,347 are examples thereof.

As for the 3-hydroxypyridine couplers which can be used, the couplers described, e.g., in JP-A-02-315736 are examples thereof.

As for the active methylene couplers and the active methine couplers which can be used, the couplers described, e.g., in U.S. Pat. Nos. 5,104,783 and 5,162,196 are examples thereof.

As for the 5,5-ring-fused hetero ring couplers which can be used, the pyrrolopyrazole couplers described in U.S. Pat. No. 5,164,289 and the pyrroloimidazole couplers described in JP-A-04-174429 are examples thereof.

As for the 5,6-ring-fused hetero ring couplers which can be used, the pyrazolopyrimidine couplers described in U.S. Pat. No. 4,950,585, the pyrrolotriazine couplers described in JP-A-04-204730 and the couplers described in European Patent 556,700 are examples thereof.

Beyond those couplers, it is also possible in the present invention to use the couplers described. e.g, in West German Pat. No. 3,819,051 A and 3,823,049, U.S. Pat. Nos. 4,840,883, 5,024,930, 5,051,347 and 4,481,268, EP-A2-0304856, European Patent 329,039, EP-A2-0354549, EP-A2-0374781, EP-A2-0379110, EP-A1-0386930, JP-A-63-141055, JP-A-64-32260, JP-A-64-32261, JP-A-02-297547, JP-A-02-44340, JP-A-02-110555, JP-A-03-7938, JP-A-03-160440, JP-A-03-172839, JP-A-04-172447, JP-A-04-179949, JP-A-04-182645, JP-A-04-184437, JP-A-04-188138, JP-A-04-188139, JP-A-04-194847, JP-A-04-204532, JP-A-04-204731 and JP-A-04-204732.

Specific examples of couplers which can be used in the present invention are illustrated below. However, the invention should not be construed as being limited to these examples.

(C-1)

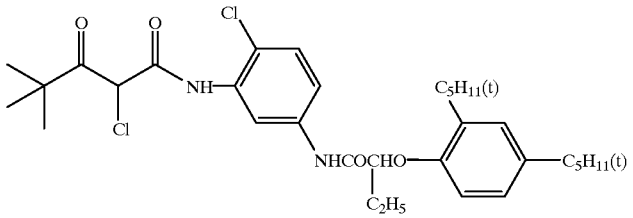

-continued
(C-2)
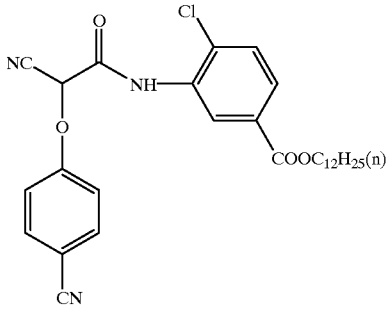
(C-3)
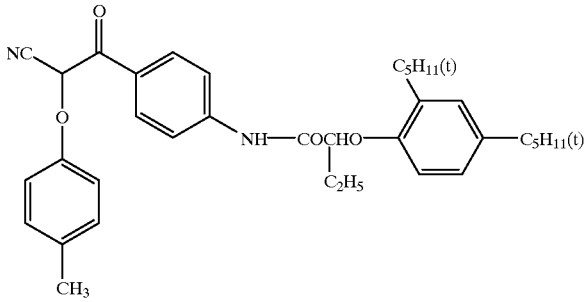
(C-4)
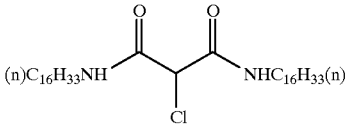
(C-5)
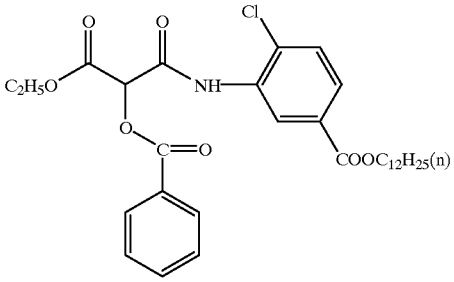
(C-6)
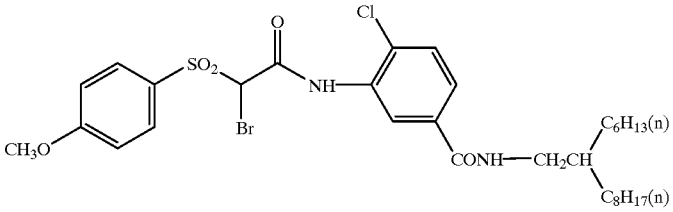
(C-7)
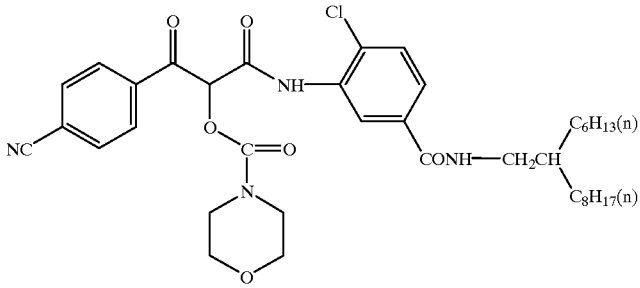

-continued
(C-8)
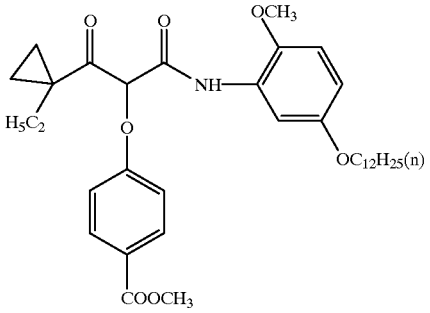
(C-9)
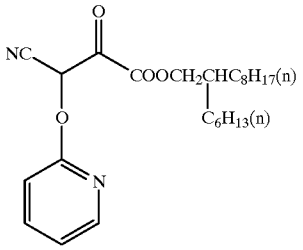
(C-10)
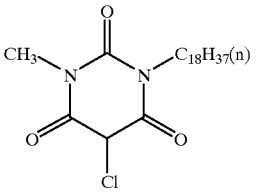
(C-11)
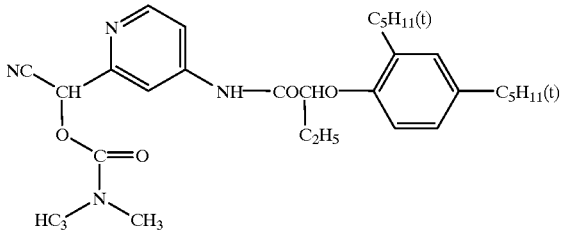
(C-12)
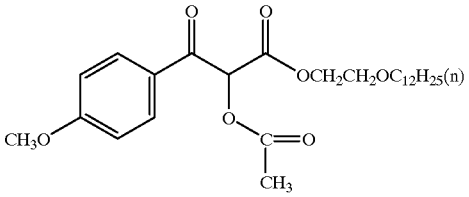
(C-13)
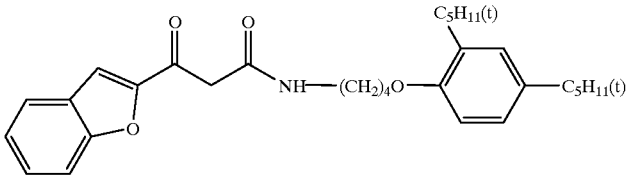
(C-14)
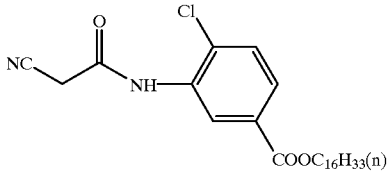
(C-15)
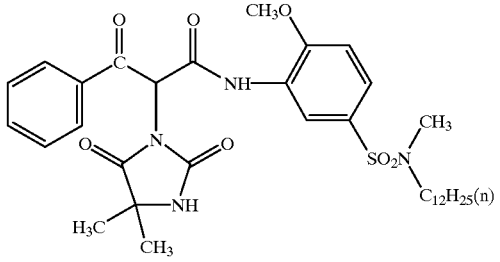

-continued
(C-16)
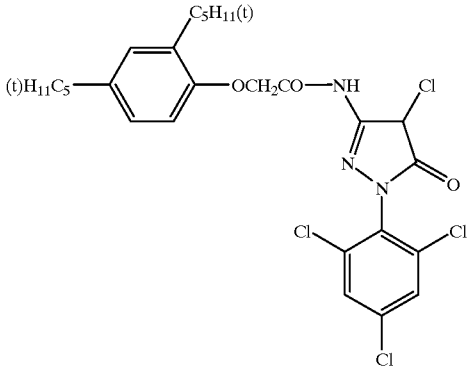
(C-17)
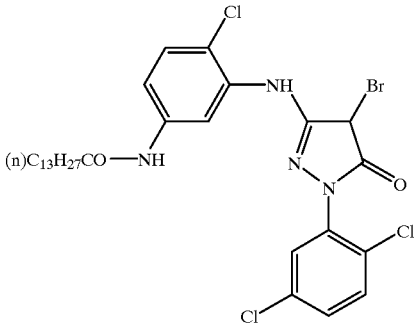
(C-18)
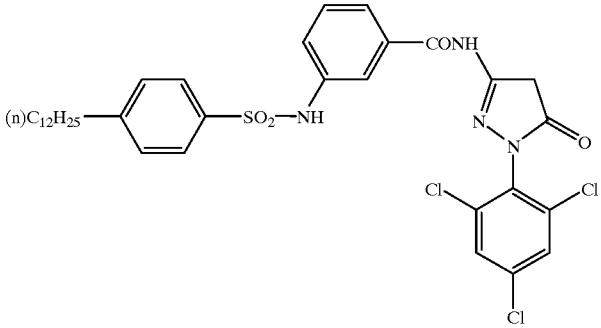
(C-19)
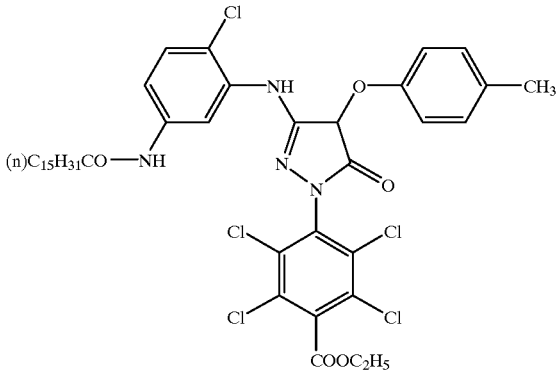
(C-20)
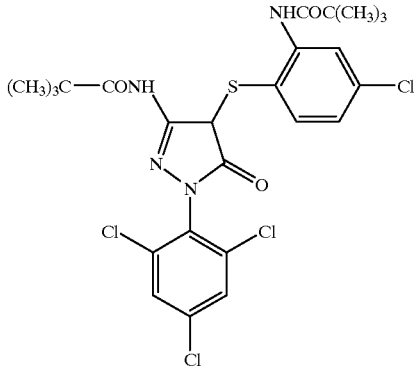
(C-21)
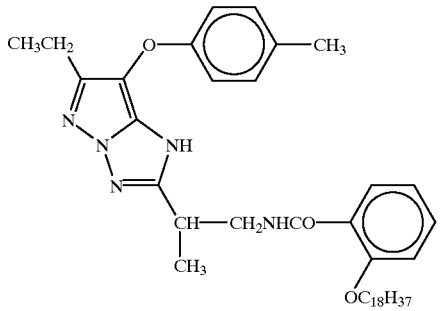
(C-22)
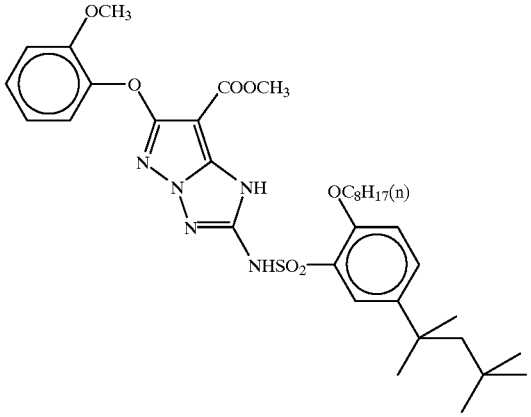

-continued
(C-23)
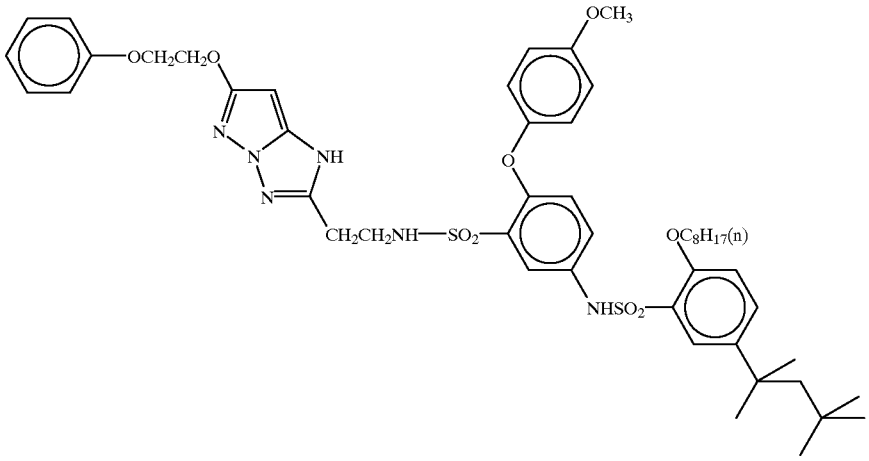
(C-24)
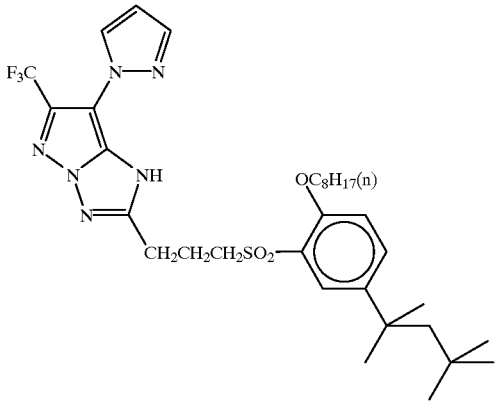
(C-25)
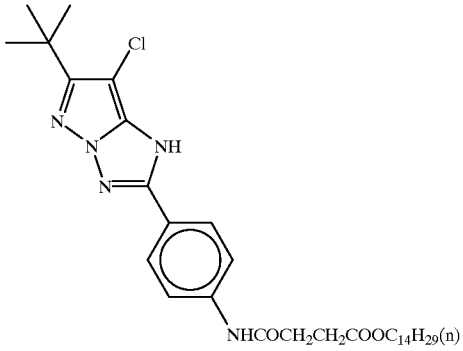
(C-26)
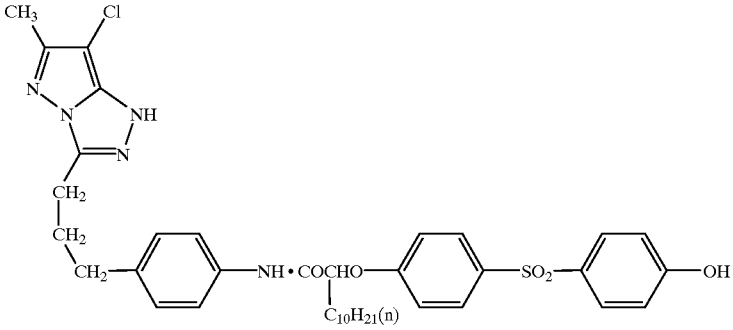

-continued
(C-27)
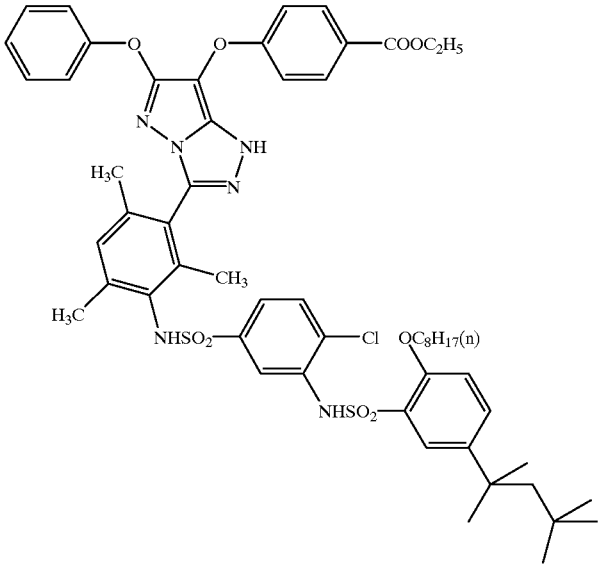
(C-28)
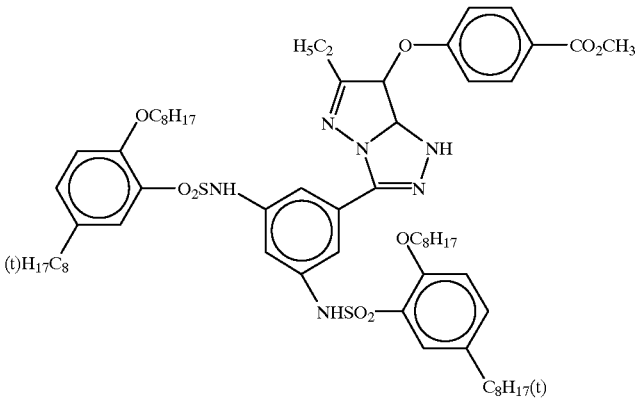
(C-29)
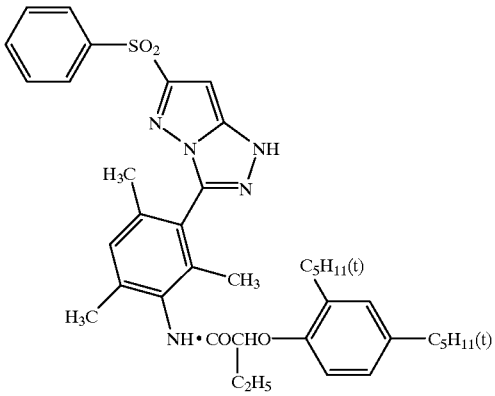
(C-30)
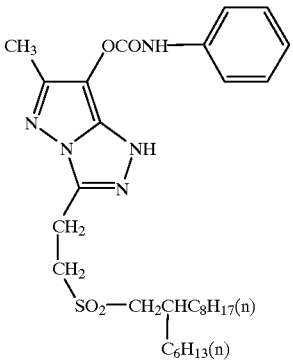

-continued
(C-31)
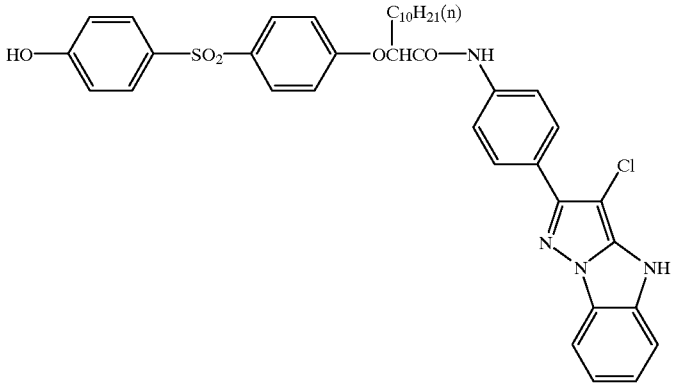
(C-32)
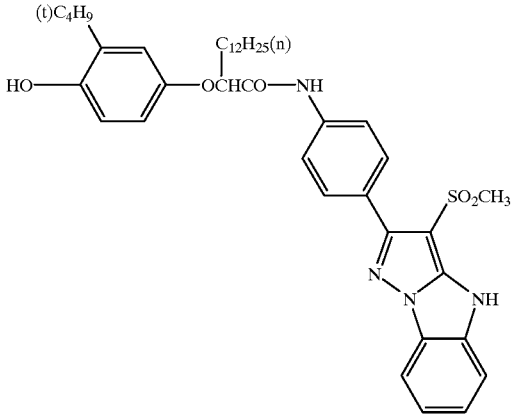
(C-33)
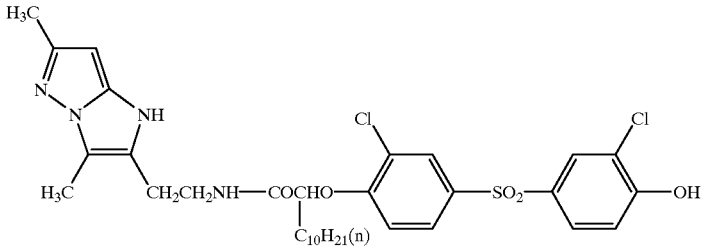
(C-34)
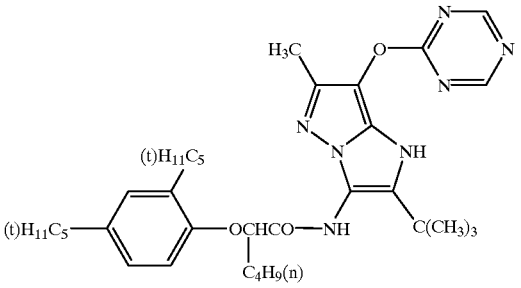

-continued
(C-35)
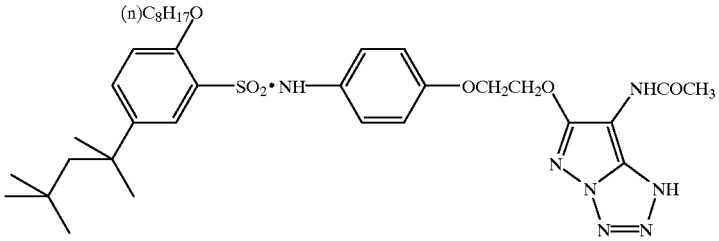
(C-36)
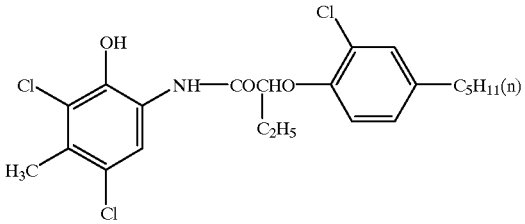
(C-37)
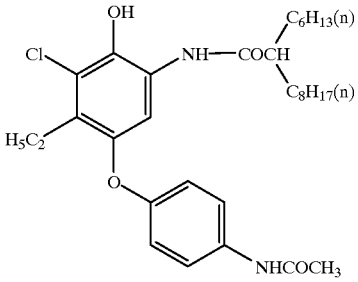
(C-38)
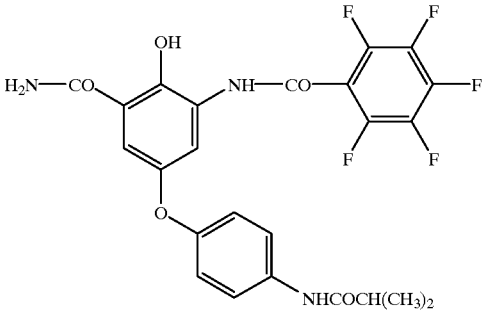
(C-39)
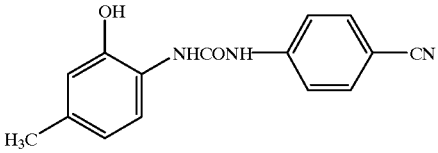
(C-40)
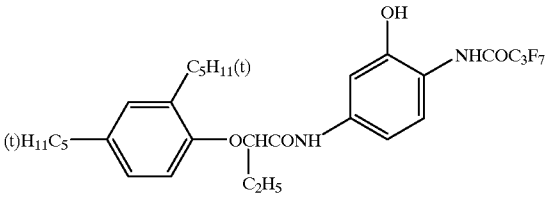
(C-41)
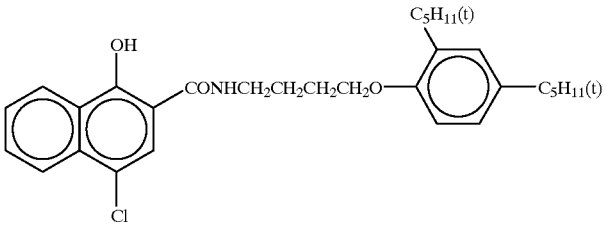

-continued
(C-42)
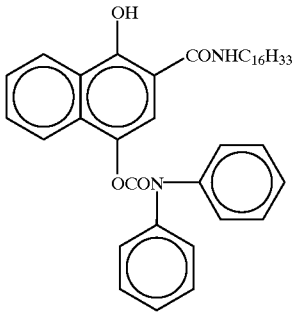
(C-43)
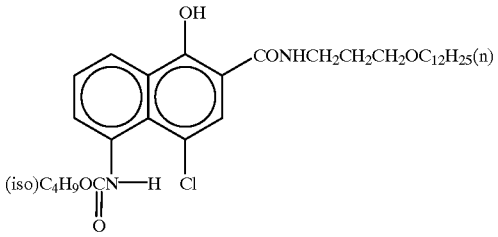
(C-44)
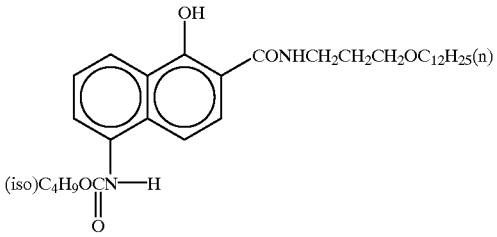
(C-45)
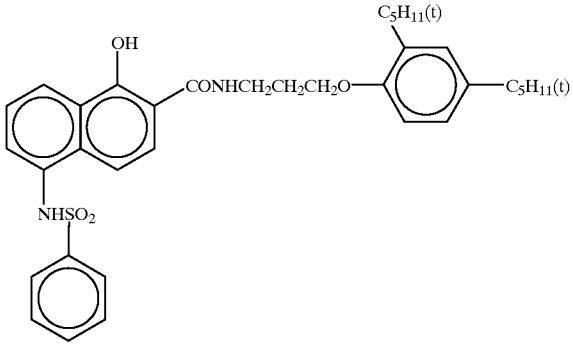
(C-46)
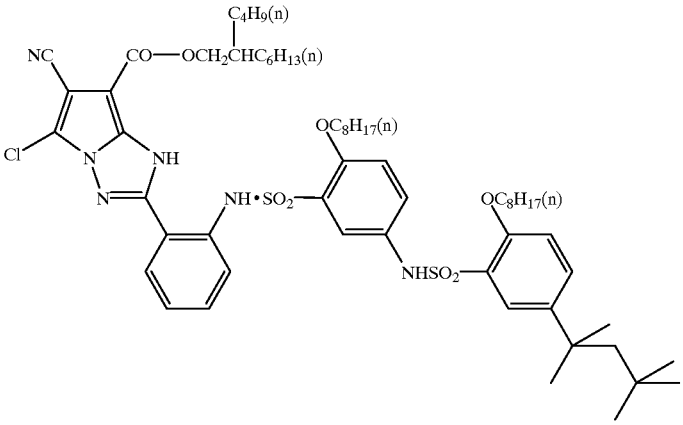

-continued
(C-47)
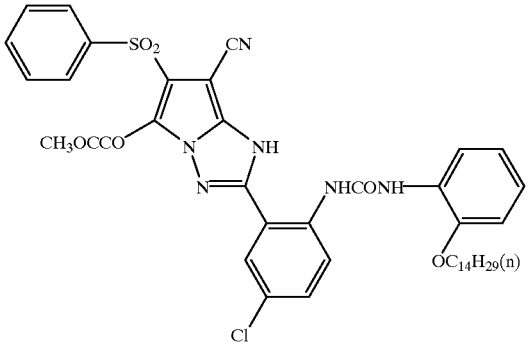
(C-48)
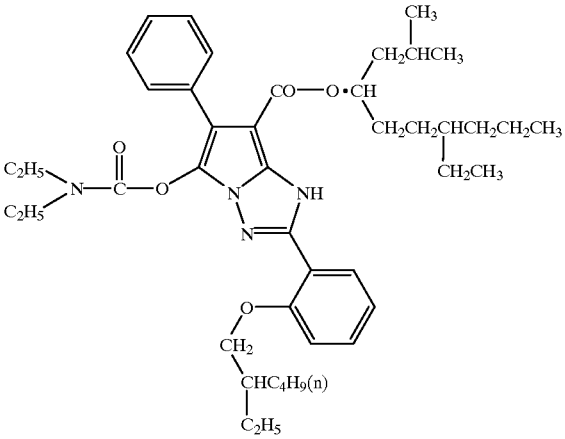
(C-49)
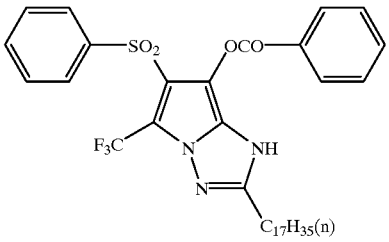
(C-50)
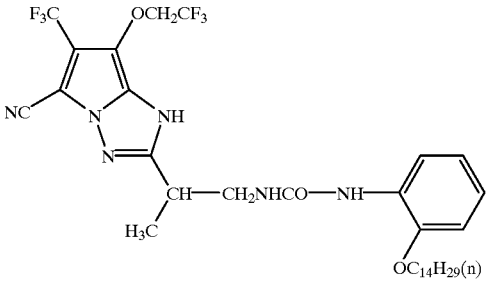
(C-51)
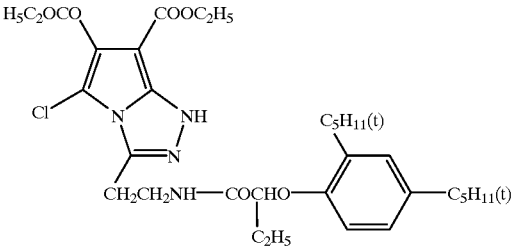
(C-52)
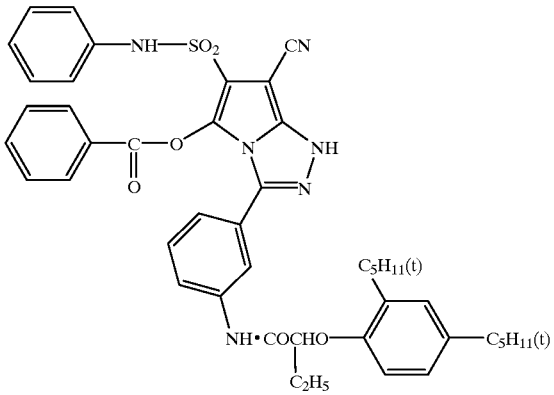
(C-53)
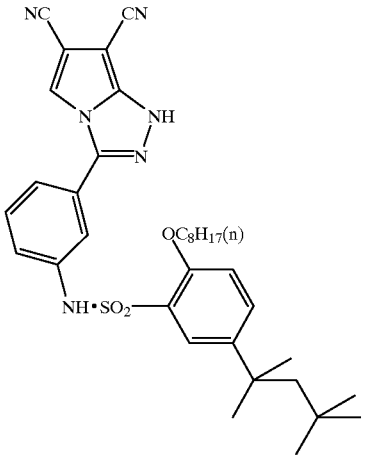

-continued
(C-54)
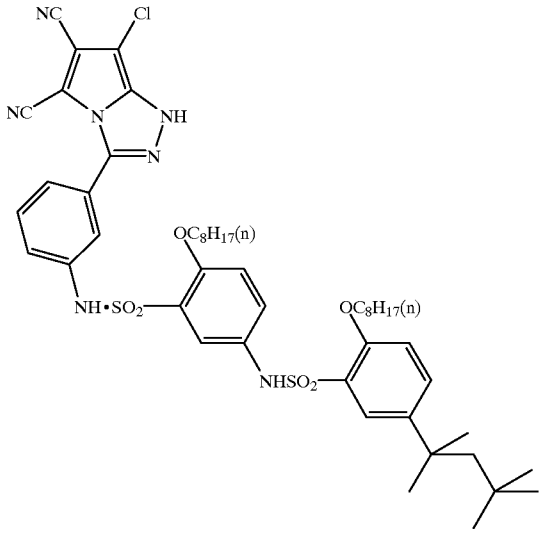
(C-55)
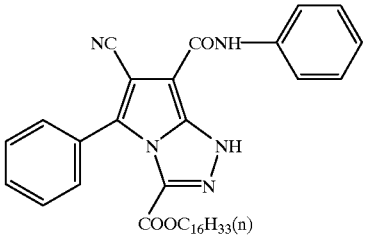
(C-56)
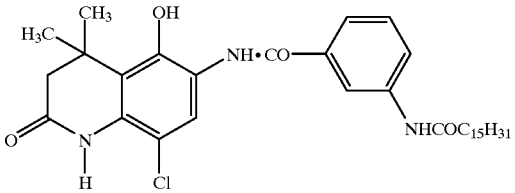
(C-57)
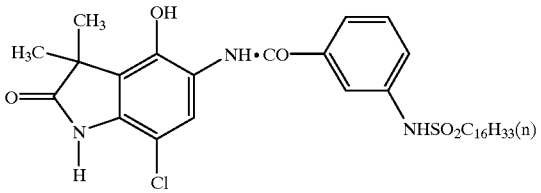
(C-58)
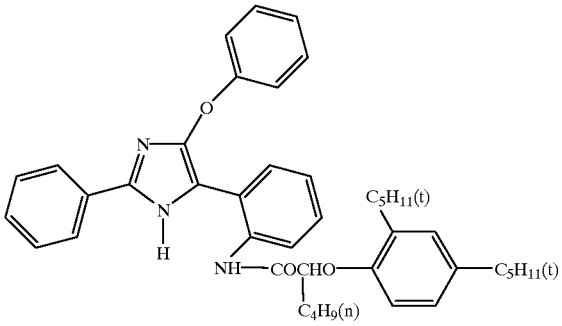
(C-59)
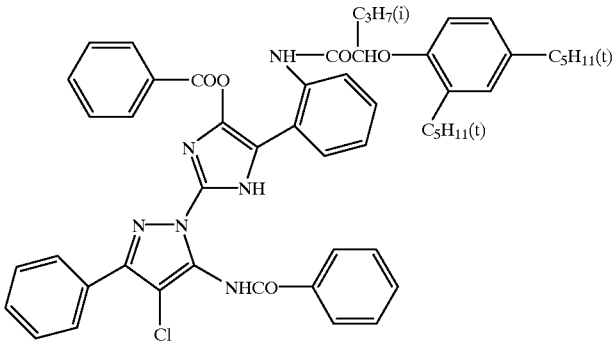

-continued
(C-60)
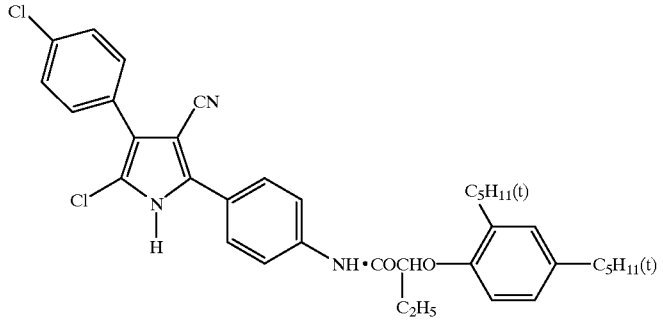
(C-61)
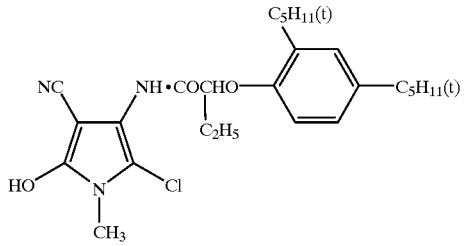
(C-62)
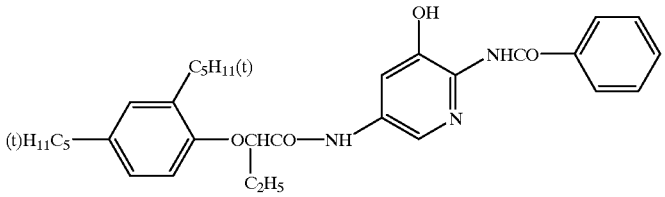
(C-63)
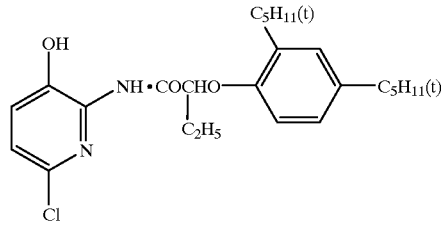
(C-64)
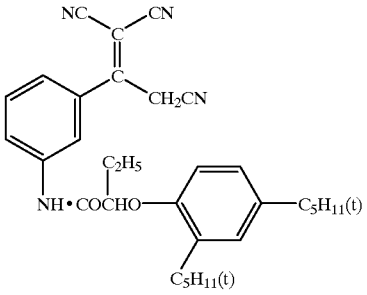
(C-65)
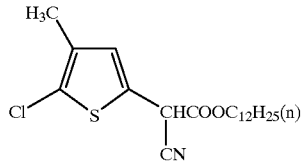
(C-66)
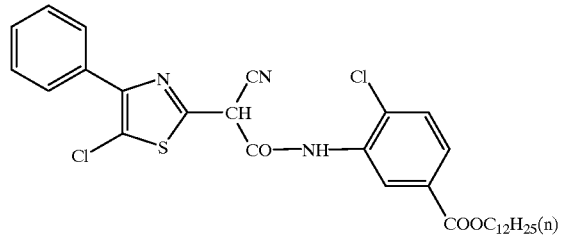

-continued
(C-67)
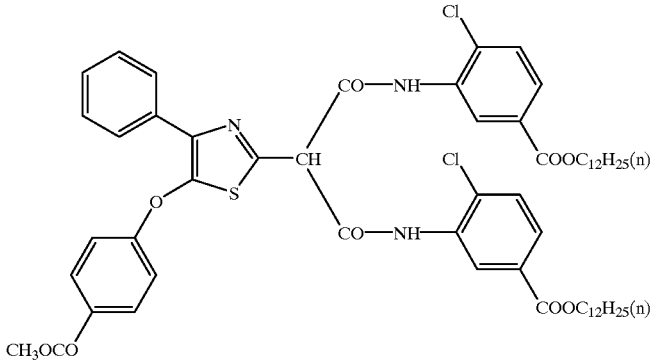
(C-68)
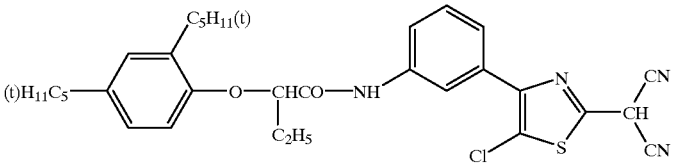
(C-69)
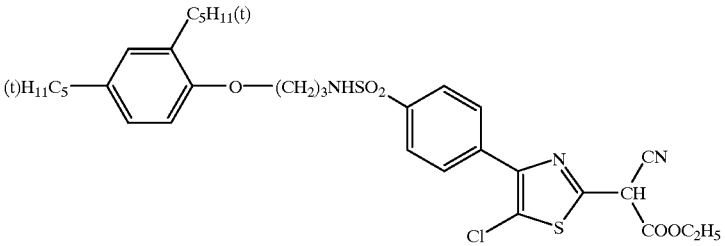
(C-70)
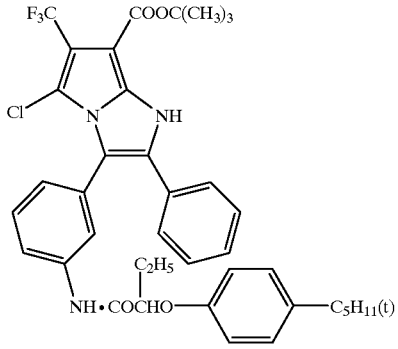
(C-71)
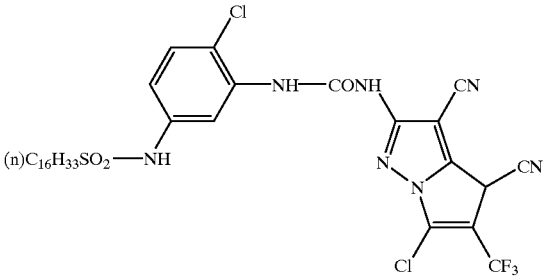
(C-72)
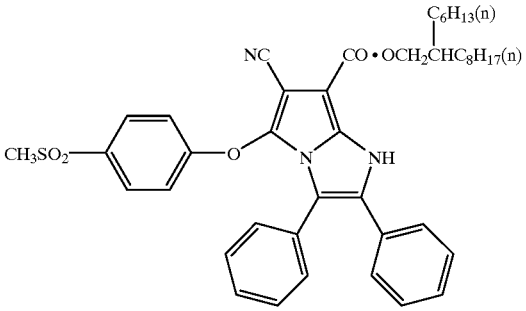

-continued
(C-73)
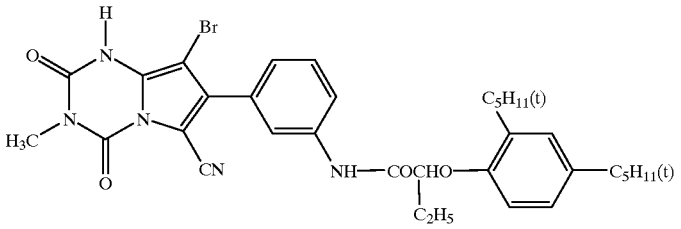
(C-74)
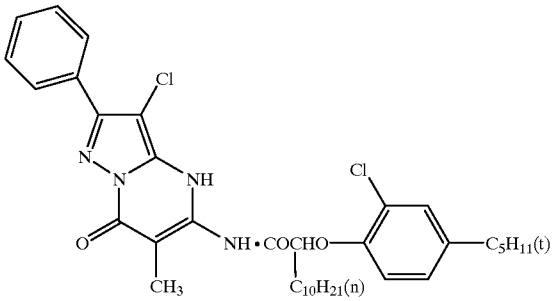
(C-75)
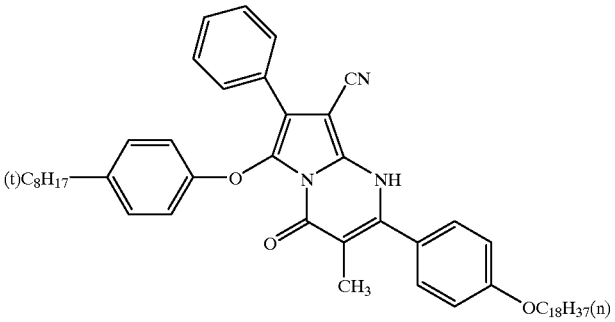
(C-76)
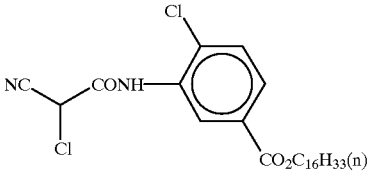
(C-77)
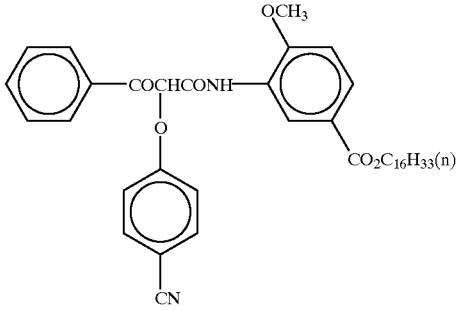
(C-78)
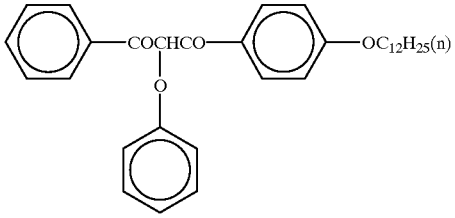

-continued (C-79)

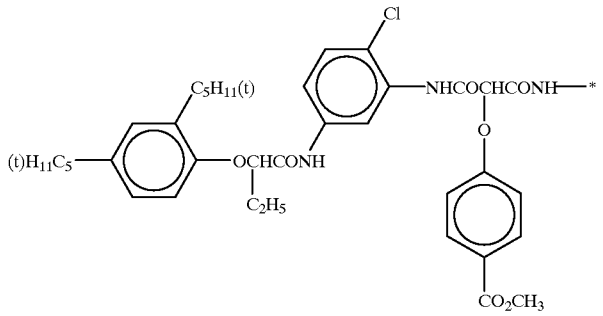

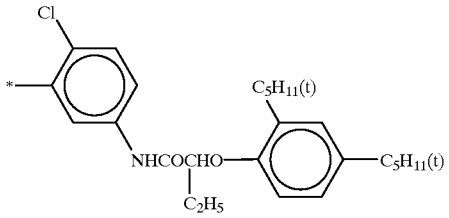

(C-80)

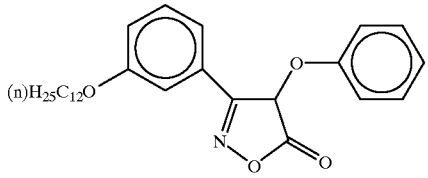

It is desirable that the present reducing agent for color formation be used in an amount of from 0.01 mmol/m$^2$ to 10 mmol/m$^2$ per color forming layer. Preferably, the amount used is from 0.05 to 5 mmol/m$^2$, and particularly preferably from 0.1 to 1 mmol/m$^2$. Such a range of the amount used is favorable for achievement of sufficiently high color density.

In the color forming layer containing the present reducing agent, it is desirable to use couplers in an amount corresponding to 0.05 to 20 times by mole, preferably 0.1 to 10 times by mole, particularly preferably 0.2 to 5 times by mole, the amount of the reducing agent used. The use of couplers in such a range of amount is favorable for achievement of sufficiently high color density.

The present color photosensitive material is basically a color photosensitive material which comprises a support and at least one photographic constituent layer, including at least one hydrophilic colloid layer, provided thereon by coating, and contains a light-sensitive silver halide, a dye-forming coupler and a reducing agent for color formation in any of the photographic constituent layers.

In the most typical embodiment of the present invention, a dye-forming coupler and a reducing agent for color formation are incorporated in the same layer. Also, the coupler and the reducing agent may be added to separate layers as far as they are in a possible state of mutual reaction. However, it is desirable to add these ingredients together to a silver halide emulsion layer or a layer adjacent thereto, preferably to a silver halide emulsion layer.

The present reducing agent for color formation and couplers can be incorporated into a photosensitive material according to known various dispersion methods. However, it is desirable in the present invention to adopt an oil-in-water dispersion method in which those ingredients are dissolved in a high boiling organic solvent (together with a low boiling organic solvent, if needed), emulsified and dispersed in an aqueous gelatin solution, and then add to a silver halide emulsion. A high boiling organic solvent usable in the present invention is a water-immiscible compound having a melting point of 100° C. or lower and a boiling point of 140° C. or higher, and is a good solvent for the reducing agent for color formation and couplers. Details of such a high boiling organic solvent are described in JP-A-62-215272, from the right lower column at page 137 to the right upper column at page 144. In using a high boiling organic solvent in the present invention, the amount thereof has no particular limits. However, it is desirable to use a high boiling organic solvent in an amount such that the ratio of the high boiling organic solvent to the reducing agent for color formation be not greater than 20 by weight, preferably from 0.02 to 5 by weight, particularly preferably from 0.2 to 4 by weight.

Also, known polymer dispersion methods may be adopted in the present invention. The processes and effects of a latex dispersion method as one of the polymer dispersion methods, and specific examples of a latex for impregnation as well, are described, e.g., in U.S. Pat. No. 4,199,363, West German Patent Applications (OLS) 2,541,274 and 2,541,230, JP-B-53-41091 and EP-A-0029104. In addition, the dispersion method using a polymer soluble in an organic solvent is described in PCT World Open No. WO 88/00723.

The oleophilic fine particles in which the present reducing agent for color formation is incorporated has no particular restriction on their average size, but the average size ranging from 0.05 to 0.3 μm, particularly from 0.05 to 0.2 μm, is desirable from the viewpoint of color productivity.

A diminution in average size of oleophilic fine particles can be attained by choosing a proper kind of surfactant, increasing the amount of a surfactant used, heightening the viscosity of a hydrophilic colloid solution, lowering the viscosity of an oleophilic organic phase by the combined use with a low boiling organic solvent, strengthening the shearing stress, e.g., by increasing a revolution speed of the stirring blades of an emulsifying apparatus, or making an emulsification time longer.

The sizes of oleophilic fine particles can be measured with a Nanosizer made by British Coulter Co. or so on.

When the dyes produced from the present reducing agent and dye-forming couplers are diffusible dyes, it is desirable to add a mordant to a photosensitive material. If this form is adopted in the present invention, it becomes needless to develop colors by dipping the photosensitive material in an alkali solution, and thereby the image stability after processing can be improved to a considerable extent. A mordant may be used in any of constituent layers, excepting the layer containing the present reducing agent for color formation. This is because the mordant lowers the stability of the reducing agent. In other words, it is desirable to use a mordant in a layer free from the present reducing agent for color formation. Additionally, the dye produced from the reducing agent for color formation and a coupler diffuses through swollen gelatin layers during photographic processing and binds to a mordant, and thereby its color is fixed. For high image sharpness, therefore, it is desirable that the diffusion distance of dyes be short. Thus, a mordant is preferably added to a layer adjacent to the layer containing the reducing agent for color formation.

Further, the dyes produced from the present reducing agent for color formation and the present couplers are soluble in water, so that there is a possibility of their effusion into a processing solution. For prevention of such effusion, it is desirable that the mordant-added layer be located on the upper side of the layer containing the reducing agent for color formation, that is, on the side opposite to the support. However, in the case where the barrier layer as described in JP-A-07-168335 is provided over the mordant-added layer, and that on the side opposite to the support, it is also desirable that the mordant-added layer be located on the support side of the layer containing the reducing agent for color formation.

Furthermore, a mordant may be added to two or more layers. Specifically, in the case where the reducing agent for color formation is incorporated in two or more layers, it is desirable that a mordant be added to layers adjacent respectively to those layers.

As for the coupler which forms a diffusible dye, any couplers can be used as far as they form diffusible dyes having the capability to reach a mordant upon coupling with the present reducing agent for color formation. However, it is desirable for the diffusible dye formed to contain at least one dissociative group having a pKa value (dissociation constant) of no higher than 12, preferably no higher than 8, particularly preferably no higher than 6, and have a molecular weight of from 200 to 2,000. Further, it is desirable for the diffusible dye formed to have a ratio of the molecular weight to the number of dissociative groups having a pKa value below 12 within the range of 100 to 2,000, preferably 100 to 1,000. Additionally, the above pKa values are the values determined using a 1:1 mixture of dimethylformamide and water as solvent.

As for the solubility of the diffusible dye formed from a coupler, it is desirable for the diffusible dye formed by coupling with the present reducing agent for color formation to be dissolved in an alkali solution of pH 11 at 25° C. in a concentration of at least $1\times10^{-6}$ mole/l, preferably at least $1\times10^{-5}$ mole/l, particularly preferably at least $1\times10^{-4}$ mole/l. As for the diffusion constant of the diffusible dye formed from a coupler, it is desirable for the diffusible dye formed by coupling with the present reducing agent for color formation to have a diffusion constant of at least $1\times10^{-8}$ $m^2\cdot s^{-1}$, preferably at least $1\times10^{-7}$ $m^2\cdot s^{-1}$, particularly preferably $1\times10^{-6}$ $m^2\cdot s^{-1}$, when it is dissolved in an alkali solution of pH 11 at 25° C. in a concentration of $10^{-4}$ mole/l.

As for the mordant which can be used in the present invention, though any of generally used mordants may be chosen, polymeric mordants are preferred in particular. The term "polymeric mordant" as used herein is intended to include polymers containing tertiary amino groups, polymers having nitrogen-containing heterocyclic moieties and polymers containing quaternary cation groups into which the tertiary amino groups or the nitrogen atoms of the nitrogen-containing heterocyclic rings are converted.

Specific examples of a homo- or copolymer having as a constitutional repeating unit a vinyl monomer containing a tertiary imidazole group include the mordants described, e.g., in U.S. Pat. No. 4,282,305, 4,115,124 and 3,148,061, JP-A-60-118834, JP-A-60-122941, JP-A-62-244043 and JP-A-62-244036.

Suitable examples of a homo- or copolymer having as a constitutional repeating unit a-vinyl monomer containing a quaternary imidazolium salt group include the mordants described, e.g., in British Patents 2,056,101, 2,093,041 and 1,594,961, U.S. Pat. Nos. 4,124,386, 4,115,124 and 4,450,224, JP-A-48-28325.

Suitable examples of a homo- or copolymer having as a constitutional repeating unit a vinyl monomer containing a quaternary ammonium salt group, other than quaternary imidazolium salt group, include the mordants described, e.g., in U.S. Pat. Nos. 3,709,690, 3,898,088 and 3,958,995, JP-A-60-57836, JP-A-60-60643, JP-A-60-122940, JP-A-60-122942 and JP- A-60-235134.

As other examples of a suitable polymeric mordant, mention may be made of the vinylpyridine polymers and vinylpyridinium cation polymers disclosed, e.g., in U.S. Pat. Nos. 2,548,564, 2,484,430, 3,148,161 and 3,756,814; the polymeric mordants capable of cross-linking with gelatin or the like which are disclosed, e.g., in U.S. Pat. Nos. 3,625,694, 3,859,096 and 4,128,538, and British Patent 1,277,453; the mordants of aqueous sol type disclosed, e.g., in U.S. Pat. Nos. 3,958,995, 2,721,852 and 2,798,063, JP-A-54-115228, JP-A-54-145529 and JP-A-54-26027; the water-insoluble mordants disclosed in U.S. Pat. No. 3,898,088; the reactive mordants capable of covalently binding to dyes, which are disclosed, e.g., in U.S. Pat. No. 4,168,976 (corresponding to JP-A-54-137333); and the mordants disclosed in U.S. Pat. Nos. 3,709,690, 3,788,855, 3,642,482, 3,488,706, 3,557,066 and 3,271,147, JP-A-50-71332, JP-A-53-30328, JP-A-52-155528, JP-A-53-125 and JP-A-53-1024.

In addition, the mordants described in U.S. Pat. Nos. 2,675,316 and 2,882,156 can be used in the present invention.

An appropriate molecular weight of the polymeric mordant used in the present invention is in the range of 1,000 to 1,000,000, and it is particularly desirable for the molecular weight to be from 10,000 to 200,000.

The polymeric mordant as recited above is generally used in the form of mixture with a hydrophilic colloid. As for the hydrophilic colloid, not only a hydrophilic colloid but also a highly hygroscopic polymer and a mixture of a hydrophilic colloid with a highly hygroscopic polymer can be used, but the most typical hydrophilic colloid is gelatin. Taking into account the amount of dyes to be mordanted, the type and the composition of a mordant used and the image forming process adopted, the mixing ratio of a polymeric mordant to a hydrophilic colloid and the coverage rate of a polymeric mordant can be easily determined by one skilled in the art. Specifically, the ratio of a mordant to a hydrophilic colloid is appropriately from 20/80 to 80/20, and the coverage rate of a mordant is appropriately from 0.2 to 15 g/m$^2$, particularly from 0.5 to 8 g/m$^2$.

In the present invention, it is desirable to incorporate an auxiliary developing agent or its precursor in a photosensitive material. Compounds suitable therefor are illustrated below.

The term "auxiliary developing agent" as used herein refers to the compound having a function of promoting the electron transfer from the reducing agent for color formation to silver halide during the developing step of silver halide grains, preferably the compound capable of not only developing the exposed silver halide grains but also oxidizing the reducing agent for color formation when it is oxidized (this function is called "cross-oxidation" hereinafter).

As for the auxiliary developing agent, pyrazolidones, dihydroxybenzenes, reductones and aminophenols are used to advantage in the present invention. In particular, pyrazolidones are preferred over the others. It is desirable for those compounds to have low diffusibility in a hydrophilic colloid layer. Specifically, their solubilities in water at 25° C. are desirably below 0.1%, more desirably below 0.05%, most desirably below 0.01%.

Precursors of an auxiliary developing agent used in the present invention are compounds which are present stably in a photosensitive material but release the auxiliary developing agent as soon as they are treated with a processing solution. In the case of using these compounds, it is desirable that they also be low in diffusibility in a hydrophilic colloid layer. Specifically, their solubilities in water at 25° C. are desirably below 0.1%, more desirably below 0.05%, most desirably below 0.01%. The auxiliary developing agent released from its precursor is not particularly restricted as to solubility, but it is desirable for the auxiliary developing agent itself to be low in solubility.

The precursors of an auxiliary developing agent used in the present invention are preferably represented by the following formula (A):

$$A—(L)_n—PUG \quad (A)$$

wherein A represents a blocking group, and the bond between A and a moiety $(L)_n$—PUG is cleaved upon development-processing; L represents a linkage group and, after the bond between A and L is cleaved, the bond between L and PUG is cleaved to release PUG; n is an integer of from 0 to 3; and PUG represents an auxiliary developing agent.

As the auxiliary developing agent, electron-releasing compounds which conform to Kendall-Pelz rule, other than p-phenylenediamines, can be employed. Of those compounds, pyrazolidones are preferred over the others.

To the blocking group can be applied the known groups recited below. Specifically, applicable blocking groups are the blocking groups described, e.g., in U.S. Pat. No. 3,311,476, such as an acyl group and a sulfonyl group; the blocking groups utilizing the so-called reverse Michael's reaction, as described, e.g., in JP-A-59-105642; the blocking groups utilizing the production of quinonemethide or the analogues thereof accompanied by an intramolecular electron transfer, as described, e.g., in JP-A-02-280140; the blocking groups utilizing an intramolecular nucleophilic substitution reaction, as described, e.g., in JP-A-63-31855 (corresponding to EP-A-0395729; the blocking groups utilizing an addition reaction of a nucleophilic agent to a conjugated unsaturated bond, as described, e.g., in JP-A-04-186344; the blocking groups utilizing a β-elimination reaction, as described in JP-A-62-163051; the blocking groups utilizing the nucleophilic substitution reaction of diarylmethanes described in JP-A-61-199540; the blocking groups utilizing Lossen rearrangement reaction described in JP-A-62-187950; the blocking groups utilizing the reaction of a N-acyl body of thiazolidine-2-thione with an amine, as described in JP-A-62-147457; and the blocking groups having two electrophilic groups and reacting with a dinucleophile agent, as described in WO 93/03419.

The group represented by L is a linkage group which enables the cleavage of the bond between $(L)_n$ and PUG after the release from the group represented by A upon development-processing, and has no particular restriction as far as it has the above-mentioned function.

Specific examples of an auxiliary developing agent and a precursor thereof are illustrated below. However, the compound usable in the invention should not be construed as being limited to these examples;

(ETA-1)

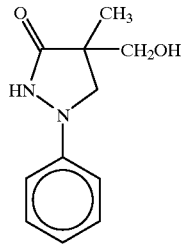

(ETA-2)

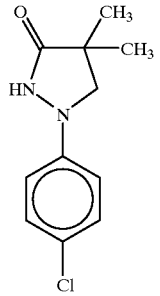

(ETA-3)

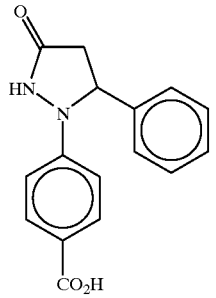

-continued
(ETA-4)
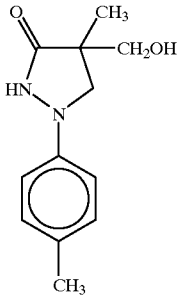
(ETA-5)
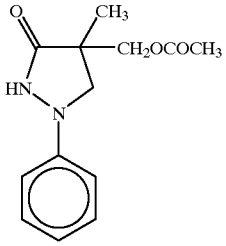
(ETA-6)
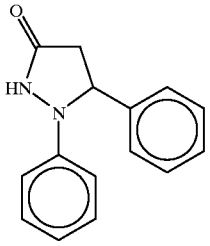
(ETA-7)
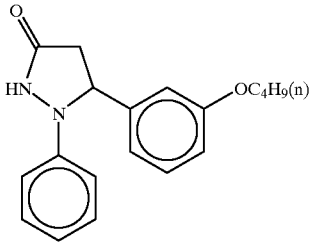
(ETA-8)
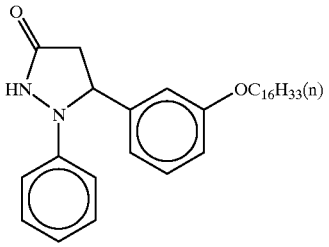
-continued
(ETA-9)
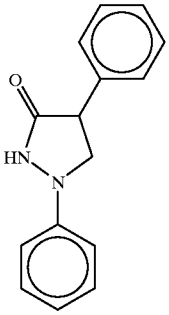
(ETA-10)
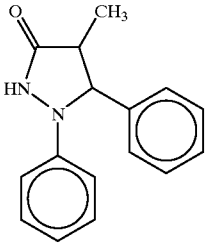
(ETA-11)
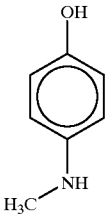
(ETA-12)
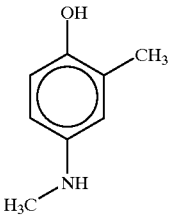
(ETA-13)
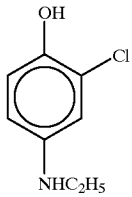
(ETA-14)
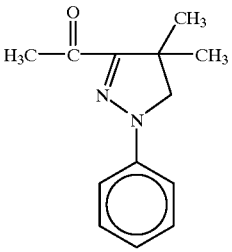

-continued (ETA-15)

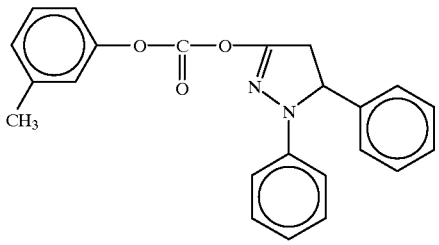

(ETA-16)

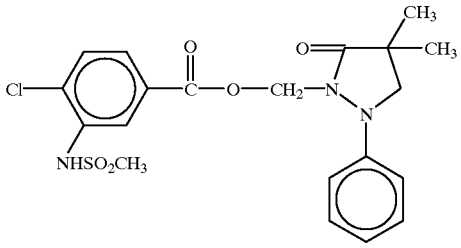

(ETA-17)

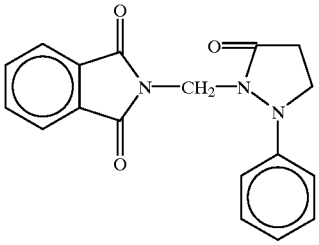

(ETA-18)

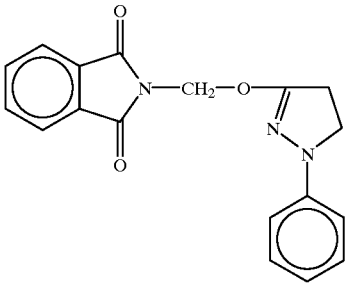

(ETA-19)

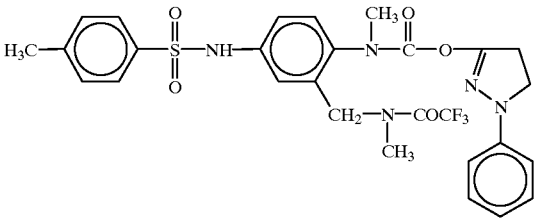

-continued (ETA-20)

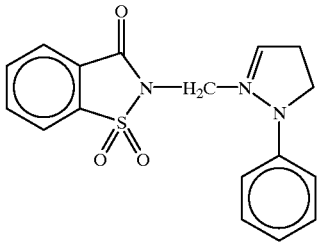

Those compounds may be incorporated in any of light-sensitive layers, interlayers, subbing layers and protective layers. In the case of an auxiliary developing agent, however, it is desirable to incorporate it in a light-insensitive layer.

In order to incorporate those compounds in a photosensitive material, various known methods can be adopted. Specific examples thereof include the method of dissolving a compound in a water-miscible organic solvent, such as methanol, and then adding it directly to a hydrophilic colloid; the method of converting a compound into a water solution or colloid dispersion in the presence of a surfactant, and then adding it to a hydrophilic colloid; the method of dissolving a compound in a substantially water-immiscible solvent or oil, dispersing it into water or a hydrophilic colloid, and then adding the dispersion to a hydrophilic colloid; and the method of adding a compound in the form of finely divided solid dispersion to a hydrophilic colloid. These methods may be used alone or in combination of two or more thereof. The preparation method of a finely divided solid dispersion is described in detail in JP-A-02-235044, page 20.

The amount of those compounds incorporated in a photosensitive material is from 1 to 200 mole %, preferably from 5 to 100 mole %, more preferably from 10 to 50 mole %, to the reducing agent for color formation.

As for the support used in the present invention, any of transmission or reflection type supports, such as glass, paper and plastic films, can be used as far as photographic emulsion layers can be coated thereon. Specific examples of a plastic film usable in the present invention include polyester films, such as polyethylene terephthalate, polyethylene naphthalate, cellulose triacetate and cellulose nitrate, polyamide films, polycarbonate films and polystyrene films.

The term "reflection type support" as used above signifies the support having an enhanced reflectance to make dye images formed in silver halide emulsion layers clear, with examples including a support coated with a hydrophobic resin layer containing a light-reflecting substance, such as titanium oxide, zinc oxide, calcium oxide or calcium sulfate, in a dispersed condition, and a support made of a hydrophobic resin containing a light-reflecting substance in a dispersed condition. As specific examples thereof, mention may be made of polyethylene-coated paper, polyester-coated paper, synthetic paper of polypropylene type and a support provided with a reflecting layer or a reflecting substance, such as a glass plate, a polyester film, including a polyethylene terephthalate film, a cellulose triacetate film and a cellulose nitrate film, a polyamide film, a polycarbonate film, a polystyrene film or a polyvinyl chloride resin film. As for the polyester-coated paper, the polyester-coated paper described in European Patent 0,507,489, which contains polyethylene terephthalate as a main component, is preferred in particular.

The reflection type support preferably used in the present invention is a paper support which is covered with a waterproof resin layer on both sides and contains fine particles of a white pigment in at least one waterproof resin layer. This white pigment particles is desirably contained in a proportion of at least 12 weight %, preferably at least 14 weight %. As for the light-reflecting white pigment, it is desirable that the pigment be thoroughly kneaded in the presence of a surfactant and the surface thereof be treated with a di- to tetrahydric alcohol.

It is desirable for the present invention to use a support having a surface on which diffuse reflection of second type occurs. The term "diffuse reflection of second type" as used herein refers to the diffuse reflection obtained by roughening a glassy surface to divide it into minute glassy faces turned to different directions. The roughness of a surface causing diffuse reflection of second type is from 0.1 to 2 $\mu$m, preferably from 0.1 to 1.2 $\mu$m, expressed in terms of the three-dimensional average roughness on the center plane. Details of such a support are described in JP-A-02-23924.

In order to obtain colors covering a wide region on a chromaticity diagram by the use of three primaries, namely yellow, magenta and cyan colors, at least three silver halide emulsion layers having their sensitivities in different spectral regions respectively are used in combination. For instance, a combination of blue-sensitive, green-sensitive and red-sensitive layers or a combination of green-sensitive, red-sensitive and infrared-sensitive layers is coated on a support. These light-sensitive layers can take any of arranging orders adopted in generally used color photosensitive materials. Each of those light-sensitive layer may be divided into two or more layers, if desired.

In addition to those light-sensitive layers, the photosensitive material can be provided with various light-insensitive photographic constituent layers, such as a protective layer, a subbing layer, an interlayer, an anti-halation layer and a backing layer. Further, various types of filter dyes can be added to photographic constituent layers for the purpose of improvement in color separation.

As for the binder or the protective colloid which can be used for photosensitive materials relating to the present invention, gelatin is used to advantage. Also, it is possible to use another hydrophilic colloid alone or in combination with gelatin. With respect to the gelatin used in the present invention, it is desirable that the calcium content therein be not greater than 800 ppm, preferably not greater than 200 ppm, and the iron content therein be not greater than 5 ppm, preferably not greater than 3 ppm. Furthermore, the addition of antimolds as described in JP-A-63-271247 is desirable for the purpose of preventing the deterioration of image quality due to propagation of various molds and germs in hydrophilic colloid layers.

When the present photosensitive material is subjected to printer exposure, it is desirable to use the band stop filter described in U.S. Pat. Nos. 4,880,726. This filter can get rid of color stain of optical origin to improve color reproducibility to a great extent.

The silver halide emulsion grains used in the present invention can be grains of silver bromide, silver chloride, silver iodide, silver chlorobromide, silver chloroiodide, silver iodobromide or silver chloroiodobromide. Other silver salts, such as silver thiocyanate, silver sulfide, silver selenide, silver carbonate, silver phosphate and silver salts of organic acids, may form grains independently of silver halide emulsion grains, or they may be included in silver halide emulsion grains. In a case where it is requested to carry out development and desilvering (bleaching, fixation and bleach-fix) steps with rapidity, emulsion grains having a chloride content of at least 90 mole %, or the so-called high chloride content emulsion grains, are preferably used. In a case where it is requested to moderately restrain development, on the other hand, it is desirable for the emulsion grains to include silver iodide. An appropriate iodide content depends on what purpose the intended photosensitive material is used for.

As for the high chloride content emulsions used in the present invention, the emulsion grains therein can have a structure such that silver bromide-localized phases are present inside and/or the surface of the grains with or without assuming a layer form. In such a localized phase, the bromide content should be at least 10 mole %, and it is preferably more than 20 mole %. The bromide content in a silver bromide-localized phase can be determined by X-ray diffractiometry (described, e.g., in *Shin-Jikken Kagaku Koza 6 Kozo Kaiseki* (which means "Lectures on New Experimental Chemistry, vol. 6, Structural Analyses"), compiled by Chemical Society of Japan and published by Maruzen) or the like. The bromide-localized phases can be present inside the grains, or at the edges, corners or faces of the grain surface. In particular, it is preferable for those phases to be present at the corners of the grain surface in a condition of epitaxial growth.

For the purpose of reducing a replenishment rate of a development-processing solution, it is effective to further heighten the chloride content in a silver halide emulsion. In such a case, an emulsion having a chloride content of from 98 to 100 mole %, namely an emulsion of almost pure silver chloride, can be used to advantage.

It is desirable that the silver halide emulsion used in the present invention have inside the grains a distribution or a structure with respect to halide composition. Typical examples thereof are described in JP-B-43-13162, JP-A-61-215540, JP-A-60-222845, JP-A-60-143331, JP-A-61-75337 and JP-A-60-222844.

With the intention of making emulsion grains have an internal structure, not only grains having the wrapped-in structures as cited above but also grains having the so-called fused structures can be formed. Those grains are disclosed, e.g., in JP-A-59-133540, JP-A-58-108526, EP-A2-0199290, JP-B-58-24772 and JP-A-59-16254.

Although it is natural for the combination of different silver halides to have a fused structure, it is also possible that the combination of silver halide with a silver salt having a structure other than rock salt structure, such as silver thiocyanate or silver carbonate, takes a fused structure.

In cases where silver iodobromide grains or the like have a wrapped-in structure, it is a favorable embodiment to render the iodide content higher in the core part than in the shell part. Conversely, it is desirable sometimes that the iodide content in the grains be lower in the core than in the shell part. Also in the grains having a fused structure, the iodide content may be high in a host crystal and relatively low in a fused crystal, and vice versa. With respect to the grains having those structures, a boundary between the parts differing in halide composition may have a clear interface, or may be rendered obscure. Also, it is a favorable embodiment that a continuous change in halide composition is positively made in the boundary region.

In cases where silver halide grains constituted of two or more kinds of silver halides are present in the form of mixed crystal or have a structure inside thereof, it is important to control a distribution of halide compositions among grains. The method for determination of a distribution of halide compositions among grains is described in JP-A-60-254032. In particular, highly uniform emulsions having a variation coefficient of no greater than 20% with respect to the halide composition distribution are preferred.

Moreover, it is important to control the halide composition in the vicinity of grain surface. Since raising an iodide content or chloride content in the vicinity of the grain surface changes the surface coverage of dyes and the development speed, the halide composition in the vicinity of grain surface may be chosen depending on the intended purpose.

The silver halide grains used in the present invention can be chosen, depending on their intended purpose, from those having twin plane-free regular crystal forms or those having twin planes, such as multiply twinned crystal forms which have at least two parallel or nonparallel twin planes, as illustrated at page 163 of *Shashin Kogyo no Kiso, Gin-en shashin Hen* (which means "Fundamendals of Photographic Industry—Volume of Silver Salt Photography"), compiled by Photographic Society of Japan and published by Corona Co. in 1979. Also, a mixture of silver halide grains having various crystal forms as described in U.S. Pat. No. 4,865,946 may be used. As for the grains having a regular crystal form, the grains having a cubic form consisting of (100) faces, those having an octahedral form consisting of (111) faces and those having a dodecahedral form consisting of (110) faces as disclosed in JP-B-55-42737 and JP-A-60-222042 can be employed. Further, depending on their intended purpose, the grains used in the present invention can be selected from the grains having (hlm) faces as reported in *Journal of Imaging Science*, vol. 30, page 247 (1986). In addition, grains having a crystal form in which two or more planes differing in Miller indices are present, such as tetradecahedral grains having both (100) and (110) planes and the grains having both (111) and (110) planes, can be used, if desired.

The form of tabular grains is defined by an aspect ratio, which is the value obtained by dividing the diameter of a circle having the same area as the projected area of each grain (which is called "the circle-equivalent diameter", hereinafter) by a thickness of the grain. In the present invention can be used tabular grains having an aspect ratio of no smaller than 1. Such tabular grains can be prepared according to the methods described, e.g., in Cleve, *Photographic Theory and Practice*, page 131 (1930); Gutoff, *Photographic Science and Engineering*, volume 14, pages 248–257 (1970); U.S. Pat. Nos. 4,434,226, 4,414,310, 4,433,048 and 4,439,520; and British Patent 2,112,157. The use of tabular grains has advantages of raising the covering power and the efficiency of color sensitization by sensitizing dyes, and so on. These advantages are described in detail in U.S. Pat. No. 4,434,226 cited above. In the case of averaging at least 80% of the total projected area of tabular grains, an appropriate aspect ratio is from 1 to less than 100, preferably from 2 to less than 20, and particularly preferably from 3 to less than 10. As for the shape of tabular grains, a triangle, a hexagon and a sphere are suitable examples thereof. In particular, a regular hexagon having six sides nearly equal in length as described in U.S. Pat. No. 4,797,354 is preferred.

As for the size of tabular grains, the circle-equivalent diameter is used in many cases. Tabular grains having an average circle-equivalent diameter of no greater than 0.6 micron, as described in U.S. Pat. No. 4,748,106, are appropriate for enhancement of image quality. Also, emulsion grains having a narrow size distribution, as described in U.S. Pat. No. 4,775,617, are used to advantage. As for the shape of tabular grains, the grain thickness of no greater than 0.5 micron, preferably no greater than 0.3 micron, is desirable from the viewpoint of heightening the sharpness. Also, emulsion grains having high uniformity in the thickness, specifically a variation coefficient of 30% or below with respect to the grain thickness, are desirable. Further, the grains described in JP-A-63-163451 which have a specified grain thickness and a specified distance between twinning planes are favorable ones for the present invention.

Furthermore, it is desirable that grains containing no dislocation line, those containing several dislocation lines or those containing many dislocation lines be used properly depending on the intended purpose. The type of dislocation may be a dislocation introduced linearly in a particular direction of the crystallographic orientation of the grains, or a screw dislocation. Additionally, such a dislocation may be introduced throughout the grain, or the introduction thereof into the grain may be limited to a particular part alone, e.g., a fringe part of the grain. The existence of dislocation lines in grains is desirable in not only the case of tabular grains but also other cases, including the case of grains having a regular crystal form and the case of grains having an irregular crystal form, e.g, a potato-like shape.

The silver halide emulsions used in the present invention may be subjected to a treatment for making the emulsion grains round, as disclosed in EP-B1-0096727 and EP-B1-0064412, or a surface-modifying treatment, as disclosed in West German Patent 2,306,447 C2 and JP-A-60-221320.

Although the grain surface is generally smooth, it is sometimes desirable that the grain surface be roughened intentionally, as described in JP-A-58-106532, JP-A-60-221320 and U.S. Pat. No. 4,643,966.

The size of emulsion grains used in the present invention can be evaluated by the circle-equivalent diameters calculated from projected areas of the grains measured with an electron microscope, the sphere-equivalent diameters calculated from projected areas and thicknesses of the grains measured with an electron microscope, the sphere-equivalent diameters calculated from volumes of the grains determined by Coulter counter method, or so on. The emulsion grains used in the present invention can be chosen from a wide variety of grains, from super fine grains measuring 0.01 micron or below in sphere-equivalent diameter to coarse grains measuring 10 microns or above in sphere-equivalent diameter. For the light-sensitive silver halide grains, however, it is desirable to have their size in the range of 0.1 to 3 microns.

Whether to choose the emulsions used in the present invention from the so-called polydisperse emulsions having a wide grain size distribution or the so-called monodisperse emulsions having a narrow grain size distribution depends on the intended purpose. As for the measure of a grain size distribution, a variation coefficient regarding the distribution of circle-equivalent diameters or sphere-equivalent diameters among grains is sometimes adopted. In choosing a monodisperse emulsion, it is desirable that the variation coefficient thereof be not greater than 25%, preferably not greater than 20%, and particularly preferably not greater than 15%.

For the purpose of achieving the intended gradation, it is possible to coat a blend of two or more monodisperse emulsions having substantially the same color sensitivity but differing in average grain size in a single layer, or to coat those monodisperse emulsions separately in multiple layers.

Also, two or more of polydisperse emulsions or a combination of monodisperse emulsion(s) with polydisperse emulsion(s) may be coated as a mixture in a single layer, or separately in multiple layers.

The photographic emulsions used in the present invention can be prepared using various methods as described, e.g., in P. Glafkides, *Chemie et Physique Photographique*, Paul Montel (1967); G. F. Duffin, *Photographic Emulsion Chemistry*, The Focal Press (1966); V. L. Zelikman et al, The Focal Press (1964); and so on. Also, a method in which silver halide grains are produced in the presence of excess silver ion (the so-called reverse mixing method) can be employed. On the other hand, the so-called controlled double jet method, in which the pAg of the liquid phase in which silver halide grains are to be precipitated is maintained constant, may be employed, too. According to this method, a silver halide emulsion having a regular crystal form and an almost uniform distribution of grain sizes can be obtained.

The method of adding silver halide grains previously formed as precipitates to a reaction vessel for emulsion-making, as described in U.S. Pat. Nos. 4,334,012, 4,301,241 and 4,150,994, can be used to advantage in some cases. Those grains can be used as seed crystals, and it is also effective to feed them as the silver halide for grain growth. Further, the addition of fine grains having various halide compositions is sometimes effective for modifying the grain surface.

Methods of converting a great part or a very small part of the halide composition of each silver halide grain by halogen replacement are disclosed, e.g., in U.S. Pat. Nos. 3,477,852 and 4,142,900, European Patents 273,429 and 273,430, and West German Patent Application (OLS) 3,819,241. Conversion into more slightly soluble silver salts can be effected by the addition of a soluble halide solution or soluble silver halide grains.

In addition to the method of making grains grow by adding soluble silver salts and soluble halides as their respective concentrations and their respective flow rates are kept constant, the methods of forming grains while changing the concentrations or the flow rates of solutions added, as described in British Patent 1,469,480 and U.S. Pat. Nos. 3,650,757 and 4,242,445, can also be used to advantage. By increasing the concentration or the flow rate, the amount of silver halide to be supplied can be changed as a linear, quadratic or more complex function of the addition time.

The mixing instrument used for reacting soluble silver salts with soluble halides can be chosen from those described in U.S. Pat. Nos. 2,996,287, 3,342,605, 3,415,650 and 3,785,777, and West German Patent Applications (OLS) 2,556,885 and 2,555,364.

When the acceleration of the ripening of grains is aimed at, the use of a silver halide solvent is effective. For instance, it is known to allow excess halogen ions to be present in the reaction vessel with the intention of accelerating the ripening of grains. Also, other ripening agents can be used. Those ripening agents in a total amount can be mixed with a dispersing medium in the reaction vessel prior to the addition of silver salts and halides, or may be introduced into the reaction vessel simultaneously with the addition of halide(s), silver salt(s) or a deflocculant.

As examples of a silver halide solvent, mention may be made of ammonia, thiocyanates (e.g., potassium thiocyanate, ammonium thiocyanate), organic thioether compounds (e.g., the compounds described in U.S. Pat. Nos. 3,574,628, 3,021,215, 3,057,724, 3,038,805, 4,276,374, 4,294,439, 3,704,130 and 4,782,013, and JP-A-57-104926), thione compounds (e.g., the tetrasubstituted thioureas as described in JP-A-53-82408, JP-A-55-77737 and U.S. Pat. No. 4,221,863, and the compounds described in JP-A-53-144319), the mercapto compounds capable of accelerating the growth of silver halide grains, as described in JP-A-57-202531, and amine compounds (e.g., those described in JP-A-54-10071).

As for the protective colloid used at the time of emulsion-making and the binder for other hydrophilic colloid layers, gelatin is used to advantage. Of course, hydrophilic colloids other than gelatin can also be used.

Examples of such a hydrophilic colloid include proteins, such as gelatin derivatives, graftcopolymers of gelatin and other high polymers, albumin and casein; sugar derivatives, such as cellulose derivatives, e.g., hydroxyethyl cellulose, carboxymethyl cellulose and cellulose sulfate, sodium alginate and starch derivatives; and various synthetic hydrophilic high molecular substances, such as homo- and co-polymers including polyvinyl alcohol, polyvinyl alcohol partial acetal, poly-N-vinyl pyrrolidone, polyacrylic acid, polymethacrylic acid, polyacrylamide, polyvinylimidazole, polyvinylpyrazole and the like.

As for the gelatin, not only lime-processed gelatin but also acid-processed gelatin and the enzyme-processed gelatins as described in *Bull. Soc. Sci. Photo. Japan*, No. 16, p. 30 (1966) may be used. In addition, hydrolysis products of gelatin and enzymatic degradation products of gelatin can also be used. The low molecular weight gelatin described in JP-A-01-158426 is favorable for preparation of tabular grains.

Preferably, the silver halide emulsions used in the present invention is washed with water for desalting, and dispersed into a newly prepared protective colloid. The washing temperature can be chosen depending on the intended purpose, but it is desirable to choose the temperature from the range of 5° C. to 50° C. Also, the pH at the time of washing can be chosen depending-on the intended purpose, but it is desirable to choose the pH from the range between 2 and 10, preferably between 3 and 8. Further, the pAg at the time of washing can be chosen depending on the intended purpose, too. It is desirable for the pAg to be chosen from the range between 5 and 10. As for the method of washing, a noodle washing method, a dialysis method using a semi-permeable membrane, a centrifugal separation method, a coagulated precipitation method and an ion exchange method are suitable examples thereof. In the coagulated precipitation method, the way of using a sulfate, an organic solvent, a water-soluble polymer or a gelatin derivative can be adopted.

During the process of preparing a silver halide emulsion, e.g., at the stage of grain formation, desalting or chemical sensitization, or before coating a silver halide emulsion, salts of metal ions can be introduced into the emulsion with various intentions. For the purpose of doping silver halide grains with metal ions, it is desirable for the metal salts to be added at the stage of grain formation. For the purpose of modifying the grain surfaces or chemical sensitization, on the other hand, it is desirable for them to be added after the grain formation or before the conclusion of chemical sensitization. As for the doping, silver halide grains may be doped with metal ions throughout, or a localized doping method may be chosen. For instance, silver halide grains may be doped only in the core part, the shell part, the epitaxial part or the-basis part. As examples of metal for doping silver halide grains, mention may be made of Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi.

These metals can be added to a grain forming system in the form of salt as far as the salts thereof are soluble in the system. Suitable examples of such salts include ammonium salts, acetates, nitrates, sulfates, phosphates, hydroxides, complex salts having the coordination number of six, and complex salts having the coordination number of four. Specifically, such salts include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, $K_4Ru(CN)_6$, and so on. As for the ligands of coordination compounds, halogen, $H_2O$, cyano, cyanato, thiocyanato, nitrosil, thionitrosil, oxo and carbonyl are appropriate examples thereof. Those metal salts may be used alone, or as a combination of two or more thereof.

In some cases, the method of adding a chalcogen compound during the preparation of a silver halide emulsion, as described in U.S. Pat. No. 3,772,931, is useful. Besides S, Se and Te, a cyanate, a thiocyanate, selenocyanic acid, a carbonate, a phosphate or/and an acetate may be present therein.

The silver halide grains used in the present invention can be subjected to at least one kind of chemical sensitization selected from among sulfur sensitization, selenium sensitization, tellurium sensitization (these three kinds of sensitization are collectively called "chalcogen sensitization"), precious metal sensitization and reduction sensitization at an arbitrary stage during the process of preparing a silver halide emulsion. Preferably, two or more kinds of chemical sensitization are used in combination. Various types of emulsions can be obtained by changing variously the stage at which emulsion grains undergo chemical sensitization. More specifically, chemical sensitization specks may be buried deep inside the grains, or buried in a shallow zone below the grain surface, or formed on the grain surface. The emulsions used in the present invention can choose the location of chemical sensitization specks depending on their intended purpose.

The chemical sensitization performed advantageously in the present invention is chalcogen sensitization, precious metal sensitization, or the combination thereof. Such sensitization can be effected by the use of an active gelatin compound, as described in T. H. James, *The Theory of the Photographic Process*, 4th ed., pp. 67–76, Macmillan (1977); or by using a sulfur sensitizer, a selenium sensitizer, a tellurium sensitizer, a gold sensitizer, a platinum sensitizer, a palladium sensitizer, an iridium sensitizer or a combination of two or more thereof under a condition that pAg is from 5 to 10, pH is from 5 to 8 and a temperature is from 30° C. to 80° C., as described in *Research Disclosure*, Item 12008 (April, 1975), Item 13452(June 1975) and Item 307105 (November 1989), U.S. Pat. Nos. 2,642,361, 3,297,446, 3,772,031, 3,857,711, 3,901,714, 4,266,018 and 3,904,415, and British Patent 1,315,755.

For sulfur sensitization, unstable sulfur compounds are used. Specific examples of such a compound include thiosulfates (such as hypo), thioureas (such as diphenylthiourea, triethylthiourea and allylthiourea), rhodanines, mercapto compounds, thioamides, thiohydantoins, 4-oxo-oxazolidine-2-thiones, di- or polysulfide, polythionic acid salts, elemental sulfur, and known sulfur-containing compounds described in U.S. Pat. Nos. 3,857,711, 4,266,018 and 4,054,457.

The amount of a sulfur sensitizer applicable to silver halide grains is appropriately from $1\times10^{-7}$ to $1\times10^{-3}$ mole per mole of silver halide, and more appropriately from $5\times10^{-7}$ to $1\times10^{-4}$ mole per mole of silver halide.

For the selenium sensitization, known unstable selenium compounds, e.g., the selenium compounds described in U.S. Pat. Nos. 3,297,446 and 3,297,447, can be used. Specific examples of such a selenium compound include colloidal selenium metal, selenoureas (such as N,N-dimethylselenourea and tetramethylselenourea), selenoketones (such as selenoacetone), selenoamides (such as selenoacetamide), selenocarboxylic acids and esters thereof, isoselenocyanates, selenides (such as diethyl selenide and triphenylphosphine selenide), and selenophosphates (such as tri-p-tolylselenophosphate). In some cases, it is more effective to perform selenium sensitization in combination with sulfur sensitization, precious metal sensitization, or both thereof.

The amount of a selenium sensitizer used, though it depends on the type of selenium compound used, the type of silver halide grains to be sensitized, the chemical ripening condition adopted, and so on, is generally from about $10^{-8}$ to about $10^{-4}$ mole per mole of silver halide, and preferably from about $10^{-7}$ to about $10^{-5}$ mole per mole of silver halide.

As for the tellurium sensitizer used in the present invention, the compounds described in Canadian Patent 800,958, British Patents 1,295,462 and 1,396,696, and JP-A-4-204640 and JP-A-4-3330343 are examples thereof.

For precious metal sensitization, salts of precious metals, such as gold, platinum, palladium and iridium, can be used. In particular, gold sensitization, palladium sensitization and the combination thereof are employed to advantage. In the case of gold sensitization can be used known gold compounds, such as chloroauric acid, potassium chloroaurate, potassium aurithiocyanate, gold sulfide and gold selenide. Palladium compounds which can be used for palladium sensitization include salts of divalent palladium and salts of tetravalent palladium compounds. Suitable palladium compounds are represented by $R_2PdX_6$ or $R_2PdX_4$. In these formulae, R represents a hydrogen atom, an alkali metal atom or an ammonium group, and X represents a halogen atom, such as chlorine, bromine or iodine. Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2Pdbr_4$ are favorable palladium compounds.

The gold compounds and the palladium compounds as recited above are preferably used in combination with thiocyanates or selenocyanates.

The emulsions used in the present invention are preferably subjected to gold sensitization. The amount of a gold sensitizer used is preferably from $1\times10^{-7}$ to $1\times10^{-3}$ mole, more preferably from $5\times10^{-7}$ to $5\times10^{-4}$ mole, per mole of silver halide. The suitable range of a palladium compound is from $5\times10^{-7}$ to $1\times10^{-3}$ mole, and that of a thiocyanate or selenocyanate is from $1\times10^{-6}$ to $5\times10^{-2}$ mole.

It is desirable for the silver halide emulsions to be subjected to reduction sensitization (i) during the grain formation, (ii) after the completion of the grain formation and before and during the chemical sensitization, or (iii) after the chemical sensitization.

The reduction sensitization can be effected by the method of adding a reduction sensitizer, the method of making grains grow or ripen under the low pAg atmosphere of pAg 1–7, namely the so-called silver ripening, or the method of making grains grow or ripen under the high pH atmosphere of pH 8–11, namely the so-called high pH ripening. These methods may be employed in combination of two or more thereof.

The reduction sensitizer used in the present invention can be chosen from known compounds, such as stannous salts, ascorbic acid and derivatives thereof, amines and polyamines, hydrazine and derivatives thereof, formamidinesulfinic acid, silane compounds or borane compounds. These compounds may be used in combination of two or more thereof. Preferably, stannous chloride, aminoiminomethanesulfinic acid (commonly called thiourea dioxide), dimethylamine borane, ascorbic acid and derivatives thereof are used as reduction sensitizer.

The chemical sensitization can be performed in the presence of the so-called chemical sensitization aids. As for the chemical sensitization aids, the compounds known to enable inhibition of fog and increase of sensitivity during chemical sensitization, such as azaindenes, azapyridazine and azapyrimidine, are useful, and specific examples thereof are described in U.S. Pat. Nos. 2,131,038, 3,411,914 and 3,554,757, JP-A-58-126526, and the above-cited book, G. F. Duffin, *Photographic Emulsion Chemistry*, pages 138–143.

During the process of preparing emulsions, it is desirable that the oxidizing agent for silver be used. The term "oxidizing agent for silver" refers to the compound having a function such that, when it acts on metal silver, it can convert the metal silver into silver ion. In particular, compounds capable of converting very fine silver grains, which are formed as a by-product during the process of forming and chemically sensitizing silver halide grains, into silver ions are effective. The silver ions thus produced may form a silver salt slightly soluble in water, such as silver halide, silver sulfide or silver selenide, or a silver salt highly soluble in water, such as silver nitrate. The oxidizing agent for silver may be an inorganic substance, or an organic substance. Specific examples of an inorganic oxidizing agent include ozone, hydrogen peroxide and adducts thereof (e.g., $NaBO_2 \cdot H_2O_2 \cdot 3H_2O$, $2NaCO_3 \cdot 3H_2O_2$, $Na_4P_2O_7 \cdot 2H_2O_2$, $2Na_2SO_4 \cdot H_2O_2 \cdot 2H_2O$), peroxyacid salts (e.g., $K_2S_2O_8$, $K_2C_2O_6$, $K_2P_2O_8$), peroxy complex compounds (e.g., $K_2[Ti(O_2)C_2O_4] \cdot 3H_2O$, $4K_2SO_4 \cdot Ti(O_2)OH \cdot SO_4 \cdot 2H_2O$, $Na_3[VO(O_2)((C_2H_4)_2 \cdot 6H_2O)$, oxyacid salts including permanganates (e.g., $KMnO_4$) and chromates (e.g., $K_2Cr_2O_7$), halogen elements such as iodine and bromine, perhalogenates (e.g., potassium periodate), polyvalent metal salts (e.g., potassium hexacyanoferrate(III)) and thiosulfonates.

Specific examples of an organic oxidizing agent include quinones such as p-quinone, organic peroxides such as peracetic acid and perbenzoic acid, and active halogen-releasing compounds (e.g., N-bromosuccinimide, chloramine T, chloramine B).

It is favorable for the present invention to perform the foregoing reduction sensitization in combination with the oxidizing agent for silver as recited above.

The photographic emulsions used in the present invention can contain a wide variety of compounds for the purposes of preventing fog or stabilizing photographic functions during the production, storage or photographic processing of the resultant photosensitive material. Specific examples of compounds added for such purposes include azoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (e.g., 1-phenyl-5-mercaptotetrazole, 1-(5-methylureidophenyl)-5-mercaptotetrazole); mercaptopyrimidines; mercaptotriazines; thioketo compounds, such as oxazolinethione; azaindenes, such as triazaindenes, tetraazaindenes (especially 4-hydroxy-6-methyl(1,3,3a,7)tetraazaindene) and pentaazaindenes; and other many compounds known as antifoggants or stabilizers, e.g., those described in U.S. Pat. Nos. 3,954,474 and 3,982,947, and JP-B-52-28660. In addition, the compounds described in JP-A-63-212932 are also used to advantage. Those antifoggants and stabilizers can be added at various stages depending on the intended purpose, e.g., before, during or after the grain formation, at the stage of washing, at the time of dispersion after washing, before, during or after the chemical sensitization, before coating, or/and so on.

Preferably, the photographic emulsions used in the present invention are spectrally sensitized using methine dyes or other dyes. Suitable spectral sensitizing dyes which can be employed include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes. Any nuclei usually present in cyanine dyes can be the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. As examples of such fused nuclei, mention may be made of indolenine, benzindolenine, indole, benzoxazole, naphtoxazole, benzothiazole, naphthothiazole, benzoselenazole, benzimidazole, quinoline and like nuclei. These nuclei each can have a substituent on a carbon atom.

The merocyanine and complex merocyanine dyes can contain 5- or 6-membered heterocyclic nuclei, e.g., pyrazoline-5-one, thiohydantoin, 2-thioxazolidine-2,4-dione, thiazolidine-2,4-dione, rhodanine, thiobarbituric acid and like nuclei, as ketomethylene structure-containing nuclei.

Those sensitizing dyes may be employed individually or in combination. In particular, combinations of sensitizing dyes are often employed for the purpose of supersensitization. Typical examples of supersensitizing combinations are described U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618, JP-A-52-109925, and so on.

Materials which can exhibit a supersensitizing effect in combination with a certain sensitizing dye although they themselves do not spectrally sensitize silver halide emulsions or do not absorb light in the visible region may be incorporated into the silver halide emulsions.

The sensitizing dyes may be added to photographic emulsions at any of stages of emulsion-making as far as the addition at those stages has so far been known to be effective. In general, the addition of sensitizing dyes are carried out during the period from the completion of chemical sensitization till the start of coating. However, it is also possible to add sensitizing dyes simultaneously with the addition of chemical sensitizers to carry out spectral sensitization and chemical sensitization at the same time, as described in U.S. Pat. Nos. 3,628,969 and 4,225,666, or to add sensitizing dyes prior to chemical sensitization as described in JP-A-58-113928, or to start spectral sensitization by adding sensitizing dyes before the completion of precipitation of silver halide grains. Further, it is possible to divide the amount of sensitizing dyes to be added into two portions and add them at separate stages, specifically one portion of sensitizing dyes prior to chemical sensitization and the other portion thereof posterior to chemical sensitization, as taught by in U.S. Pat. Nos. 4,225,666; or the sensitizing dyes may be added at any of the stages for formation of silver halide grains, as disclosed in U.S. Pat. No. 4,183,756 and so on.

The amount of sensitizing dyes added can be within the range of $4\times10^{-6}$ to $8\times10^{-3}$ mole per mole of silver halide. When silver halide grains have their grain size in the preferred range of 0.2 to 1.2 $\mu$m, however, it is effective to use sensitizing dyes in an amount of from about $5\times10^{-5}$ to about $2\times10^{-3}$ mole per mole of silver halide.

In addition to the above-mentioned various additives, the photosensitive materials relating to the present invention can contain various additives depending on the intended purposes.

Details of such additives are described in *Research Disclosure*, Item 17643 (December, 1978), ibid., Item 18716 (November 1979), and ibid., Item 307105 (November 1989). The following is a list of those additives and the locations of their descriptions in the above-cited references.

| Additive | RD 17643 | RD 18716 | RD 307105 |
|---|---|---|---|
| 1. Chemical Sensitizer | p. 23 | p. 648, right column | p. 996 |
| 2. Sensitivity Rising Agent | | p. 648, right column | |
| 3. Spectral Sensitizer, and Supersensitizing Agent | pp. 23–24 | p. 648, right column, to p. 649, right column | p. 996 (right) to p. 998 (right) |
| 4. Brightening Agent | p. 24 | — | p. 998 (right) |
| 5. Antifoggant and Stabilizer | pp. 24–25 | p. 649, right column | p. 998 (right) to p. 1000 (right) |
| 6. Light Absorbent, Filter Dye, and UV Absorbent | pp. 25–26 | p. 649, right column, to p. 650, left column | p. 1003 (right to left) |
| 7. Stain inhibitor | p. 25 (right column) | p. 650, right to left column | |
| 8. Dye Image Stabilizer | p. 25 | | |
| 9. Hardener | p. 26 | p. 651, left column | p. 1004 (right) to p. 1005 (left) |
| 10. Binder | p. 26 | p. 651, left column | p. 1003 (right) to p. 1004 (right) |
| 11. Plasticizer, and Lubricant | p. 27 | p. 650, right column | p. 1006 (left to right) |
| 12. Coating Aid, and Surfactant | pp. 26–27 | p. 650, right column | p. 1005 (left) to p. 1006 (left) |
| 13. Antistatic Agent | p. 27 | p. 650, right column | p. 1006 (right) to p. 1007 (left) |

The photosensitive materials used in the present invention preferably have their total coverage of silver in the range of 0.003 to 12 g/m$^2$. In the case of photosensitive materials of transmission type, such as a color negative film, the total coverage of silver is preferably from 1 to 12 g/m$^2$, more preferably from 3 to 10 g/m$^2$. In the case of photosensitive materials of reflection type, such as a color paper, the appropriate total coverage of silver is from 0.003 to 1 g/m$^2$ from the viewpoints of rapid processing and low rate of replenishment, and each of the light-sensitive layers therein preferably has a silver coverage of from 0.001 to 0.4 g/m$^2$. In a particular case wherein the photosensitive material used in the present invention undergoes an intensification processing, the appropriate total coverage of silver is from 0.003 to 0.3 g/m$^2$, preferably from 0.01 to 0.1 g/m$^2$, particularly preferably from 0.015 to 0.05 g/m$^2$. It is desirable for each light-sensitive layer in such a case to have a silver coverage of from 0.001 to 0.1 g/m$^2$, preferably from 0.003 to 0.03 g/m$^2$.

When the coverage of silver per light-sensitive layer is less than 0.001 g/m$^2$, the dissolution of silver salts proceeds to fail in providing sufficient color density; while, when it is beyond 0.1 g/m$^2$ in the case wherein the photosensitive material undergoes intensification processing, the Dmin is increased and bubbles are generated to tend to provide images unfit for appreciation.

The photosensitive materials used in the present invention have their total coverage of gelatin in the range of 1.0 to 30 g/m$^2$, preferably 2.0 to 20 g/m$^2$. In the swelling of the present photosensitive material in an alkaline solution having pH 12, it is desirable that the photosensitive material require 15 seconds or below, preferably 10 seconds or below, for reaching half its saturation swelling thickness (corresponding to 90% of its maximum swelling thickness). As for the swelling degree defined as [(maximum swelling thickness−thickness) /thickness]×100, the photosensitive materials used in the present invention preferably have a swelling degree of from 50 to 300%, particularly from 100 to 200%.

The scanning exposure employed in the present invention is illustrated below in detail.

The present scanning exposure is required to have an inter-raster overlap width adjusted to 5–95%, preferably 15–85%, most preferably 20–80%, of the effective beam diameter. When the inter-raster overlap width is in the above-described range, favorable characteristics, including high color density and high resolution, can be achieved. The effective beam diameter mentioned above can be determined by the method described in JP-A-05-19423, page 4, left lower part. More specifically, a straight line segment on a photosensitive material used is exposed to a laser beam emitted under the output corresponding to 50% of the laser beam intensity enough to provide the highest color density in the image to be formed, and subjected to color development. Thus, a line-form color image is obtained. The density profile of the thus obtained image in the direction perpendicular to the foregoing straight line segment is measured with a microdensitometer. The line width at the density $D_{1/5}$, that is, one-fifth-the maximum density $D_{max}$, in the profile obtained is taken as effective beam diameter.

The effective beam diameter in scanning exposure can be determined by the pixel density of an intended output image. The pixel density preferred as a pictorial image is generally in the range of 50 dpi to 2,000 dpi. This range corresponds to the range of about 110 $\mu$m to about 500 $\mu$m when it is converted to the basis of pixel size. Although it is impossible in principle to write a pattern more precise than an effective beam diameter, the adoption of an effective beam diameter greater than the pixel size is also permissible. The suitable effective beam diameter for the present invention is from 5 $\mu$m to 200 $\mu$m, preferably from 10 $\mu$m to 100 $\mu$m. Such a range is favorable for the inter-raster relationship.

The term "scanning pitch" as used in the present invention is defined as the interval between rasters in the scanning on the surface of a photosensitive material with a beam for exposure. In the present invention, the effective beam diameter is required to be greater than the image scanning pitch. More specifically, the width of an overlap between rasters (named the inter-raster overlap width hereinbefore) defined by the following equation is required to meet the range specified by the present invention;

$$L=d-p$$

wherein L is an overlap width, d is an effective beam diameter and p is a scanning pitch.

Accordingly, the scanning pitch in the present invention is preferably from 0.25 μm to 190 μm, particularly preferably from 2 μm to 80 μm. This range is advantageous to the inter-raster relationship.

Although the scanning of a beam of light in the present invention can be performed by the so-called drum scanning method as well, wherein the main scanning is carried out by rotating at a high speed a cylindrical drum around which a photosensitive material is wound and the sub-scanning is carried out by gradually moving a light source beam in the axis direction of the cylindrical drum, it is more desirable for the present invention to adopt the scanning method which comprises performing the main scanning by making a light source beam be incident on faces of a high-speed revolving polyhedral mirror (polygon mirror) and the sub-scanning by moving a photosensitive material in the direction perpendicular to that of the main scanning. The polygon mirror used in the present invention has no particular limitation on the number of faces. However, it is desirable that the number of faces be from 2 to 36, especially from 6 to 14. Further, it is desirable that the polygon mirror be steadily revolving at 4,000–36,000 r.p.m.

As for the means to generate a beam of light, known various light sources can be used in the present invention. However, the present invention can fully achieve its effects when light sources having high illumination intensity, such as semiconductor laser, gas laser and light emission diode, are used as light source. In order to render the exposure system more compact and cheaper, it is desired to use a laser diode or a secondary harmonic wave generator (SHG) wherein semiconductor laser or solid state laser using semiconductor laser as an source of exciting light is combined with non-linear optical crystals. For the purpose of designing a compact and cheap apparatus which has a long span of life and high stability, the use of semiconductor laser is favorable, and it is preferable that at least one of exposure light sources be semiconductor laser.

The wavelengths of beams used in the present invention can be selected respectively depending on the absorption maxima of a photosensitive material used.

Further, it is advantageous to the present scanning exposure that the exposure time per pixel be not longer than $10^{-4}$ second, preferably not longer than $10^{-6}$ second.

In the case of using the above-mentioned light sources for scanning exposure, on the other hand, it is also possible to adjust the spectral sensitivity maxima of a photosensitive material to be used in the present invention depending on the wavelengths of the light sources used. Since an SHG light source obtained by combining solid state laser using semiconductor laser as a source of exciting light or semiconductor laser with non-linear optical crystals can reduce the oscillation wavelength of laser to half, it can generate a beam of blue color and a beam of green color. Accordingly, the use of such a light source permits the spectral sensitivity maxima of a photosensitive material to be present in the conventional three regions, namely blue, green and red regions. When laser diodes are used as light sources for the purpose of making a cheap, highly stable and compact exposure apparatus, it is desired that at least two layers have their individual spectral sensitivity maxima in the wavelength region longer than 670 nm. This is because the laser beams obtained by III–V group compound semiconductors, which are stable and now available at a low price, have their individual oscillation wavelengths in the red or infrared region. On the laboratory level, however, the oscillation of laser beams in the green and blue regions has been ascertained by the use of II–VI group compound semiconductors. Thus, it can be reasonably expected that such semiconductor laser could be available at a low price and work steadily if technical improvement in production of semiconductor laser would be made. If the production of such semiconductor laser is realized, the need of designing at least two layers so as to have their individual spectral sensitivity maxima in the wavelength region longer than 670 nm will be lessened.

Processing materials and processing methods usable in the present invention are illustrated below in detail. The photosensitive materials relating to the present invention are subjected to development (silver development/cross-oxidation of the incorporated reducing agent), desilvering, and washing or stabilization operations. After undergoing a washing or stabilization operation, the photosensitive materials are optionally subjected to a treatment for reinforcing color formation, such as a treatment with an alkali.

In developing a photosensitive material relating to the present invention, a compound which functions as a developing agent for silver halide and/or has a cross-oxidation function such that the oxidation product thereof by silver development oxidizes a reducing agent incorporated for color formation in the photosensitive material can be contained in a developer used. Suitable examples of such a compound include pyrazolidones, dihydroxybenzenes, reductones and aminophenols. In particular, pyrazolidones are preferred over the others.

Specific examples of a pyrazolidone which can be used to advantage include 1-phenyl-3-pyrazolidones, such as 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4,-dihydroxymethyl-3-pyrazolidone, 1-phenyl-5-methyl-3-pyrazolidone, 1-phenyl-5-phenyl-3-pyrazolidone, 1-p-tolyl-4-methyl-4-hydroxymethyl-3-pyrazolidone, 1-p-chlorophenyl-4-methyl-4-hydroxymethyl-3-pyrazolidone, 1-phenyl-2-hydroxymethyl-4,4-dimethyl-3-pyrazolidone, 1-phenyl-2-acetyl-3-pyrazolidone and 1-phenyl-2-hydroxymethyl-5-phenyl-3-pyrazolidone.

Specific examples of a dihydroxybenzene include hydroquinone, chlorohydroquinone, bromohydroquinone, isopropylhydroquinone, methylhydroquinone, 2,3-dichlorohydroquinone, 2,5-dichlorohydroquinone, 2,5-dimethylhydroquinone and potassium hydroquinonemonosulfonate.

As for the reductones, ascorbic acid and derivatives thereof are suitable examples thereof. Specifically, the compounds described in JP-A-06-148822, pages 3–10, are used to advantage. In particular, sodium L-ascorbate and sodium erysorbate are preferred over the others.

As for the p-aminophenols, N-methyl-p-aminophenol, N-(β-hydroxyethyl)-p-aminophenol, N-(4-hydroxyphenyl) glycine and 2-methyl-p-aminophenol are examples thereof.

Those compounds are generally used alone, but a combination of two or more thereof is also favorable for enhancement of development and cross-oxidation activities.

The amount of such compounds used in a developer is generally from $2.5\times10^{-4}$ mole/l to 0.2 mole/l, desirably from 0.0025 mole/l to 0.1 mole/l, and more desirably from 0.005 mole/l to 0.05 mole/l.

As examples of a preservative used in a developer, mention may be made of sodium sulfite, potassium sulfite, lithium sulfite, ammonium sulfite, sodium bisulfite, potassium metabisulfite, formaldehyde sodium bisulfite and hydroxylamine sulfate. The amount of a preservative used is generally 0.1 mole/l or below, preferably from 0.001 to 0.02 mole/l. In the case of using emulsions having high chloride contents in a photosensitive material, the foregoing preservative is generally added to the photosensitive material in an amount of 0.001 mole/l or below. Preferably, no preservative is added thereto.

Instead of containing hydroxylamine sulfate or sulfite ion as recited above, it is desirable for the photosensitive materials used in the present invention to contain an organic preservative, such as diethylhydroxylamine and the dialkylhydroxylamines described in JP-A-04-97355.

The developer can contain halogen ion(s), such as chlorine ion, bromine ion or/and iodine ion.

In order to make halogen ion(s) be present in the developer, halide(s) may be added directly to the developer, or eluted from photosensitive materials with the developer during development-processing.

The developer used in the present invention is preferably adjusted to pH 8 to 13, particularly pH 9 to 12.

In order to retain the pH of the developer in the above-described rage, it is desired that various pH buffers be used. Suitable examples of pH buffers which can be used include carbonates, phosphates, tetraborates and hydroxybenzoates.

It is desirable that the foregoing buffers be added to the developer in a concentration of at least 0.05 mole/l, particularly from 0.1 to 0.4 mole/l.

In addition, various kinds of chelating agents can be used in the developer as a suspending agent for calcium and magnesium ions, or for the purpose of heightening the stability of the developer.

Such chelating agents are added in an amount sufficient to block metal ions in the developer, for examples, from about 0.1 to about 10 g per liter of the developer.

To the developer used in the present invention, any antifoggant can be added, if needed. Specific examples of an antifoggant which can be used include alkali metal halides, such as sodium chloride, potassium bromide and potassium iodide, and nitrogen-containing heterocyclic compounds.

The appropriate amount of a nitrogen-containing heterocyclic compound added is from $1\times10^{-5}$ to $1\times10^{-2}$ mole/l, preferably from $2.5\times10^{-5}$ to $1\times10^{-3}$ mole/l.

Further, any development accelerator can be added to the developer, if needed.

It is desirable for the developer to contain a brightening agent. As a brightening agent, 4,4'-diamino-2,2'-disulfostilbene compounds are used to advantage.

The processing temperature of the developer applicable to the present invention ranges from 20 to 50° C., preferably from 30 to 45° C. The processing time thereof is within the range of 5 sec. to 2 min., preferably 10 sec. to 1 min. As for the replenisher, the use thereof in the smallest possible amount is desirable. More specifically, the replenishment rate appropriate to the present invention is from 15 to 600 ml, preferably from 25 to 200 ml, more preferably from 35 to 100 ml, per $m^2$ of the photosensitive material processed.

After the development, a desilvering process is carried out. The desilvering process may be constituted of a fixation step alone, or both bleach and fixation steps. In the latter case, the bleach step and the fixation step may be performed separately, or simultaneously (blix step). Further, if desired, it is possible to carry out the blix step by using two blix baths continuously, or to carry out the fixation step prior to the blix step, or to carry out the bleach step posterior to the blix step.

In some cases, however, it is desirable for the stabilization of silver salts and dye images after development to be effected by stabilization processing alone without undergoing any desilvering operation.

After development, on the other hand, image intensification can be carried out using the peroxides, the halogenous acids, the iodoso compounds or the cobalt(III) complex compounds described, e.g., in West German Patent Application (OLS) Nos. 1,813,920, 2,044,993 and 2,735,262, JP-A-48-9728, JP-A-49-84240, JP-A-49-102314, JP-A-51-53826, JP-A-52-13336 and JP-A-52-73731. For the purpose of reinforcing the image intensification, the foregoing oxidizing agent for image intensification can also be added to the developer, and thereby development and image intensification can be simultaneously effected with a monobath. In particular, hydrogen peroxide is preferably used as the oxidizing agent because of its high amplification factor. These image intensification methods are favorable processing methods from the viewpoint of environmental preservation, because they enable a great reduction in silver coverage of a photosensitive material to render bleach processing needless and prevent the discharge of silver (and silver salts) resulting from stabilization processing or so on.

As examples of a bleaching agent used in the bleaching or bleach-fix bath, mention may be made of compounds of polyvalent metals, such as Fe(III), Co(III), Cr(IV) and Cu(II), peroxy acids, quinones and nitro compounds. Of these compounds, complex salts of Fe(III) and aminopolycarboxylic acids, such as (ethylenediaminetetraacetato)iron (III) complex and (1,3-diaminopropanetetraacetato)iron(III) complex, hydrogen peroxide and persulfates are preferred over the others from the viewpoints of rapid processing and prevention of environmental pollution.

The bleaching or bleach-fix bath containing a Fe(III)-aminopolycarboxylic acid complex as mentioned above is adjusted to pH 3–8, preferably pH 5–7. The bleaching bath containing a persulfate or hydrogen peroxide is adjusted to pH 4–11, preferably pH 5–10.

In the bleaching bath, the bleach-fix bath and prebaths thereof, bleach accelerators can be used, if needed.

In addition, hitherto known additives such as a rehalogenating agent, a pH buffering combination, a metal corrosion inhibitor and so on can be added to the bleaching bath, the bleach-fix bath and the fixing bath. In particular, the addition of an organic acid having an acid dissociation constant (pKa) of from 2 to 7 is advantageous to those baths for the purpose of preventing bleach stain.

The fixing agent used in the fixing or bleach-fix bath include thiosulfates, thiocyanates, thioureas, a large quantity of iodides, the nitrogen-containing heterocyclic compounds having sulfide groups as described in JP-A-04-365037 (pp. 11–22), JP-A-05-66540 (pp. 1088–1092), meso ion compounds and thioether compounds.

As for the preservatives used in the fixing bath and the bleach-fix bath, sulfites, bisulfites, carbonyl-bisulfite adducts and the sulfinic acid compounds described in EP-A-0294769 are suitable examples thereof.

In the fixing bath and the bleach-fix bath, various kinds of brightening agents, defoaming agents, surfactants, polyvinyl pyrrolidone, methanol and so on can also be included.

The processing temperature in the desilvering process ranges from 20° C. to 50° C., preferably from 30° C. to 45° C. The processing time is from 5 sec. to 2 min., preferably from 10 sec. to 1 min. The replenishment rate, though it should be made as low as possible, is from 15 to 600 ml, preferably from 25 to 200 ml, more preferably from 35 to 100 ml, per $m^2$ of the photosensitive material processed. Also, it is desirable that the processing baths undergo substantially no replenishment, that is, only evaporation loss be supplemented with water.

After the desilvering process, the present photosensitive materials are, in general, subjected to washing processing.

When stabilization processing is carried out, the washing processing may be omitted. To the stabilization processing, all the known methods, such as those described in JP-A-57-8543, JP-A-58-14834 and JP-A-60-220345 and those described in JP-A-58-127926, JP-A-58-137837 and JP-A-58-140741, are applicable. Further, it is possible to adopt a process of the type which is constituted of a washing step and a stabilization step and uses a stabilizing bath containing a dye stabilizer and a surfactant as the final bath, as represented by the process for photograph-taking color photosensitive materials.

The washing bath and the stabilizing bath can include water softeners, such as sulfites, inorganic phosphoric acids, polyaminocarboxylic acids and organic aminophosphonic acids; metal salts, such as magnesium salts, aluminum salts and bismuth salts; surfactants; hardeners; pH buffers; brightening agents; and silver salt forming agents such as nitrogen-containing heterocyclic compounds.

As examples of a dye stabilizer used in the stabilizing solution, mention may be made of aldehydes, such as formaldehyde and glutaraldehyde, N-methylol compounds, hexamethylenetetramine, and aldehyde-sulfurous acid adduct.

The pH of the washing bath and the stabilizing bath ranges from 4 to 9, preferably from 5 to 8. The processing temperature is generally from 15° C. to 45° C., preferably from 25° C. to 40° C. The processing time is generally from 5 sec. to 2 min., preferably from 10 sec. to 40 sec.

The overflow arising from the replenishment of a washing and/or stabilizing solution can be re-used in the prior steps, such as the desilvering process.

The amount of washing water and/or the stabilizing solution used can be chosen from a wide range depending on various conditions. As for the replenishment rate, however, a suitable replenishment rate is within the range of 15 to 360 ml, especially 25 to 120 ml, per $m^2$ of the photosensitive material. In order to reduce the replenishment volume, it is desired that the processing be carried out using two or more tanks in accordance with the multistage counter current process.

For the purpose of saving water, the water obtained by treating the overflow and tank solutions with a reverse osmosis membrane can be utilized in the present invention. More specifically, it is desirable to apply the treatment with a reverse osmosis membrane to the water in the second tank or the tanks arranged thereafter in the multistage counter current process for washing and/or stabilization.

In the present invention, it is desirable that the agitation be performed as strongly as possible. In order to strengthen agitation, it is desirable to adopt the methods described in JP-A-62-183460 and JP-A-62-183461, wherein a jet flow of processing solution is made to collide with the emulsion surface of a photosensitive material; the method of enhancing the agitation effect with the rotating means described in JP-A-62-183461; the method of improving the agitation effect by moving a photosensitive material while bringing the emulsion surface thereof into contact with a wiper blade installed in a processing solution to make the processing solution turbulent over the emulsion surface; or the method of increasing the total circulated flow rate of processing solutions. These means of improving agitation are useful for all the processing solutions, including a developer, a bleaching bath, a fixer, a bleach-fix bath, a stabilizer and a washing bath. Those methods are also effective in accelerating the supply of effective components from a processing solution to a-photosensitive material and the diffusion of unnecessary components from a photosensitive material into a processing solution.

The image formation method of the present invention can achieve its excellent performance irrespective of open space rate of every processing bath (defined by the quotient of the air-contacted area ($cm^2$) divided by the volume ($cm^3$) of a processing solution). However, it is desirable for the open space rate to range from 0 to 0.1 $cm^{-1}$ from the viewpoint of stabilities of constituents in a processing bath. In a continuous processing operation, the appropriate open space rate is in the range of 0.001 to 0.05 $cm^{-1}$ from the practical point of view, and further favorable results can be obtained when the open space rate ranges from 0.002 to 0.03 $cm^{-1}$.

It is desirable for the automatic processor used in the present invention to be equipped with the photosensitive material conveying means described in JP-A-60-191257, JP-A-60-191258 and JP-A-60-191259. These conveying means enable a marked reduction in the quantity of a processing solution brought from a prebath into a bath arranged thereafter, and thereby the deterioration in processing capability can be prevented effectively. From this effect, advantages of shortening a processing time in each step and reducing a replenishment rate of each processing solution can be derived. In addition, a reduction in crossover time (time of staying in the air) is desired for shortening of the processing time. For instance, it is desirable to adopt the method of conveying a photosensitive material through a blade having a shielding effect of a processing solution (wherein the blade is provided to the processing bath) as illustrated in JP-A-04-86659, FIGS. 4, 5 and 6, and JP-A-05-66540, FIGS. 4 and 5.

In the case where each processing solution is concentrated by evaporation during continuous processing, it is desirable to add water for compensating losses due to concentration.

The expression "processing time in each step" as used in the present invention refers to the time required on each processing step from the start thereof till the start of the next processing step. The practical processing time in an automatic processor depends generally on the linear velocity and the volumes of processing baths. As a guide, the linear velocity ranging from 500 to 4,000 mm/min is applicable to the present invention. In the cases of using a small-sized processor, the linear velocity is preferably in the range of 500 to 2,500 mm/min.

The processing time for all the processing steps, from the developing step to the drying step, is desirably not longer than 360 seconds, preferably not longer than 120 seconds, and particularly preferably from 90 to 30 seconds. Additionally, the term "processing time" as used above is a period from the start in the dipping of a photosensitive material in a developer till the release of the photosensitive material from the drying section of a processor.

In the processing steps applied to the present invention, various additives are used, and further details thereof are described in *Research Disclosure*, Item 36544 (September 1994). The pages on which the descriptions of additives are found in the above reference are set forth below:

| Kind of Processing Agent | Page |
|---|---|
| Developing agent | 536 |
| Preservative for developing agent | 537, left column |
| Antifoggant | 537 |
| Chelating agent | 537, right column |
| Buffer | 537, right column |
| Surfactant | 538, left column, to 539, left column |
| Bleaching agent | 538 |
| Bleach accelerator | 538, right column, |

-continued

| Kind of Processing Agent | Page |
|---|---|
| | to 539, left column |
| Chelating agent for bleaching | 539, left column |
| Re-halogenating agent | 539, left column |
| Fixer | 539, right column |
| Preservative for fixer | 539, right column |
| Chelating agent for fixation | 540, left column |
| Surfactant for stabilization | 540, left column |
| Scum inhibitor for stabilization | 540, right column |
| Chelating agent for stabilization | 540, right column |
| Antibacterial and moldproofing agent | 540, right column |
| Dye stabilizer | 540, tight column |

The arts of saving water which are applicable to the present invention are described in detail in *Research Disclosure*, Item 36544 (September, 1994), from page 540, right column, to page 541, left column.

The present invention will now be described by way of the following examples. However, the invention should not be construes as being limited to these examples.

EXAMPLE 1

Preparation of Photosensitive Material Containing Therein Reducing Agent for Color Formation The surface of a paper support laminated with polyethylene on both sides was subjected to a corona discharge operation, provided with a gelatin undercoat containing sodium dodecylbenzenesulfonate, and further coated with various photographic constituent layers to prepare a multilayer color photographic paper having the layer structure described below (Sample No. 100). Coating compositions used were prepared in the following manner.

Preparation of Coating Solution for First Layer;

A coupler (C-76) in the amount of 17 g, 20 g of a reducing agent for color formation (I-16) and 80 g of a solvent (Solv-2) were dissolved in ethyl acetate, and then dispersed in an emulsified condition into a 16% aqueous gelatin solution containing a 10% solution of sodium dodecylbenzenesulfonate and citric acid to prepare emulsified Dispersion A.

On the other hand, two kinds of silver chlorobromide emulsions [both of which has a cubic crystal form; one of which had an average grain size of 0.88 $\mu$m and a variation coefficient of 0.08 with respect to the grain size distribution (large-sized Emulsion A1), and the other of which had an average grain size of 0.70 $\mu$m and a variation coefficient of 0.10 with respect to the grain size distribution (small-sized Emulsion A2); both of which contained 0.3 mole % of silver bromide, in which the bromide was localized in part of the surface of each grain having silver chloride as substrate] were prepared. These Emulsions A1 and A2 were mixed in a ratio of 3:7 by mole on a silver basis to obtain a silver chlorobromide Emulsion A. Prior to the mixing of Emulsions A1 and A2, blue-sensitive Sensitizing Dyes A, B and C illustrated below were added to the large-sized emulsion in the same amount of $1.4\times10^{-4}$ mole per mole of silver, and to the small-sized emulsion in the same amount of $1.7\times10^{-4}$ mole per mole of silver. Further, the Emulsion A was chemically sensitized to the optimum by the addition of a sulfur sensitizer and a gold sensitizer. Then, the resultant Emulsion A was mixed homogeneously with the foregoing emulsified Dispersion A, and thereto were added other ingredients set forth below so as to obtain the coating solution for the first layer having the following composition. As for the silver halide emulsions, the numerical values of their coverage are given below on a silver basis.

Coating solutions for the second to seventh layers were prepared respectively in the same manner as that for the first layer. However, the following emulsions were used in the third layer and the fifth layer respectively in place of the Emulsion A.

More specifically, the silver chlorobromide Emulsion B used for the third layer was obtained as follows: Two kinds of silver chlorobromide emulsions [both of which has a cubic crystal form; one of which had an average grain size of 0.55 $\mu$m and a variation coefficient of 0.10 with respect to the grain size distribution (large-sized Emulsion B1), and the other of which had an average grain size of 0.39 $\mu$m and a variation coefficient of 0.08 with respect to the grain size distribution (small-sized Emulsion B2); both of which contained 0.8 mole % of silver bromide, in which the bromide was localized in part of the surface of each grain having silver chloride as substrate] were prepared. Then, green-sensitive Sensitizing Dye D illustrated below was added to the Emulsion B1 in the amount of $3.0\times10^{-4}$ mole per mole of silver and to the Emulsion B2 in the amount of $3.6\times10^{-4}$ mole per mole of silver, green-sensitive Sensitizing Dye E illustrated below was added to the Emulsion B1 in the amount of $4.0\times10^{-5}$ mole per mole of silver and to the Emulsion B2 in the amount of $7.0\times10^{-5}$ mole per mole of silver, and green-sensitive Sensitizing Dye F illustrated below was added to the Emulsion B1 in the amount of $2.0\times10^{-4}$ mole per mole of silver and to the Emulsion B2 in the amount of $2.8\times10^{-4}$ mole per mole of silver. The resultant Emulsions B1 and B2 were mixed in a ratio of 1:3 by mole on a silver basis.

The silver chlorobromide Emulsion C used for the fifth layer was obtained as follows: Two kinds of silver chlorobromide emulsions [both of which has a cubic crystal form; one of which had an average grain size of 0.50 $\mu$m and a variation coefficient of 0.09 with respect to the grain size distribution (large-sized Emulsion C1), and the other of which had an average grain size of 0.41 $\mu$m and a variation coefficient of 0.11 with respect to the grain size distribution (small-sized Emulsion C2); both of which contained 0.8 mole % of silver bromide, in which the bromide was localized in part of the surface of each grain having silver chloride as substrate] were prepared. Then, red-sensitive Sensitizing Dyes G and H illustrated below were added to Emulsion C1 in the same amount of $5.0\times10^{-5}$ mole per mole of silver, and to Emulsion C2 in the same amount of $8.0\times10^{-5}$ mole per mole of silver. The resultant Emulsions C1 and C2 were mixed in a ratio of 1:4 by mole on a silver basis.

In each constituent layer, sodium salt of 1-oxy-3,5-dichloro-S-triazine was used as gelatin hardener.

In addition, Cpd-2, Cpd-3, Cpd-4 and Cpd-5 were added to all constituent layers so that their total coverages were 15.0 mg/m$^2$, 60.0 mg/m$^2$, 50.0 mg/m$^2$ and 10.0 mg/m$^2$, respectively.

Blue-Sensitive Sensitizing Dyes.

Sensitizing Dye A

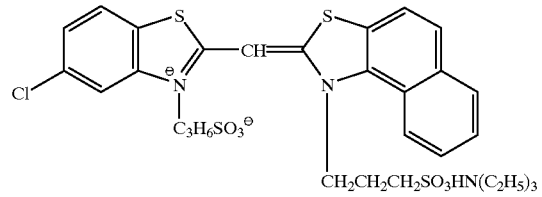

-continued
Sensitizing Dye B
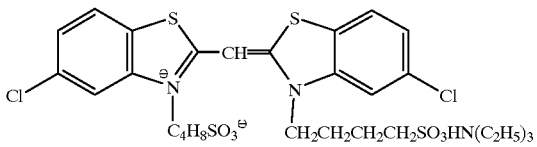
-continued
Sensitizing Dye C
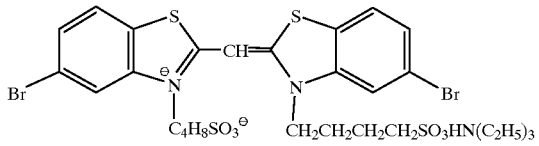
Green-Sensitive Sensitizing Dyes.
Sensitizing Dye D
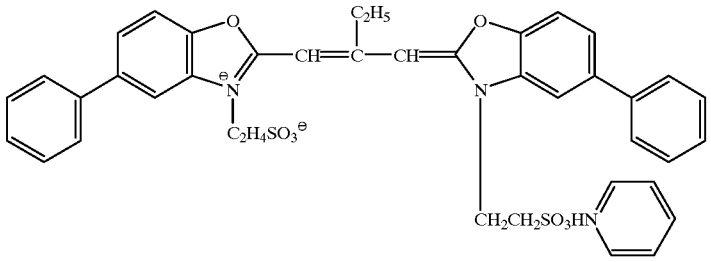
Sensitizing Dye E
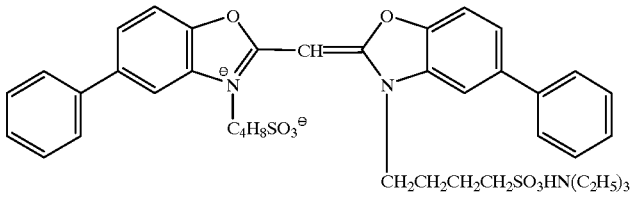
Sensitizing Dye F
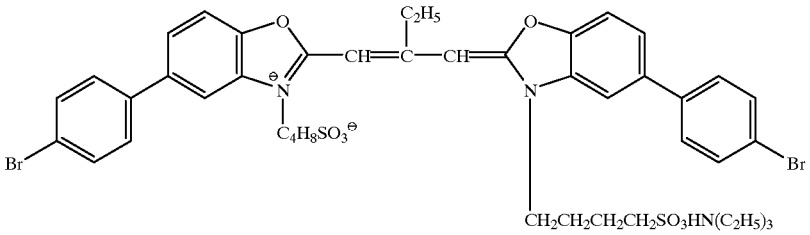
Red-Sensitive Sensitizing Dyes
Sensitizing Dye G
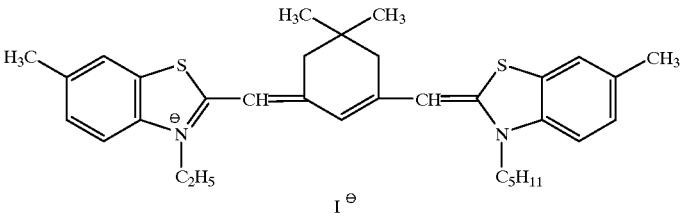

-continued
Sensitizing Dye H
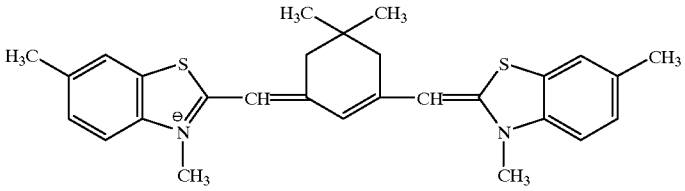
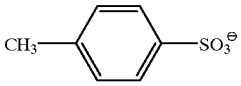
(Solv-1) Solvent
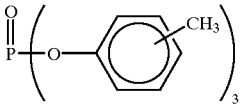
(Solv-2) Solvent
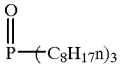
(Cpd-1) Surfactant
7:3 (by weight) Mixture of
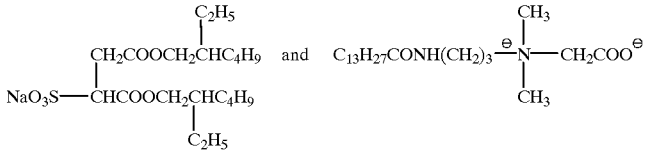
(Cpd-2) Preservative
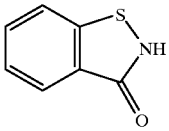
(Cpd-3) Preservative
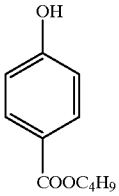
(Cpd-4) Preservative
1:1:1:1 Mixture of a,b,c and d:
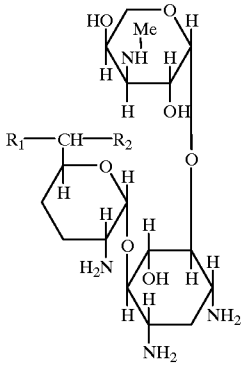
| | $R_1$ | $R_2$ |
|---|---|---|
| a | —Me | —NHMe |
| b | —Me | —$NH_2$ |
| c | —H | —$NH_2$ |
| d | —H | —NHMe |

-continued (Cpd-5) Preservative

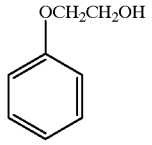

To the fifth layer (red-sensitive layer), the following compound was further added in the amount of $2.6\times10^{-2}$ mole per mole of silver halide:

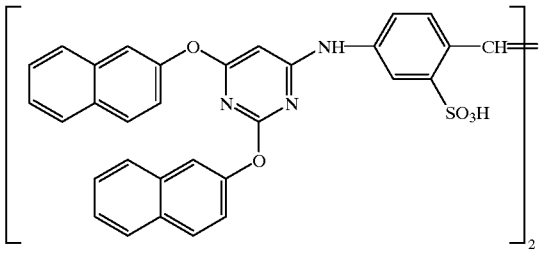

Furthermore, 1-(5-methylureidophenyl)-5-mercaptotetrazole was added to the blue-sensitive emulsion layer, the green-sensitive emulsion layer and the red-sensitive emulsion layer in the amounts of $3.5\times10^{-4}$ mole, $3.0\times10^{-3}$ mole and $2.5\times10^{-4}$ mole, respectively, per mole of silver halide.

In addition, 4-hydroxy-6-methyl-1,3,3a,7-tetraazaindene was added to the blue-sensitive emulsion layer and the green-sensitive emulsion layer in the amounts of $1\times10^{-4}$ mole and $2\times10^{-4}$ mole, respectively, per mole of silver halide.

In order to inhibit an irradiation phenomenon from occurring, the dyes illustrated below (their respective coverages are designated in parentheses) were further added to emulsion layers:

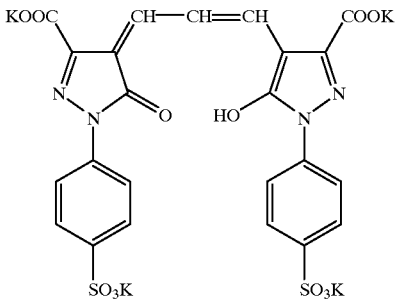

(10 mg/m$^2$)

and

-continued

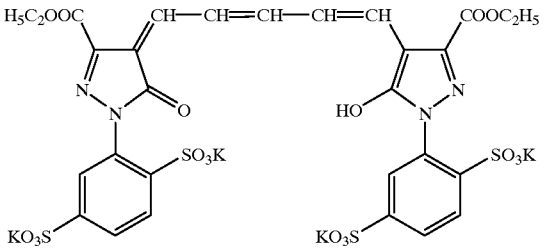

(40 mg/m$^2$)

Layer Structure of Photosensitive Material Containing Therein Reducing Agent for Color Formation The composition of each constituent layer is described below. Each figure on the right side designates the coverage (g/m$^2$)of the ingredient corresponding thereto. As for the silver halide emulsion, the figure represents the coverage based on silver.

Support;

Polyethylene-laminated paper which contained white pigment ($TiO_2$) in an amount of 15 wt % and a bluish dye (ultramarine) in the polyethylene laminate on the side of the first layer.

First Layer (blue-sensitive emulsion layer);

| | |
|---|---|
| The foregoing silver chlorobromide Emulsion A | 0.20 |
| Gelatin | 1.50 |
| Yellow coupler (C-76) | 0.17 |
| Reducing agent for color formation (I-16) | 0.20 |
| Solvent (Solv-2) | 0.80 |

Second Layer (color stain inhibiting layer);

| | |
|---|---|
| Gelatin | 1.09 |
| Color stain inhibitor | 0.11 |
| Solvent (Solv-1) | 0.19 |
| Solvent (Solv-3) | 0.07 |
| Solvent (Solv-4) | 0.25 |
| Solvent (Solv-5) | 0.09 |
| 1,5-Diphenyl-3-pyrazolidone (solid dispersion of fine particles) | 0.03 |

Third Layer (green-sensitive emulsion layer);

| | |
|---|---|
| The foregoing silver chlorobromide Emulsion B | 0.20 |
| Gelatin | 1.50 |
| Magenta coupler (C-56) | 0.24 |
| Reducing agent for color formation (I-16) | 0.20 |
| Solvent (Solv-2) | 0.80 |

Fourth Layer (color stain inhibiting layer);

| | |
|---|---|
| Gelatin | 0.77 |
| Color stain inhibitor | 0.08 |
| Solvent (Solv-1) | 0.14 |
| Solvent (Solv-3) | 0.05 |
| Solvent (Solv-4) | 0.14 |
| Solvent (Solv-5) | 0.06 |
| 1,5-Diphenyl-3-pyrazolidone (solid dispersion of fine particles) | 0.02 |

Fifth Layer (red-sensitive emulsion layer);

| | |
|---|---|
| The foregoing silver chlorobromide Emulsion C | 0.20 |
| Gelatin | 0.15 |
| Cyan coupler (C-43) | 0.21 |
| Reducing agent for color formation (I-16) | 0.20 |
| Solvent (Solv-2) | 0.80 |

Sixth Layer (ultraviolet absorbing layer);

| | |
|---|---|
| Gelatin | 0.64 |
| Ultraviolet absorbent (UV-1) | 0.39 |
| Solvent (Solv-6) | 0.05 |

Seventh Layer (protective layer);

| | |
|---|---|
| Gelatin | 1.01 |
| Acryl-modified polyvinyl alcohol (modification degree: 17%) | 0.04 |
| Liquid paraffin | 0.02 |
| Surfactant | 0.01 |

The structural formulae of the ingredients used herein are illustrated below:

(Cpd-6) Color Stain Inhibitor (1)

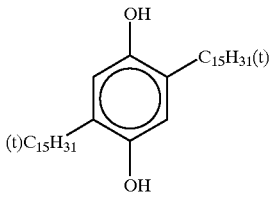

(2)

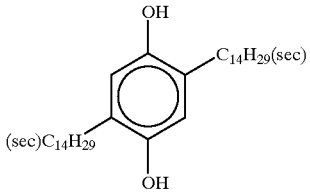

(3)

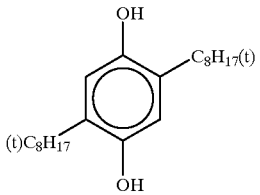

(Cpd-7) Color Image Stabilizer

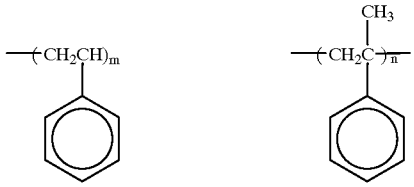

number average molecular weight: 600 m/n: 9/1

(Solv-3) Solvent

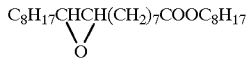

(Solv-4) Solvent

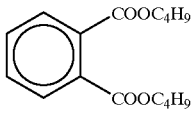

(Solv-5) Solvent

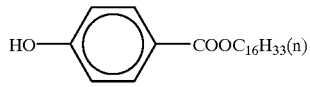

(Solv-6) Solvent

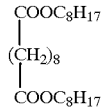

(UV-1) Ultraviolet Absorbent

1:2:2:3:1 (by weight) Mixture of (1), (2), (3), (4) and (5):

(1)

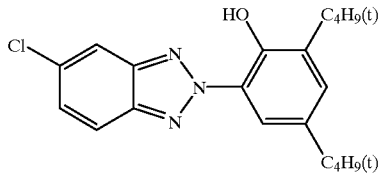

(2)

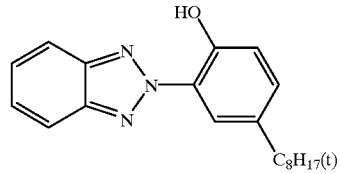

(3)

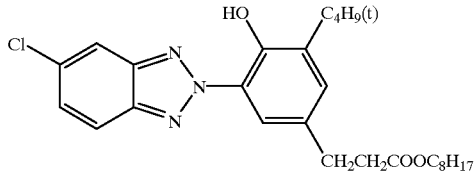

-continued (4)

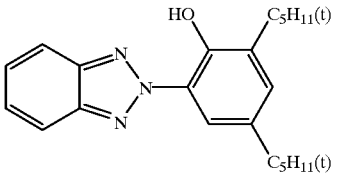

(5)

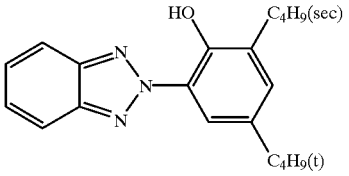

Samples Nos. 101 to 109 were prepared in the same manner as Sample No. 100, except that the couplers and the reducing agent for color formation were changed to those shown in Table 2 in their respective equimolar amounts.

Preparation of Conventional Photosensitive Material Which Contains Therein No Reducing Agent for Color Formation Sample No. 110 was prepared in the same manner as Sample No. 100, except that the couplers were replaced by those shown in Table 2 in their respective equimolar amounts, the reducing agent for color formation was removed from the first, the third and the fifth layers, and 1,5-diphenyl-3-pyrazolidone was removed from the second and the fourth layers.

The structural formulae of the couplers used in the conventional photosensitive material for comparison are illustrated below:

Ex-Y

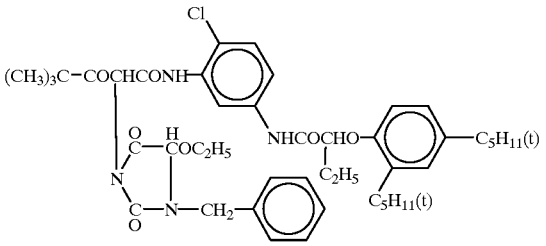

Ex-M

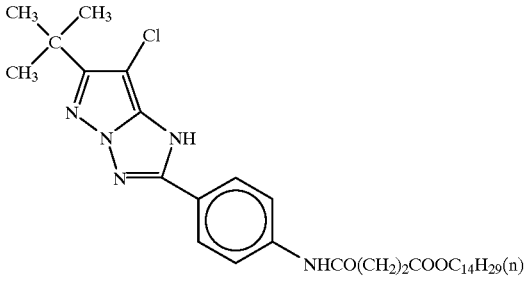

-continued

Ex-C

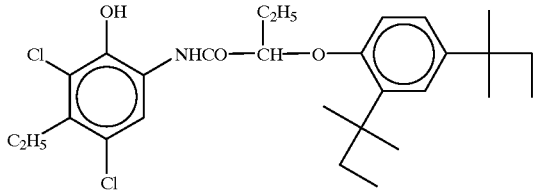

Each of the thus prepared samples was exposed to the following scanning exposure of three color separation.

Scanning Exposure Apparatus and Scanning Exposure

The apparatus used was designed so as to use as light sources a beam of 473 nm picked out by subjecting YAG solid state laser (oscillation wavelength: 946 nm) provided with GaAlAs semiconductor laser (oscillation wavelength: 808.5 nm) as an exciting light source to-wavelength conversion by means of $KNbO_3$ as an SHG crystal, a beam of 532 nm picked out by subjecting $YVO_4$ solid state laser (oscillation wavelength: 1064 nm) provided with GaAlAs semiconductor laser (oscillation wavelength: 808.7 nm) as an exciting light source to wavelength conversion by means of KTP as an SHG crystal, and AlGaInP semiconductor laser (oscillation wavelength: about 670 nm; Type No. TOLD9211, made by Toshiba); and so as to make each of these three laser beams with different colors traverse over a color printing paper by means of a polygon mirror in the direction perpendicular to a traveling direction of the printing paper, thereby effecting successive scanning exposure. Herein, the fluctuation of a semiconductor laser beam in quantity due to variation of temperature was controlled by keeping the temperature constant by the use of a Peltier element.

The laser beams of different wavelengths were each adjusted so as to have an effective beam diameter of 80 $\mu$m on each sample, and gradation exposure was given to each sample by controlling the quantity of exposure with an external modulator. The scanning pitch was adjusted to 400 dpi (63.5 $\mu$m). Thus, the inter-raster overlap width was 21% of the effective beam diameter. In addition, the average exposure time per pixel was $5\times10^{-8}$ sec.

Photographic Processing of Photosensitive Material Containing Therein Reducing Agent for Color Formation After the scanning exposure, each of Sample Nos. 100 to 109 was processed in accordance with the following processing steps using the processing solutions described below.

| Processing Step | Temperature | Amount* replenished | Time | Tank Volume (l) |
|---|---|---|---|---|
| Development | 40° C. | 30 ml | shown in Table 2 | 1.0 |
| Bleach-fix | 40° C. | 30 ml | 20 sec. | 1.0 |
| Rinsing (1) | 30° C. | — | 5 sec. | 0.3 |
| Rinsing (2) | 30° C. | — | 5 sec. | 0.3 |
| Rinsing (3) | 30° C. | — | 5 sec. | 0.3 |
| Rinsing (4) | 30° C. | — | 5 sec. | 0.3 |
| Rinsing (5) | 30° C. | 60 ml | 5 sec. | 0.3 |
| Drying | 80° C. | | 10 sec. | |

*per $m^2$ of photosensitive material

The rinsing was carried out in accordance with a 5-stage counter current process wherein the course of the rinsing solution was from the tank (5) to the tank (1). More specifically, the solution in the rinsing tank (4) was pressed to be sent to a reverse osmosis membrane. The water which had penetrated the membrane was fed to the rinsing tank (5), while the concentrated solution which hadn't penetrated the membrane was sent back to the rinsing tank (4). Additionally, the rinsing solution was passed through blades arranged between rinsing tanks adjacent to each other in order to shorten the crossover time.

Developer

| | Tank Solution | Replenisher |
|---|---|---|
| Water | 600 ml | 600 ml |
| Tripotassium phosphate | 40 g | 52 g |
| KCl | 5 g | — |
| Hydroxyethylidene-1,1-diphosphonic acid (30%) | 4 ml | 4 ml |
| Water to make | 1,000 ml | 1,000 ml |
| pH (25° C.) adjusted to | 12 | 12 |

Bleach-Fix Bath (Tank solution = Replenisher)

| | |
|---|---|
| Water | 600 ml |
| Ammonium thiosulfate (700 g/l) | 93 ml |
| Ammonium sulfite | 40 g |
| Ammonium ethylenediaminetetra-acetatoferrate(III) | 55 g |
| Ethylenediaminetetraacetic acid | 2 g |
| Nitric acid (67%) | 30 g |
| Water to make | 1,000 ml |
| pH adjusted to (at 25° C., with acetic acid and aqueous ammonia) | 5.8 |

Rinsing Bath (Tank solution = Replenisher)

| | |
|---|---|
| Sodium chlorinated isocyanurate | 0.02 g |
| Deionized water (conductivity: below 5 μS/cm) | 1,000 ml |
| pH | 6.5 |

Photographic Processing of Conventional Photosensitive Material Containing Therein No Reducing Agent for Color Formation After the scanning exposure, Sample No. 110 was processed in accordance with the following processing steps using the processing solutions described below.

| Processing Step | Temperature | Amount* replenished | Time | Tank Volume (l) |
|---|---|---|---|---|
| Color Development | 38.5° C. | 73 ml | shown in Table 2 | 0.5 |
| Bleach-fix | 35.0° C. | 60 ml | 20 sec. | 0.5 |
| Rinsing (1) | 35° C. | — | 10 sec. | 0.3 |
| Rinsing (2) | 35° C. | — | 10 sec. | 0.3 |
| Rinsing (3) | 35° C. | 90 ml | 10 sec. | 0.3 |
| Drying | 80° C. | | 10 sec. | |

*per $m^2$ of photosensitive material

The rinsing was carried out in accordance with a 3-stage counter current process wherein the course of the rinsing solution was from the tank (3) to the tank (1).

Color Developer

| | Tank Solution | Replenisher |
|---|---|---|
| Water | 700 ml | 700 ml |
| Sodium triisopropylene(β)sulfonate | 0.1 g | 0.1 g |
| Ethylenediaminetetraacetic acid | 3.0 g | 3.0 g |
| Disodium 1,2-dihydroxybenzene-4,6-disulfonate | 0.5 g | 0.5 g |
| Triethanolamine | 12.0 g | 12.0 g |
| KCl | 6.5 g | — |
| KBr | 0.03 g | — |
| $KCO_3$ | 27.0 g | 27.0 g |
| Brightening agent (WHITEX4, product of Sumitomo Chemical Co., Ltd.) | 1.0 g | 3.0 g |
| Disodium-N,N-bis(sulfonatoethyl)-hydroxylamine | 10.0 g | 13.0 g |
| N-Ethyl-N-(β-methanesulfonamido-ethyl)-3-methyl-4-aminoaniline sulfate | 5.0 g | 11.5 g |
| Water to make | 1,000 ml | 1,000 ml |
| pH (25° C.) adjusted to | 10 | 11.5 |

As for the bleach-fix bath and the rinsing bath, the above-mentioned baths were used respectively.

Each of the thus processed samples was examined for densities of yellow, magenta and cyan dye images via B, G and R filters corresponding to these dyes respectively. The maximum density (Dmax) and the minimum density (Dmin) of each of the colors produced in each sample are shown in Table 2.

For reference, Sample Nos. 100–109 are inventive samples, and Sample No. 110 is a comparative sample.

TABLE 2

| Sample No. | RACP* | Y-Cp | Y-Dmin | Y-Dmax | RACP* | M-Cp | M-Dmin | M-Dmax | RACP* | C-Cp | C-Dmin | C-Dmax | Develop-ment Time |
|---|---|---|---|---|---|---|---|---|---|---|---|---|---|
| 100 | I-16 | C-76 | 0.03 | 1.86 | I-16 | C-56 | 0.03 | 2.05 | I-16 | C-43 | 0.03 | 2.10 | 10 |
| 100 | I-16 | C-76 | 0.05 | 1.97 | I-16 | C-56 | 0.06 | 2.17 | I-16 | C-43 | 0.06 | 2.23 | 20 |
| 100 | I-16 | C-76 | 0.08 | 2.00 | I-16 | C-56 | 0.09 | 2.20 | I-16 | C-43 | 0.09 | 2.26 | 40 |
| 101 | I-16 | C-76 | 0.04 | 1.84 | I-16 | C-56 | 0.04 | 2.02 | I-6 | C-43 | 0.05 | 2.08 | 10 |
| 101 | I-16 | C-76 | 0.05 | 1.88 | I-16 | C-56 | 0.06 | 2.07 | I-6 | C-43 | 0.06 | 2.12 | 20 |
| 101 | I-16 | C-76 | 0.08 | 2.01 | I-16 | C-56 | 0.09 | 2.21 | I-6 | C-43 | 0.09 | 2.27 | 40 |
| 102 | I-16 | C-76 | 0.03 | 1.85 | I-16 | C-56 | 0.03 | 2.04 | I-10 | C-43 | 0.03 | 2.09 | 10 |
| 102 | I-16 | C-76 | 0.05 | 1.86 | I-16 | C-56 | 0.06 | 2.05 | I-10 | C-43 | 0.06 | 2.10 | 20 |
| 102 | I-16 | C-76 | 0.07 | 2.00 | I-16 | C-56 | 0.08 | 2.20 | I-10 | C-43 | 0.08 | 2.26 | 40 |
| 103 | I-24 | C-77 | 0.04 | 1.89 | I-24 | C-56 | 0.04 | 2.08 | I-24 | C-43 | 0.05 | 2.14 | 10 |
| 103 | I-24 | C-77 | 0.05 | 1.99 | I-24 | C-56 | 0.06 | 2.19 | I-24 | C-43 | 0.06 | 2.25 | 20 |
| 103 | I-24 | C-77 | 0.07 | 2.01 | I-24 | C-56 | 0.08 | 2.21 | I-24 | C-43 | 0.08 | 2.27 | 40 |

TABLE 2-continued

| Sample No. | RACP* | Y-Cp | Y-Dmin | Y-Dmax | RACP* | M-Cp | M-Dmin | M-Dmax | RACP* | C-Cp | C-Dmin | C-Dmax | Development Time |
|---|---|---|---|---|---|---|---|---|---|---|---|---|---|
| 104 | I-32 | C-21 | 0.03 | 1.84 | I-32 | C-56 | 0.03 | 2.02 | I-32 | C-69 | 0.03 | 2.08 | 10 |
| 104 | I-32 | C-21 | 0.05 | 1.93 | I-32 | C-56 | 0.06 | 2.12 | I-32 | C-69 | 0.06 | 2.18 | 20 |
| 104 | I-32 | C-21 | 0.08 | 2.03 | I-32 | C-56 | 0.09 | 2.23 | I-32 | C-69 | 0.09 | 2.29 | 40 |
| 105 | I-32 | C-21 | 0.03 | 1.83 | I-32 | C-56 | 0.03 | 2.01 | I-27 | C-69 | 0.03 | 2.07 | 10 |
| 105 | I-32 | C-21 | 0.06 | 1.94 | I-32 | C-56 | 0.07 | 2.13 | I-27 | C-69 | 0.07 | 2.19 | 20 |
| 105 | I-32 | C-21 | 0.09 | 2.05 | I-32 | C-56 | 0.10 | 2.26 | I-27 | C-69 | 0.10 | 2.32 | 40 |
| 106 | I-39 | C-21 | 0.03 | 1.84 | I-32 | C-56 | 0.03 | 2.02 | I-32 | C-69 | 0.03 | 2.08 | 10 |
| 106 | I-39 | C-21 | 0.07 | 1.95 | I-32 | C-56 | 0.08 | 2.15 | I-32 | C-69 | 0.08 | 2.20 | 20 |
| 106 | I-39 | C-21 | 0.09 | 2.06 | I-32 | C-56 | 0.10 | 2.27 | I-32 | C-69 | 0.10 | 2.33 | 40 |
| 107 | I-61 | C-14 | 0.08 | 1.77 | I-61 | C-40 | 0.09 | 1.95 | I-61 | C-44 | 0.09 | 2.00 | 10 |
| 107 | I-61 | C-14 | 0.12 | 1.90 | I-61 | C-40 | 0.13 | 2.09 | I-61 | C-44 | 0.14 | 2.15 | 20 |
| 107 | I-61 | C-14 | 0.14 | 1.95 | I-61 | C-40 | 0.15 | 2.15 | I-61 | C-44 | 0.16 | 2.20 | 40 |
| 108 | I-61 | C-14 | 0.09 | 1.76 | I-61 | C-40 | 0.10 | 1.94 | I-82 | C-44 | 0.10 | 1.99 | 10 |
| 108 | I-61 | C-14 | 0.13 | 1.89 | I-61 | C-40 | 0.14 | 2.08 | I-82 | C-44 | 0.15 | 2.14 | 20 |
| 108 | I-61 | C-14 | 0.16 | 1.94 | I-61 | C-40 | 0.18 | 2.13 | I-82 | C-44 | 0.18 | 2.19 | 40 |
| 109 | I-67 | C-14 | 0.08 | 1.75 | I-61 | C-40 | 0.09 | 1.93 | I-61 | C-44 | 0.09 | 1.98 | 10 |
| 109 | I-67 | C-14 | 0.11 | 1.86 | I-61 | C-40 | 0.12 | 2.05 | I-61 | C-44 | 0.12 | 2.10 | 20 |
| 109 | I-67 | C-14 | 0.15 | 1.92 | I-61 | C-40 | 0.17 | 2.11 | I-61 | C-44 | 0.17 | 2.17 | 40 |
| 110 | — | Ex-Y | 0.03 | 1.24 | — | Ex-M | 0.03 | 1.36 | — | Ex-C | 0.03 | 1.40 | 30 |
| 110 | — | Ex-Y | 0.05 | 1.35 | — | Ex-M | 0.06 | 1.49 | — | Ex-C | 0.06 | 1.53 | 45 |
| 110 | — | Ex-Y | 0.05 | 1.55 | — | Ex-M | 0.06 | 1.71 | — | Ex-C | 0.06 | 1.75 | 60 |

*RACP stands for "reducing agent for color formation".
Cp stands for "coupler", Y for "yellow", M for "magenta" and C for "cyan".

As can be seen from Table 2, the conventional photosensitive material (Sample No. 110), which contained therein no reducing agent for color formation, produced colors having low maximum densities when underwent the scanning exposure, so that it was unsuitable for scanning exposure. On the other hand, it was proved that high densities of colors were produced when the photosensitive materials (Sample Nos. 100 to 109), which each contained therein the present reducing agent for color formation, were subjected to the scanning exposure, and further the development of the present photosensitive materials proceeded faster than the conventional one. In particular, the incorporation of carbamoylhydrazines as the reducing agent for color formation (Sample Nos. 100 to 106) produced greater effects than the incorporation of the others (Sample Nos. 107 to 109).

ing the maximum density (Dmax) and the minimum density (Dmin) of each of the colors produced. The value obtained by subtracting the density before storage ($D^s$) from the density after storage ($D^f$) i.e., ΔD, was calculated with respect to the maximum density and the minimum density of each sample. The results obtained are shown in Table 3.

Additionally, ΔDmin and ΔDmax are defined as follows:

$$\Delta Dmin = D^f min - D^s min$$

$$\Delta Dmax = D^f max - D^s max$$

TABLE 3

| Sample | Yellow | | | | Magenta | | | | Cyan | | |
|---|---|---|---|---|---|---|---|---|---|---|---|
| No. | RACP* | Cp | ΔDmin | ΔDmax | RACP* | CP | ΔDmin | ΔDmax | RACP* | Cp | ΔDmin | ΔDmax |
| 100 | I-16 | C-76 | 0.11 | −0.04 | I-16 | C-56 | 0.12 | −0.04 | I-16 | C-43 | 0.12 | −0.05 |
| 101 | I-16 | C-76 | 0.12 | −0.03 | I-16 | C-56 | 0.13 | −0.03 | I-6 | C-43 | 0.14 | −0.03 |
| 102 | I-16 | C-76 | 0.11 | −0.02 | I-16 | C-56 | 0.12 | −0.03 | I-10 | C-43 | 0.12 | −0.03 |
| 103 | I-24 | C-77 | 0.12 | −0.03 | I-24 | C-56 | 0.13 | −0.04 | I-24 | C-43 | 0.14 | −0.04 |
| 104 | I-32 | C-21 | 0.15 | −0.04 | I-32 | C-56 | 0.17 | −0.04 | I-32 | C-69 | 0.17 | −0.05 |
| 105 | I-32 | C-21 | 0.11 | −0.04 | I-32 | C-56 | 0.12 | −0.04 | I-27 | C-69 | 0.12 | −0.04 |
| 106 | I-39 | C-21 | 0.13 | −0.02 | I-32 | C-56 | 0.14 | −0.03 | I-32 | C-69 | 0.15 | −0.03 |
| 107 | I-61 | C-14 | 0.30 | −0.03 | I-61 | C-40 | 0.33 | −0.03 | I-61 | C-44 | 0.34 | −0.04 |
| 108 | I-61 | C-14 | 0.33 | −0.04 | I-61 | C-40 | 0.36 | −0.04 | I-82 | C-44 | 0.37 | −0.05 |
| 109 | I-67 | C-14 | 0.31 | −0.03 | I-61 | C-40 | 0.34 | −0.04 | I-61 | C-44 | 0.35 | −0.04 |

*RACP stands for "reducing agent for color formation.
Cp stands for "coupler".

EXAMPLE 2

The same photosensitive materials as prepared in Example 1 (Sample Nos. 100 to 109) were each subjected to the same scanning exposure and photographic processing as in Example 1, and stored for one week in a room thermo-hygrostated at 80° C.-70%. Thereafter, each of the thus stored samples was examined for densities of yellow, magenta and cyan dye images via B, G and R filters corresponding to these dyes respectively, thereby determin- As can be seen from Table 3, the Sample Nos. 107 to 109 were undesirable because they had stains on a white background after storage. In the Sample Nos. 100 to 106, on the other hand, the generation of those stains after storage were inhibited and high maximum densities were kept even after the storage, that is, satisfactory image condition was retained.

EXAMPLE 3

Sample Nos. 300 to 309 were prepared in the same manner as Sample Nos. 100 to 109 respectively in Example 1, except that the coverage of silver of the first layer, that of the third layer and that of the fifth layer were changed to 0.01 $g/m^2$, 0.01 $g/m^2$ and 0.015 $g/m^2$ respectively.

After the same scanning exposure operation as in Example 1, the Sample Nos. 300 to 309 were each processed with the same manner as in Example 1, except that the development step was carried out using the intensifier obtained by adding hydrogen peroxide to the developer used in Example 1 in a concentration of 0.3% and adjusting the pH thereof to 12.0. As a result, similarly to those prepared in Example 1, these photosensitive materials showed no appreciable lowering of densities of developed colors, although they had a sharply decreased silver coverage.

Further, the incorporation of carbamoylhydrazine compounds into photosensitive materials enabled a reduction in generation of stains after processing.

Thus, the present image formation method has proved to be effective also in forming images by subjecting a photosensitive material having low silver coverage to the amplification processing with an intensifier.

In accordance with embodiments of the present invention, the lowering of maximum densities of produced colors due to scanning exposure can be inhibited, the image formation can be effected using a developer having a simplified composition to result in reduction in replenisher volume and effluent volume, the images formed can have excellent keeping quality, and fast proceeding of development can be achieved.

It should further be apparent to those skilled in the art that various changes in form and detail of the invention as shown and described above may be made. It is intended that such changes be inclined within spirit and scope of the claimed appended hereto.

What is claimed is:

1. A method of image formation comprising the steps of:

subjecting a silver halide color photographic material to scanning exposure with a beam modulated in accordance with image information to prepare a scanning-exposed photographic material, wherein the silver halide color photographic material comprises a support having provided thereon a photographic constituent layer containing at least one reducing agent for color formation represented by formula (I) and at least one dye-forming coupler, and wherein a scanning pitch of the beam is smaller than an effective beam diameter of the beam, and an inter-raster overlap width of the beam is from 5% to 95% of the effective beam diameter; and developing the scanning-exposed photographic material in an alkali bath free from a developing agent;

$$R^{11}—NHNH—X—R^{12} \quad (I)$$

wherein $R^{11}$ represents an aryl group or a heterocyclic group; $R^{12}$ represents an alkyl group, an alkenyl group, an alkinyl group, an aryl group or a heterocyclic group; X represents $—SO_2—$, —CO—, —COCO—, —CO—O—, $—CON(R^{13})—$, —COCO—O—, $—COCO—N(R^{13})—$ or $—SO_2—N(R^{13})—$; and $R^{13}$ is a hydrogen atom, an alkyl group, an alkenyl group, an alkinyl group, an aryl group or a heterocyclic group.

2. A method of image formation as claimed in claim 1, wherein the reducing agent for color formation represented by formula (I) is a compound represented by the following formula (II) or (III):

(II)

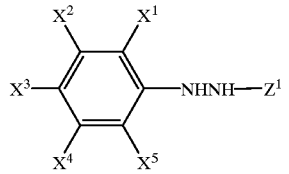

(III)

wherein $Z^1$ represents an acyl group, a carbamoyl group, an alkoxycarbonyl group or an aryloxycarbonyl group; $Z^2$ represents a carbamoyl group, an alkoxycarbonyl group or an aryloxycarbonyl group; $X^1$, $X^2$, $X^3$, $X^4$ and $X^5$ each represents a hydrogen atom or a substituent group, provided that the sum of the Hammett's $\sigma_p$ values of $X^1$, $X^3$ and $X^5$ and the Hammett's $\sigma_m$ values of $X^2$ and $X^4$ is from 0.80 to 3.80; and $R^3$ represents a heterocyclic group.

3. A method of image formation as claimed in claim 2, wherein the compounds represented by formulae (II) and (III) are compounds represented by the following formulae (IV) and (V), respectively:

(IV)

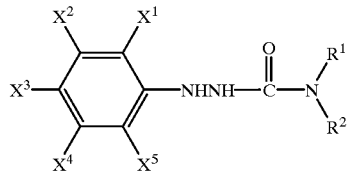

(V)

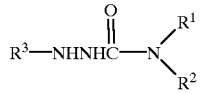

wherein $R^1$ and $R^2$ each represents a hydrogen atom or a substituent group; $X^1$, $X^2$, $X^3$, $X^4$ and $X^5$ each represents a hydrogen atom or a substituent group, provided that the sum of the Hammett's $\sigma_p$ values of $X^1$, $X^3$ and $X^5$ and the Hammett's $\sigma_m$ values of $X^2$ and $X^4$ is from 0.80 to 3.80; and $R^3$ represents a heterocyclic group.

4. A method of image formation as claimed in claim 3, wherein the compounds represented by the formulae (IV) and (V) are compounds represented by the following formulae (VI) and (VII), respectively:

(VI)

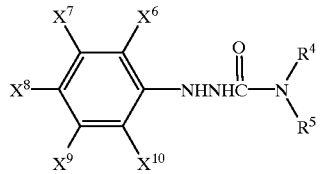

(VII)

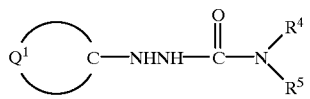

wherein $R^4$ and $R^5$ each represents a hydrogen atom or a substituent group; $X^6$, $X^7$, $X^8$, $X^9$ and $X^{10}$ each represents a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group or a heterocyclic group, provided that the sum of the Hammett's $\sigma_p$ values of $X^6$, $X^8$ and $X^{10}$ and the Hammett's $\sigma_m$ values of $X^7$ and $X^9$ is from 1.20 to 3.80; and $Q^1$ represents a nonmetallic atomic group for forming a nitrogen-containing 5- to 8-membered hetero ring together with the carbon atom.

5. A method of image formation as claimed in claim 1, wherein the inter-raster overlap width of the scanning exposure is from 20% to 80% of the effective beam diameter.

6. A method of image formation as claimed in claim 1, wherein the silver halide color photographic material has a total silver halide coverage of from 0.003 to 0.3 $g/m^2$, based on silver.

7. The method of image formation as claimed in claim 1, where the silver halide color photographic material comprises a blue-sensitive emulsion layer, a green-sensitive emulsion layer and a red-sensitive emulsion layer.

* * * * *